US008416171B2

(12) United States Patent
Murahashi et al.

(10) Patent No.: US 8,416,171 B2
(45) Date of Patent: Apr. 9, 2013

(54) DISPLAY DEVICE AND TELEVISION SYSTEM INCLUDING A SELF-HEALING DRIVING CIRCUIT

(75) Inventors: Shunichi Murahashi, Nabari (JP); Masafumi Katsutani, Nara (JP); Hiroaki Fujino, Kizugawa (JP); Shinsuke Anzai, Fukuyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/225,182

(22) PCT Filed: May 26, 2008

(86) PCT No.: PCT/JP2008/059679

§ 371 (c)(1), (2), (4) Date: Sep. 16, 2008

(87) PCT Pub. No.: WO2008/146799

PCT Pub. Date: Dec. 4, 2008

(65) Prior Publication Data

US 2010/0225635 A1 Sep. 9, 2010

(30) Foreign Application Priority Data

May 29, 2007 (JP) ..... 2007-142625
Oct. 3, 2007 (JP) ..... 2007-260378
May 19, 2008 (JP) ..... 2008-130848

(51) Int. Cl.
*G09G 3/36* (2006.01)

(52) U.S. Cl.
USPC ..... 345/93; 345/904

(58) Field of Classification Search ..... 345/93, 345/904
See application file for complete search history.

(56) References Cited

U.S. PATENT DOCUMENTS 5,465,053 A 11/1995 Edwards
5,859,627 A 1/1999 Hoshiya et al.

(Continued)

FOREIGN PATENT DOCUMENTS

JP 1-225996 9/1989
JP 3-296714 12/1991

(Continued)

OTHER PUBLICATIONS

International Search Report dated Dec. 15, 2009 issued in corresponding PCT/JP2009/069839.

(Continued)

*Primary Examiner* — Adam J Snyder
(74) *Attorney, Agent, or Firm* — Harness, Dickey & Pierce, P.L.C.

(57) ABSTRACT

In one embodiment of the present invention, a liquid crystal driving semiconductor IC for driving a display panel includes an output terminal connected to the display panel, an output circuit block including a DAC circuit, and a spare output block including a DAC circuit, the DAC circuits and being connectable to the output terminal. The IC includes an op amp for comparing output signal from the DAC circuit with that of the DAC circuit, and judging circuit for judging, based on the comparison result of the op amp, whether the DAC circuit is defective, and switches and for, if the DAC circuit is defective, connecting the spare DAC circuit to the output terminal in replacement of the defective DAC circuit. This provides an IC for driving a display device, which IC has concrete measures to easily detect a defect in an output circuit, and can perform self-healing for the defect in the output circuit.

12 Claims, 27 Drawing Sheets

U.S. PATENT DOCUMENTS

| | | | | |
|---|---|---|---|---|
| 5,923,512 | A | 7/1999 | Brownlow et al. | |
| 5,926,156 | A | 7/1999 | Katoh et al. | |
| 5,956,008 | A | 9/1999 | Kawasaki et al. | |
| 5,995,073 | A | 11/1999 | Isami et al. | |
| 6,166,725 | A | 12/2000 | Isami et al. | |
| 6,492,802 | B1 | 12/2002 | Bielski | |
| 6,707,437 | B1 | 3/2004 | Kuno et al. | |
| 6,816,143 | B1 | 11/2004 | Lambert | |
| 7,138,975 | B2 | 11/2006 | Koyama | |
| 7,190,338 | B2 | 3/2007 | Kubota et al. | |
| 7,280,090 | B2 * | 10/2007 | Keeney et al. | 345/93 |
| 7,474,290 | B2 | 1/2009 | Makuuchi et al. | |
| 2002/0011971 | A1 | 1/2002 | Hamamoto et al. | |
| 2002/0030656 | A1 | 3/2002 | Goto et al. | |
| 2002/0041278 | A1 * | 4/2002 | Matsueda | 345/204 |
| 2002/0075248 | A1 | 6/2002 | Morita et al. | |
| 2002/0113766 | A1 * | 8/2002 | Keeney et al. | 345/93 |
| 2003/0063077 | A1 | 4/2003 | Koyama | |
| 2005/0024971 | A1 * | 2/2005 | Lambert | 365/222 |
| 2005/0077957 | A1 | 4/2005 | Kasai et al. | |
| 2005/0110738 | A1 | 5/2005 | Kim et al. | |
| 2005/0122300 | A1 | 6/2005 | Makuuchi et al. | |
| 2006/0192737 | A1 | 8/2006 | Goto et al. | |
| 2006/0226899 | A1 | 10/2006 | Kasai et al. | |
| 2007/0070061 | A1 | 3/2007 | Koyama | |
| 2008/0111773 | A1 | 5/2008 | Tsuge | |
| 2008/0231573 | A1 | 9/2008 | Goto et al. | |
| 2008/0252369 | A1 | 10/2008 | Kasai et al. | |
| 2008/0303577 | A1 | 12/2008 | Higuchi | |
| 2010/0225635 | A1 | 9/2010 | Murahashi et al. | |

FOREIGN PATENT DOCUMENTS

| | | | |
|---|---|---|---|
| JP | 6-208346 | | 7/1994 |
| JP | 6-324651 | | 11/1994 |
| JP | 8-76723 | | 3/1996 |
| JP | 8-184804 | | 7/1996 |
| JP | 8-185144 | | 7/1996 |
| JP | 8-202320 | | 8/1996 |
| JP | 08-278771 | | 10/1996 |
| JP | 9-15557 | | 1/1997 |
| JP | 09-281930 | | 10/1997 |
| JP | 09312569 | A * | 12/1997 |
| JP | 10-339861 | | 12/1998 |
| JP | 2002-23712 | | 1/2002 |
| JP | 2002-32048 | | 1/2002 |
| JP | 2002-40997 | | 2/2002 |
| JP | 2002-043943 | | 2/2002 |
| JP | 2002-72979 | | 3/2002 |
| JP | 2003-108074 | | 4/2003 |
| JP | 2004-511022 | | 4/2004 |
| JP | 2004165948 | A * | 6/2004 |
| JP | 2005-117547 | | 4/2005 |
| JP | 2005-157321 | | 6/2005 |
| JP | 2005-351959 | | 12/2005 |
| JP | 2006-119225 | | 5/2006 |
| JP | 2007-316675 | | 12/2007 |
| JP | 2008-139861 | | 6/2008 |
| JP | 2008-268473 | | 11/2008 |
| JP | 2009-8891 | | 1/2009 |
| JP | 2009-104106 | | 4/2009 |
| JP | 2009-128532 | | 6/2009 |
| JP | 2009-205000 | | 9/2009 |
| JP | 2009-205001 | | 9/2009 |
| JP | 2009-210838 | | 9/2009 |
| JP | 2010-78869 | | 4/2010 |
| JP | 2010-78870 | | 4/2010 |
| JP | 2010-81254 | | 4/2010 |
| JP | 2010-81255 | | 4/2010 |
| TW | 200519825 | | 6/2005 |
| TW | 1248327 | | 1/2006 |
| WO | WO 01/39163 | | 5/2001 |

OTHER PUBLICATIONS

English version of International Search Report dated Mar. 17, 2009 for PCT/JP2009/051987.

International Search Report dated Aug. 26, 2008, issued in corresponding Application No. PCT/JP2008/059679.

* cited by examiner

DISPLAY DEVICE AND TELEVISION SYSTEM INCLUDING A SELF-HEALING DRIVING CIRCUIT

TECHNICAL FIELD

The present invention relates to a driving circuit for driving a display panel, which driving circuit performs self-inspection of a defect in a DA converter output circuit, and self-healing of such a defect in the DA converter output circuit.

BACKGROUND ART

Recently, semiconductor integrated circuits for driving liquid crystal have been improved to have more output terminals for driving liquid crystal and to output multi-value voltages in more gray scales from the output terminals, according to improvement of liquid crystal panel to be larger in size and higher in definition. For example, some of currently-most-prevalent semiconductor integrated circuits for driving liquid crystal include about 500 output terminals thereby being capable of outputting 256-gray scale voltages. Moreover, such a liquid crystal driving semiconductor integrated circuit is under development that includes 1000 or more output terminals. Moreover, as to gray scale output voltages, such a liquid crystal driving semiconductor integrated circuit is under development in response to increase in colors in the liquid crystal panels that is capable of outputting 1024 gray scales.

An arrangement of a conventional liquid crystal driving semiconductor integrated circuit is explained below referring to FIG. 27, which is a block diagram illustrating the arrangement of the conventional semiconductor integrated circuit.

The semiconductor integrated circuit 101 for driving liquid crystal illustrated in FIG. 27 is capable of outputting m-gray scale output voltages from n-number output terminals for driving liquid crystal. Firstly, the arrangement of the semiconductor integrated circuit 101 for driving liquid crystal is explained. The semiconductor integrated circuit 101 externally includes a clock input terminal 102, a gray scale date input terminal 103, a LOAD signal input terminal 104, V0 terminal 105, V1 terminal 106, V2 terminal 107, V3 terminal 108, and V4 terminal 109. The gray scale date input terminal 103 includes a plurality of signal input terminals. The V0 terminal 105, V1 terminal 106, V2 terminal 107, V3 terminal 108, and V4 terminal 109 are reference power source terminals.

The semiconductor integrated circuit 101 includes an n number of signal output terminals 111-1 to **111-*n* for driving the liquid crystal (hereinafter, the signal output terminals for driving the liquid crystal are referred to as the signal output terminals, and signal output terminals 111-1 to 111-*n* are referred to as the signal output terminals 111, collectively). Moreover, the semiconductor integrated circuit 101 includes a reference power source comparator circuit 121, a pointer shift register circuit 123, a latch circuit section 124, a hold circuit 125, a D/A converter (Digital Analog Converter: hereinafter, referred to as DAC) circuit 126, and an output buffer 127. The pointer shift register circuit 123 is constituted by n stages of shift register circuits 123-1 to 123-*n*. Further, the latch circuit section 124 is constituted by an n number of latch circuits 124-1 to 124-*n*. The hold circuit 125 is constituted by an n number of hold circuits 125-1 to 125-*n*. Moreover, the DAC circuit 126 is constituted by an n number of DAC circuits 126-1 to 126-*n*. In addition, the output buffer 127 is constituted by an n number of output buffers 127-1 to 127-*n***, each of which is constituted by an operational amplifier.

Next, described is how the semiconductor integrated circuit 101 is operated. The pointer shift register circuit 123 selects the latch circuits 124 sequentially from the latch, circuits 124-1 to **124-*n* according to the clock input signal inputted via the clock input terminal 102. The latch circuit 124 that is selected by the pointer shift register circuit 123 stores gray scale output data supplied from the gray scale data input terminal 103. The gray scale output data is data to be supplied to the corresponding one of the latch circuits 124, that is, to the corresponding one of the signal output terminals 111, and is in synchronism with the clock input signal. Therefore, the latch circuits 124-1 to 124-*n* can store gray scale output data of different values for the signal output terminals respectively corresponding to the latch circuits 124-1 to 124-*n*. The gray scale output data stored in the latch circuits 124-1 to 124-*n* is forwarded to the corresponding hold circuit 125-1 to 125-*n* respectively. Further, the hold circuits 125-1 to 125-*n* receives the gray scale output data and then output the gray scale output data to the DAC circuits 126-1 to 126-** as digital data.

The DAC circuits 126-1 to **126-*n* respectively select one voltage value among gray scale voltages of m levels, based on the gray scale output data respectively supplied from the corresponding hold circuits 125. Then, the DAC circuits 126-1 to 126-*n* each output the selective voltage value to the output buffer 127-1 to 127-*n* respectively. The DAC circuits 126 can output the gray scale voltages of m levels according to the voltage inputted respectively via the reference power source V0 terminal 105 to V4 terminals 109. Next, the output buffers 127 buffer the gray scale voltages respectively supplied from the DAC circuits 126, and then output the buffered voltages to the corresponding signals output terminals 111** as liquid crystal panel driving signals.

As described above, the shift register circuits 123, the latch circuits 124, hold circuits 125, DAC circuits 126, and output buffers 127 are necessary as many as the liquid crystal driving signal output terminals 111. If 1000 of the liquid crystal driving signal output terminals are provided, 1000 each of the circuits 124 to 127 should be necessary.

As described above, the display apparatus such has liquid crystal panels have been improved to be large in size and higher in definition. As a result, a full-spec high definition television (HDTV) has 1920 data lines. As the display driving semiconductor integrated circuits should provide gray scale voltage signals for each of RGB, the display driving semiconductor integrated circuits should have 5760 (1920×3) outputs, in other words, 5760 signal output terminals for driving the liquid crystal. If one display driving semiconductor integrated circuit had 720 outputs, 8 display driving semiconductor integrated circuit s should be necessary.

In general, the display driving semiconductor integrated circuit is tested while it is still in the wafer form, and then subjected to pre-shipment test after packaging. Then, the display driving semiconductor integrated circuit is subjected to display test after being mounted on a liquid crystal panel. Furthermore, the display driving semiconductor integrated circuit is subjected to screening test in terms of burning-in and stress. Thereby, a display driving semiconductor integrated circuit that may cause a defect in an initial stage is omitted. This eliminate a possibility of shipping, to a market, a display apparatus with a display driving semiconductor integrated circuit that may cause display defect. However, in rare cases, a display defect would happen in use of the display apparatus due to a very minor defect or contamination, which is not judged as being defect in the pre-shipment test or the screening test. For example, even if a possibility of display defect after the shipment is 0.01 ppm (one in hundred millions) per data line in the display driving semiconductor integrated circuit, a full-spec HDTV having 5760 data lines has a possibility of display defect of 57.6 ppm (57.6 in hundred millions). That is, about one HDTV in 17361 HDTVs causes a display defect. Thus, an apparatus large in size and higher in definition has a higher possibility of causing a display defect.

Such a display apparatus with a display defect should be collected promptly in order that its defective display driving semiconductor integrated circuit may be healed from a defect. This collection not only requires a large cost but damages a brand image of the display apparatus.

A conventional art discloses an art that a display driving semiconductor integrated circuit includes a spare circuit for replacing a defective circuit, so that the display driving semiconductor integrated circuit can avoid from being defective by replacing the defective circuit with the spare circuit.

Specifically, Patent Document 1 discloses an art in which a display driving semiconductor integrated circuit includes spare circuits each of which is in parallel with corresponding one of stages of a shift register, and the display driving semiconductor integrated circuit performs self-inspection to inspect the shift register selects either one of each said parallel circuit. Furthermore, Patent Document 2 discloses a method including providing a selector at each of input and output of DAC circuits and switching over the selector according to information in a RAM in which a position of a defective DAC circuit is stored, so as to select non-defective circuits to use.

[Patent Document 1]

Japanese Unexamined Patent Application Publication, Tokukaihei, No. 6-208346 (published on Jul. 26, 1994)

[Patent Document 1]

Japanese Unexamined Patent Application Publication, Tokukaihei, No. 8-278771 (published on Oct. 22, 1996)

DISCLOSURE OF INVENTION

However, Patent Document 1 does not disclose how to detect a defect or to heal from a defect by self-healing in output circuits such as DAC circuits, other than the shift register, while Patent Document 1 discloses the method including providing the spare circuits in parallel with the shift register and detecting a defect in the shift register, and the self-healing method in which a defective shift register is replaced with a spare shift register.

Moreover, Patent Document 2 does not disclose how to detect a defective DAC circuit, at all.

An object of the present invention is to provide a driving circuit for driving a display panel, the driving circuit having (i) means for easily detecting a defect in an output circuit or an output block around the output circuit even after mounting the display circuit to a display device, and (ii) a self-healing ability with which the driving circuit can perform self healing in case where an output circuit or an output circuit block is defective.

In order to attain the object, a driving circuit according to the present invention is a driving circuit for driving a display panel, comprising: an output terminal connected to the display panel; an output circuit block including an output circuit capable of being connected with the output terminal; and a spare output circuit block including a spare output circuit capable of being connected with the output terminal, the driving circuit further comprising: comparing means for comparing an output signal from an output circuit with an output signal from the spare output circuit; judging means for judging, based on a result of the comparison performed by the comparing means, whether or not the output circuit is defective; and connection switching means for, if the judging means judges that the output circuit is defective, connecting the spare output circuit to the output terminal, instead of the output circuit.

To begin with, the driving circuit according to the present invention is for driving the display panel. Thus, the driving circuit basically operates to output a gray scale voltage to the output terminal connected to the display panel, so that the display panel is driven with the gray scale voltage.

With this configuration, the comparing means compares an output signal from an output circuit with the output signal from the spare output circuit, the output circuit being included in an output block connected to an output terminal, and the spare output circuit being included in the spare output block being not connected with the output terminal. The comparing means compares two output signal, in other words, two gray scale voltages, and outputs signal of different values depending on whether the output signal is defective or not.

More specifically, for example, assume that an input signal of gray scale m is inputted in an output circuit and an input signal of gray scale m+1 is inputted in the spare output circuit. The gray scale voltage of gray scale m is lower than the gray scale voltage of gray scale m+1. If the output circuit is not defective, the comparing means outputs a signal indicating that the gray scale voltage inputted in the spare output circuit is higher. If the output circuit is defective and can output only a high gray scale voltage even though the output circuit receives the signal of gray scale m, the comparing means outputs a signal indicating that the gray scale voltage inputted in the output circuit is higher.

As described above, the driving circuit according to the present invention is configured such that the comparing means compares the gray scale voltages outputted from the output circuit and the spare output circuit, and outputs signals of different values depending on whether the output circuit is defective or not.

Next, the judging means judges, based on the signal outputted from the comparing means, whether or not the output circuit is defective. More specifically, assuming as above that an input signal of gray scale m is inputted in an output circuit and an input signal of gray scale m+1 is inputted in the spare output circuit, the judging means judges the output circuit is defective, if the judging means receives from the comparing means a signal that indicates that the gray scale voltage from the output circuit is higher. On the other hand, the judging means judges the output circuit is not defective, if the judging means receives from the comparing means a signal that indicates that the gray scale voltage from the spare output circuit is higher.

Furthermore, the driving circuit according to the present invention includes the connection switching means for connecting the spare output circuit to the output terminal, instead of the output circuit if the judging means judges that the output circuit is defective. Therefore, if the judging means judges that an output circuit is defective, the driving circuit can disconnect the defective output circuit from the output terminal and connect the spare output circuit with the output terminal, by using the connection switching means.

As described above, the driving circuit according to the present invention has concrete means for detecting a defect in the output circuit easily after the driving circuit is mounted on the display panel, and is able to perform self-healing if the output circuit is defective.

The driving circuit according to the present invention is preferably configured such that the comparing means is an operational amplifier.

In general, the output signal for driving the display panel, which output signal is outputted from the output circuit is buffered before being inputted to the output terminal. In this configuration, the operational amplifier performs negative feed back by connecting the output thereof to the negative input terminal, thereby being an voltage follower circuit. Thereby, the operational amplifier functions as a buffer circuit.

Therefore, with the configuration in which the comparing means is the operational amplifier, the operational amplifier has a role of a buffer circuit for buffering the output signal from the output circuit. Thus, the driving circuit according to the present invention does not need to have a buffer for buffering the output signal from the output circuit, thereby having a low cost.

The driving circuit according to the present invention may be preferably configured such that the output circuit block and the spare output circuit block further include an output buffer formed by using an operational amplifier; the operational amplifier is used as the comparing means; and if the judging means judges that the output circuit is defective, the spare output circuit block is connected to the output terminal, instead of the output circuit block.

The use of the circuits that are actually used makes it possible to perform the self-healing if the output circuit and the output buffer are defective.

The driving circuit according to the present invention may be preferably configured such that the output circuit block and the spare output circuit block further include (i) an output buffer formed by using an operational amplifier, and (ii) a circuit for recording a signal that is to be supplied to input terminals of said output circuits; the operational amplifier is used as the comparing means; and if the judging means judges that the output circuit is defective, the spare output circuit block is connected to the output terminal, instead of the output circuit block.

The use of the circuits that are actually used makes it possible to perform the self-healing if the output circuit and the output buffer are defective.

The driving circuit according to the present invention preferably comprises: control means for controlling an input signal that is to be inputted to the output circuit and the spare output circuit, the control means inputting input signals of different size to the output circuit and the spare output circuit, respectively, the control means outputting an expected value that indicates an expected result of the comparison performed with the input signals of different sizes by the comparing means, and if the result of the comparison is different from the expected value, the judging means judges that the output circuit is defective.

With this configuration, even if there are plural patterns of the comparison result from the comparing means which indicate that an output circuit is defective, the judging means can deal with each pattern appropriately to detect the defect in the output circuit.

To explain this more specifically, assume as above that the output circuit has such a defect that it can output only a high voltage. If the output circuit receives the input signal of gray scale m and the spare output circuit receives gray scale of m+1, the comparing means outputs a signal that indicate that the gray scale inputted in the output circuit is higher. On the other hand, if the output circuit has such a defect that it can output only a low voltage, the comparing means outputs a signal that indicate that the gray scale inputted in the spare output circuit is higher, when the output circuit receives the input signal of gray scale m+1, and the spare output circuit receives the input signal of gray scale m.

As described above, even in the same situation that the output circuit has a defect, different types of defects and their operation checking methods result in different patterns of the comparison results of the comparing means. Here, the control means outputs to the judging means the expected value of the comparison result of the comparing means, which expected value corresponds to the comparison between the input signals inputted to the output circuit and spare output circuit. Furthermore, the judging means judges that the output circuit is defective, if the comparison result is different from the expected value.

By arranging such that the control means outputs to the judging means the expected value corresponding to the input signals, and the judging means uses the expected value in order to judge whether the output circuit is defective or not, it becomes possible to deal with plural patterns of the comparison result that indicate the output circuit is defective, and the judging whether the output circuit is defective or not can be performed appropriately even if there are plural patterns of the comparison result to deal with.

The driving circuit according to the present invention preferably further comprises: flag storing means for storing therein a flag for indicating the result of the judging performed by the judging means, and if the flag is of indicating that the output circuit is defective, the connection switching means connects the spare output circuit with the output terminal, instead of the output circuit.

By providing the flag storing means for storing therein a flag for indicating the result of the judging performed by the judging means as described above, the output circuit judged as being defective can be switched over with the spare output circuit, and the switching-over can be maintained even after the judging operation is over.

Moreover, the driving circuit according to the present invention may be preferably arranged such that the following are performed in a period in which the following do not affect an image displayed by the display panel: the comparison performed by the comparison means; the judging performed by the judging means; the switching, performed by the connection switching means, to the spare output circuit from the output circuit judged as being defective; and outputting the output signal to the output terminal from the spare output circuit after the connection switching means connects the output terminal with an output of the spare output circuit.

This arrangement makes it possible to switch over the defective output circuit with the spare output circuit thereby to solve the problem of the defective output circuit, with no fear of affecting the image displayed on the display panel.

The driving circuit according to the present invention may preferably further comprise: detecting means for detecting a current value of power source current to be supplied to the driving circuit; normal current value recording means, in which a current value that the power source current has when the driving circuit is operating without defect, is recorded in advance; current value comparing means for comparing the current value of the power source current detected by the detecting means, with the current value recorded in the normal current value recording means; and driving circuit judging means for, based on a result of the comparison performed by the current value comparing means, judging whether the driving circuit is defective or not, and if the driving circuit judging means judges that the driving circuit is defective, the following is performed: the comparison performed by the comparison means; the judging performed by the judging means; and the switching, performed by the connection switching means, to the spare output circuit from the output circuit judged as being defective.

Firstly, if an operational defect occurs somewhere in the driving circuit, the power source current value consumed by the driving circuit becomes greater. More specifically, if an output circuit provided to the driving circuit has a defect, the power source current value consumed by the driving circuit becomes greater.

The above-described arrangement makes it possible to compare the power source current value detected by the detecting means with that power source current value recorded in the recording means, which the driving circuit has when it operates normally. From the result of the comparison performed by the current value comparing means, the integrated circuit judging means can judge whether the integrated circuit is defective or not. As a result, the integrated circuit can judge whether an operational defect occurs therein.

The defect in the output circuit is detected by the comparing means and the judging means. However, the operation carried out with the comparing means and the judging means takes a longer time period than the time period needed for detecting an operational defect in the driving circuit from the power source current value by using the detecting means and the current value comparing means.

Therefore, the operation by the comparing means will not be performed meaninglessly if it is configured such that the driving circuit uses the detecting means and current value comparing means so as to judge, from the power source current value, whether or not an operational defect occurs in the driving circuit, and that if it is judged that an operational defect occurs therein, the comparing means, judging means, and connection switching means detect the defective output circuit, and replace the defective circuit with the spare output circuit. As a result, the driving circuit can detect the operational defect therein and perform the self-healing efficiently.

The driving circuit according to the present invention is preferably arranged such that, right after turning ON the display panel, the followings are performed: the comparison performed by the comparison means; the judging performed by the judging means; and the switching, performed by the connection switching means, to the spare output circuit from the output circuit judged as being defective.

Even if the defect in the output circuit occurs while the integrated circuit is operating, this arrangement makes it possible to replace the defective output circuit with the spare output circuit by supplying power again, thereby to solve the defect of the output circuit.

The driving circuit according to the present invention is preferably arranged such that in a vertical retrace period of the display panel, the followings are performed: the comparison performed by the comparison means; the judging performed by the judging means; and the switching, performed by the connection switching means, to the spare output circuit from the output circuit judged as being defective.

Even if the image is being displayed on the display panel, this arrangement makes it possible to replace the defective output circuit with the spare output circuit, thereby to solve the defect in the output circuit, with no fear of affecting the image being displayed on the display panel.

The driving circuit according to the present invention may preferably further comprise: blocking means for blocking a signal path from the output terminal to the display panel, the followings being performed after the blocking means blocking the signal path from the output terminal to the display panel: the comparison performed by the comparison means; the judging performed by the judging means; and the switching, performed by the connection switching means, to the spare output circuit from the output circuit judged as being defective.

This arrangement makes it possible to replace the defective output circuit with the spare output circuit, thereby to solve the defect in the output circuit, with no fear of affecting the image being displayed on the display panel.

The driving circuit according to the present invention may be configured as follows:

A driving circuit according to the present invention for driving a display panel may comprise: self-healing means for performing self-healing for the driving circuit when the driving circuit is defective.

The driving circuit according to the present invention may comprise: an output circuit for outputting an output signal for driving the display panel, wherein: the self-healing means comprises judging means for judging whether or not the output circuit is defective, and if the judging means judges that the output circuit is defective, the self healing means performs the self-healing such that the driving circuit becomes able to output the output signal to the display panel normally.

The driving circuit according to the present invention may preferably further comprise: a spare output circuit capable of outputting the output signal to the display panel, the self-healing means comprising switching means for, if the judging means judges that the output circuit is defective, switching over from the output signal from the defective output circuit to the output signal from the spare output circuit, so that the output signal from the spare output circuit is outputted as the output signal to the display panel.

Moreover, the driving circuit according to the present invention may be preferably arranged such that the judging means comprises: comparing means for comparing the output signal from the output circuit with the output signal from the spare output circuit, and based on a result of the comparison performed by the comparing means, the judging means judges whether or not the output circuit is defective.

A display device according to the present invention may comprise any one of the driving circuits described above.

A display device according to the present invention may comprise: a display panel; and a driving circuit comprising an output circuit for outputting an output signal for driving the display panel, wherein: the driving circuit comprises: judging means for judging whether or not the output circuit is defective; and a spare output circuit capable of outputting the output signal to the display panel, and the display panel comprises: switching means for, if the judging means judges that the output signals is defective, switching over from the output signal from the defective output circuit to the output signal from the spare output circuit, so that the display panel is driven according to the output signal from the spare output circuit.

A display device according to the present invention may comprise: a display panel; an output circuit for outputting an output signal for driving the display panel; a spare output circuit capable of outputting the output signal to the display panel; judging means for judging whether or not the output circuit is defective or not; switching means for, if the judging means judges that the output circuit is defective, switching over from the output signal from the defective output circuit to the output signal from the spare output circuit, so that the display panel is driven according to the output signal from the spare output circuit.

Furthermore, a television system according to the present invention may comprise any one of the display devices described above.

For a fuller understanding of the nature and advantages of the invention, reference should be made to the ensuing detailed description taken in conjunction with the accompanying drawings.

EXPLANATION ON REFERENCE NUMERALS

1-1: Operational amplifier (comparing means)
1-2: Operational amplifier (comparing means)
**1-*n***: Operational amplifier (comparing means)
**2*c***: Switch (connection switching means)
**2*d***: Switch (connection switching means)
3-1: Judging circuit (judging means)
3-2: Judging circuit (judging means)
**3-*n***: Judging circuit (judging means)
4-1: Judging flag (flag storing means)
4-2: Judging flag (flag storing means)
**4-*n***: Judging flag (flag storing means)
8-1: DAC circuit (output circuit)
8-2: DAC circuit (output circuit)
**8-*n***: DAC circuit (output circuit)
10: Liquid crystal driving semiconductor integrated circuit (driving circuit)
10': Liquid crystal driving semiconductor integrated circuit (driving circuit)
20: Liquid crystal driving semiconductor integrated circuit (driving circuit)
21: Operational amplifier (comparing means)
21A: Operational amplifier (comparing means)
21B: Operational amplifier (comparing means)
28: DAC circuit (spare output circuit)
28A: DAC circuit (spare output circuit)
28B: DAC circuit (spare output circuit)
50: Comparing judging means (self-healing means, judging means)
60: Switching circuit (self-healing means, switching means)
61: Switching circuit (self-healing means)
80: Display panel
80': Display panel
90: Display device
90': Display device
90": Display device
202: Resistor (detecting means)
204: A/D converter (detecting means)
206: EEPROM (normal current value recording means)
208: Comparator circuit (current value comparing means, driving circuit judging means)
300: Television system

BEST MODE FOR CARRYING OUT THE INVENTION

In the following, embodiments of the present invention are described referring to drawings.

Embodiment 1

Embodiment 1 of the present invention is described below referring to FIGS. 1 to 10.

<Structure of Display Device 90>

Figure 2:
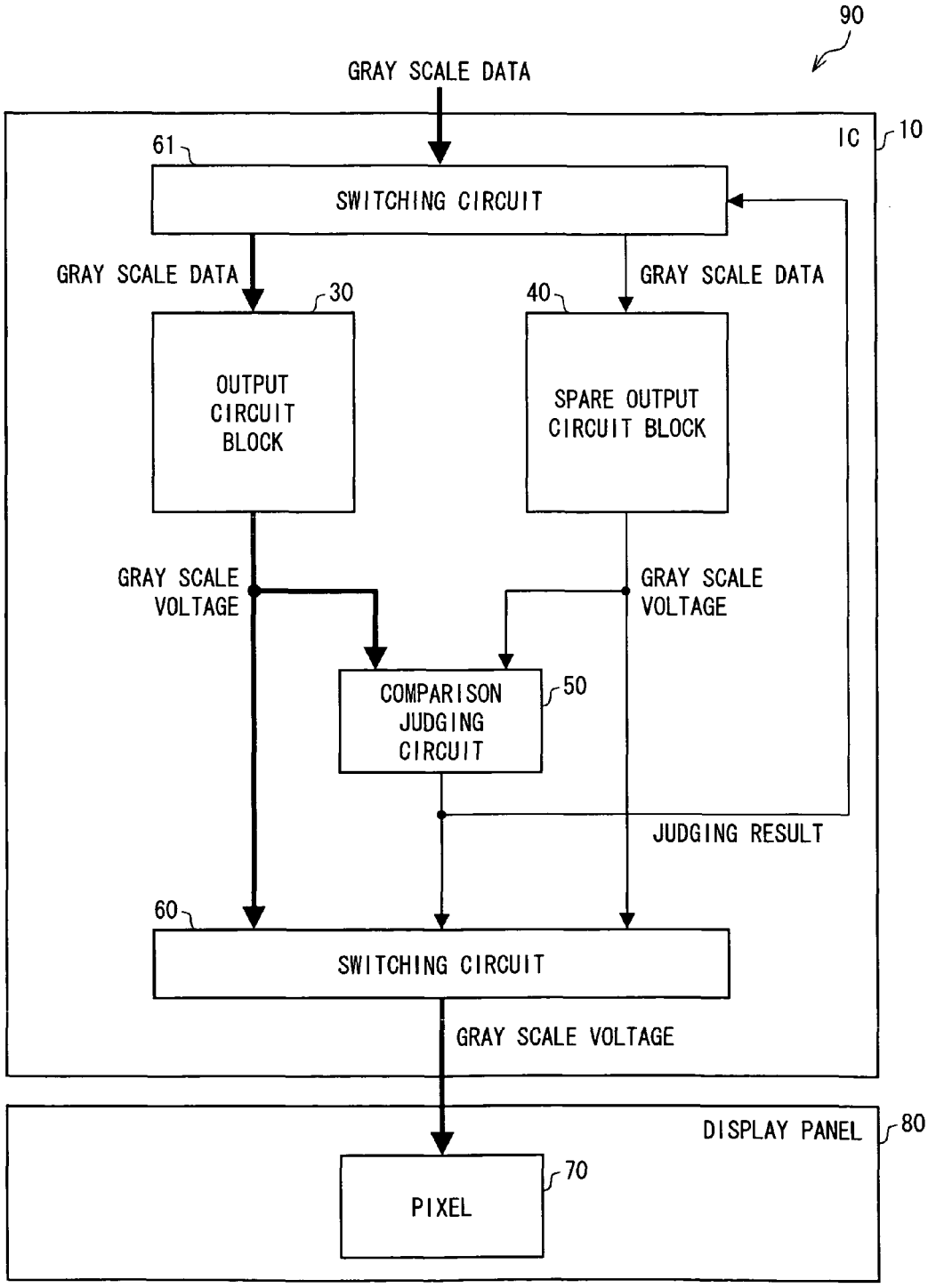
FIG. 2 is a block diagram illustrating a structure of the display device according to the embodiment of the present invention.

To begin with, a schematic structure of a display device 90 according to the present invention is described referring to FIG. 2. FIG. 2 is a block diagram schematically illustrating the display device 90.

As illustrated in FIG. 2, the display device 90 includes a display panel 80, and a display driving semiconductor integrated circuit (hereinafter, IC) 10 for driving the display panel 80 according to gray scale date externally inputted. Moreover, the IC 10 (driving circuit) includes a switching circuit (self-healing means, switching means) 60, a switching circuit (self-healing means, switching means) 61, an output circuit block 30 (output circuit), a spare output circuit block 40 (spare output circuit), and a comparison judging circuit 50 (comparing means, judging means, self-healing means). Moreover, a display panel 80 includes a pixel 70 to which a gray scale voltage is applied from the IC 10.

<Basic Operation of Display Device 90>

Next, a basic operation of the display device 90 is described below. To begin with, the display device 90 has two basic operations as its basic operations. Specifically, the display device 90 has two basic operations: one is an normal operation in which the gray scale data externally inputted is converted into the gray scale voltages (output signal) by the IC circuits 10, and the display panel 80 displays an image according to the gray scale voltages; the other is self-inspection/healing operation in which the IC 10 detects whether the output circuit block 30 is defective or not, and the IC 10 performs self-healing for itself if the output circuit 30 is defective.

In the following, the self-inspection/healing operation performed by the IC 10 is briefly described. Firstly, in case the self-inspection/healing operation is to be performed, the output circuit block 30 and the spare output circuit block 40 receive gray scale data for operation check, via the switching circuit 61 from outside.

The output circuit block 30 and the spare output circuit block 40 each convert the inputted gray scale data to gray scale voltages and output the gray scale voltages to the comparison judging circuit. The comparison judging circuit 50 compares the gray scale voltage from the output circuit block and the gray scale voltage from the spare output circuit block. Based on the comparison, the comparison judging circuit judges whether the output circuit block is defective or not.

Furthermore, the comparison judging circuit 50 outputs to the switching circuits 60 and 61*a* result of the judgment that indicates whether the output circuit block is defective or not. According to the judgment result from the comparison judging circuit 50, the switching circuit switches over destinations of the gray scale data supplied from the outside. On the other hand, the switching circuit 60 receives the gray scale voltages respectively from the output circuit block 30 and the spare output circuit block 40, and selects which one of the inputted gray scale voltages should be outputted to the display panel 80.

This is explained below more specifically. When the switching circuit 61 receives a judgment result indicating that the output circuit block 30 is defective, the switching circuit 61 inputs to the spare output block 40 the same gray scale data as the gray scale data to be outputted to the output circuit block 30 that is judged as being defective. On the other hand, when the switching circuit 60 receives the judgment result indicating that the output circuit block 30 is defective, the switching circuit 60 outputs to the display panel 80 the gray scale voltage of the spare output circuit 40, instead of the gray scale voltage of the output circuit block 30 that is judged as being defective. In this way, the IC 10 can output to the display panel 80 a non-defective gray scale voltage by using the spare output circuit block 40 instead of the output circuit block 30 in case where the output circuit block 30 is defective.

As described above, the IC circuit 10 according to the present embodiment includes the comparison judging circuit 50, and the switching circuits 60 and 61, thereby being able to detect its defect, and perform self-healing on the defect found in itself. In other words, the IC circuit 10 includes a self-healing circuit (self-healing means) for detecting a defect in itself and performing self-healing on the defect.

<Configuration of IC circuit 10>

Figure 1:
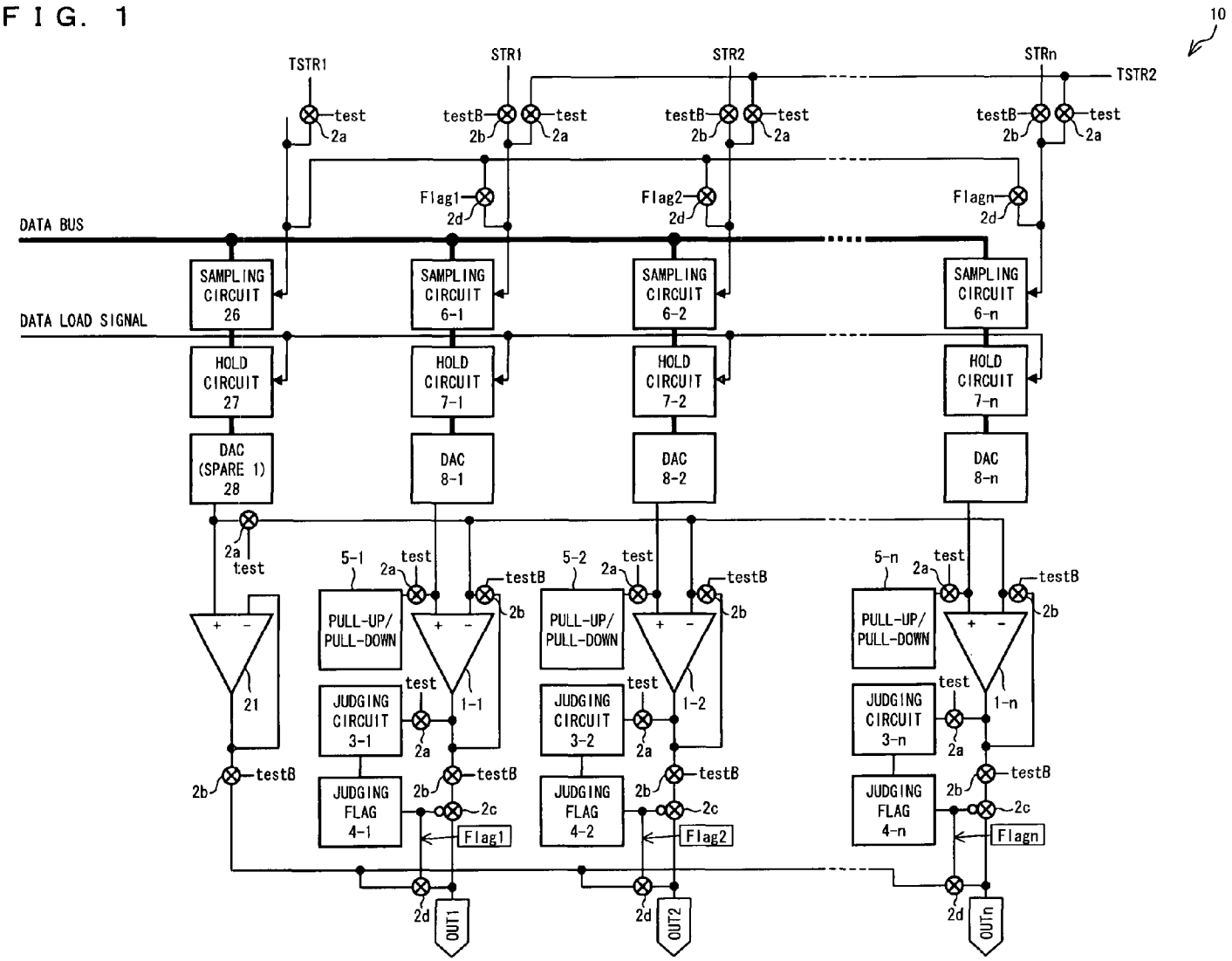
FIG. 1 is an explanatory view illustrating a structure of a display driving semiconductor integrated circuit according to one embodiment of the present invention.

Next, referring to FIG. 1, a configuration of the IC circuit 10 of the present invention is described below. FIG. 1 is an explanatory view illustrating the configuration of the IC circuit 10 (driving circuit).

As illustrated in FIG. 1, the IC 10 includes: an n number of sampling circuits 6-1 to 6-*n* (hereinafter, referred to as sampling circuits 6 collectively where appropriate) for inputting gray scale data via a data bus from a gray scale data input terminal (not illustrated), the gray scale data corresponding to an n number of liquid crystal driving signal output terminals OUT 1 to OUT n (hereinafter, referred to as output terminals OUT 1 to OUT n); an n number of hold circuits 7-1 to 7-*n* (hereinafter, referred to as hold circuits 7 collectively where appropriate); an n number of DAC circuits 8-1 to 8-*n* (hereinafter, referred to as DAC circuits 8 collectively where appropriate) for covering the gray scale data into gray scale voltage signals; an n number of operational amplifiers 1-1 to 1-*n* (hereinafter, referred to as operational amplifiers 1 collectively where appropriate) functioning as buffer circuits for the gray scale voltage signals from the DAC circuits 8; an n number of judging circuits 3-1 to 3-*n* (hereinafter, referred to as judging circuits 3 collectively where appropriate); an n number of judgment flags 4-1 to 4-*n* (hereinafter, referred to as judgment flags 4 collectively where appropriate); and an n number of pull-up/pull-down circuits 5-1 to 5-*n* (hereinafter, referred to as pull-up/pull-down 5 collectively where appropriate).

Further, as illustrated in FIG. 1, the IC 10 includes: a plurality of switches 2*a* that turn ON and OFF according to a test signal; a plurality of switches 2*b* that turn ON and OFF according to a test signal B; a plurality of switches 2*c* (connection switching means) and 2*d* (connection switching means) that turn ON and OFF according to Flag 1 to Flag n, which are output signals from the judgment flags 4. The switches 2*a*, 2*b* and 2*d* are turned ON when they receive a "H" signal, and turned OFF when they receive a "L" signal. On the other hand, the switches 2*c* are turned OFF when they receive a "H" signal, and turned ON when they receive a "H" signal.

Moreover, the IC circuit 10 includes a spare sampling circuit 26, a spare hold circuit 27, a spare DAC circuit (spare output circuit) 28, and a spare operational amplifier 21 one each.

In FIG. 1, the sampling circuits 6, hold circuits 7, and DAC circuits 8 correspond to the output circuit blocks 30 illustrated in FIG. 2. The sampling circuit 26, hold circuit 27, and DAC circuit 28 correspond to the spare output circuit block 40 illustrated in FIG. 2. In FIG. 1, the operational amplifiers 1, the judging circuits 3, and the judgment flags 4 correspond to the comparison judging section 50 illustrated in FIG. 2, and the switches 2*d* and switches 2*c* connected to the output terminals OUT 1 to OUT n correspond to the switching circuit 60 illustrated in FIG. 2. The switches 2*d* connected to the sampling circuits 6 correspond the switching circuits 61 illustrated in FIG. 2. Note that the IC circuit illustrated in FIG. 1 is connected via the output terminals OUT 1 to OUT n with the display panel 80 illustrated in FIG. 2, and that the display panel 80 is omitted in FIG. 1.

<Normal Operation of IC 10>

Next, referring to FIG. 1, the normal operation of the IC 10 is explained below in which the IC 10 outputs the gray scale voltages to the display panel 80 (see FIG. 2).

In the normal operation, the test signal is "L", and the test B signal is "H". When the test signal is "L", the switches 2*a* are turned OFF, while the switches 2*b* are turned ON. By this, STR1 to STR n signals (hereinafter, referred to as STR signals collectively where appropriate) are inputted to the corresponding sampling circuits. The STR signals are signals supplied from pointer shift registers (not illustrated). The sampling circuits 6 obtain the gray scale data respectively corresponding thereto, via the data bus from the gray scale data input terminal according to the STR signals respectively inputted to the sampling circuits 6. The hold circuits 7 receive the obtained gray scale data from the sampling circuit 6 according to a data LOAD signal. Next, the DAC circuits 8 (output circuits) receive the gray scale data from the hold circuits 7 respectively. The DAC circuits 8 convert the inputted gray scale data into the gray scale voltage signals and output the gray scale voltage signals to positive input terminals of the operational amplifiers 1 (comparing means). Here, the outputs from the operational amplifiers are negatively fed back to their own negative input terminals because the switches 2*b* are turned ON.

In this way, the operational amplifiers 1 operate as voltage followers. Thereby, the operational amplifiers 1 function as buffer circuits for the gray scale voltages supplied from the DAC circuits 8, and output to the corresponding output terminals OUT 1 to OUT n the gray scale voltage signals inputted in the positive input terminals of the operational amplifiers 1. Note that it is assumed here that switches 2*c* are turned ON while the switches 2*d* are turned OFF. The operations of the switches 2*c* and 2*d* will be described later. If it is put that the output circuit blocks are blocks including a sampling circuit 6, a hold circuit 7, a DAC circuit 8, and an operational amplifier 1, the output circuit blocks aim at outputting the gray scale voltages via the output terminals to the display panel 80 so as to drive the display panel with the gray scale voltages, the gray scale voltages being converted from gray scale data inputted from the gray scale data input terminal to the output circuit blocks.

<Switching-Over to Operation Checking Test>

Next, the switching to the operation checking test for testing the operation of the DAC circuits 8 is carried out by turning the test signals to "H", and the test B signals to "L". In response to turning ON the switches 2*a*, the spare sampling circuit 26 receives a TSTR1 signal, which is a STR signal for the operation checking test. Meanwhile, the sampling circuit 6 receives a TSTR 2 signal, which is a STR signal for the operation checking test. Further, the negative input terminal of the operational amplifier 1 receives the gray scale voltage from the spare DAC circuit 28. Moreover, in response to turning OFF the switch 2*b*, the negative feedback of the output from the operational amplifier 1 to the its own negative input terminal is cut off. As a result, the operational amplifier 1 becomes a comparator for comparing the output voltage from the DAC circuit 8 and the output voltage from the spare DAC circuit 28.

The test signal and the test B signal are outputted from a control circuit (not illustrated) for controlling the switching-over to the operation checking test and the operation in the operation checking test. The control circuit (control means) also controls the gray scale data inputted via the data bus, and the data LOAD signal during the operation checking test. Furthermore, the control circuit may or may not be a circuit that controls the gray scale data, data LOAD signal, and the shift clock input signals during the normal operation.

<Operation Checking Test 1 in Embodiment 1>

Figure 3:
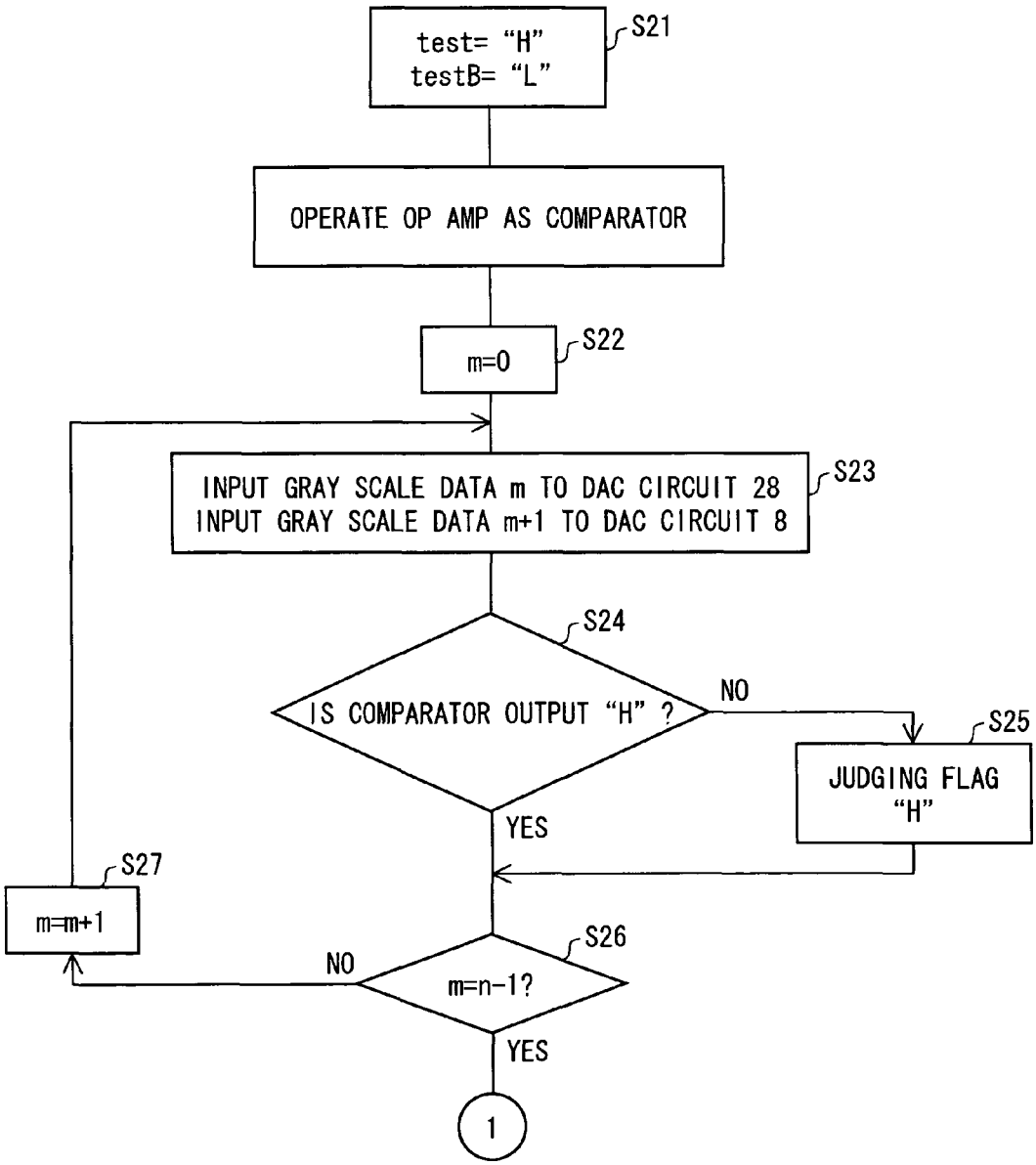
FIG. 3 is a flowchart illustrating a first procedure in an operation checking test according to the embodiment of the present invention.

Next, a first step of the operation checking test is described below referring to FIG. 3, which is a flowchart illustrating the first procedure of the operation checking test according to Embodiment 1.

At Step 21 (hereinafter, referred to as S21) illustrated in FIG. 3, the test signal is "H", while the test B signal is "L". As described above, the operational amplifier 1 becomes a comparator by S21.

Then, at S22, a counter m of the control circuit (not illustrated) is initialized to 0. Further, the control circuit supplies gray scale data of a gray scale m corresponding to a counter m (here, gray scale data of gray scale 0) to the spare sampling circuit 26 via the data bus by activating the TSTR1 signal. Further, via the data bus, the control circuits stores in the sample circuit 6 the gray scale data of gray scale m+1 (here, gray scale data of gray scale 1), whose value increased from the value of the counter m by one, by activating the TSTR1 signal. Next, the spare hold circuit 27 obtains the gray scale data of gray scale 0 from the sampling circuit 26 based on the data LOAD signal. Further, the DAC circuit 28 receives the gray scale data from the hold circuit 27, and outputs the gray scale voltage 0 to the negative input terminals of the operational amplifier 1 (S23). On the other hand, the hold circuit 7 obtains the gray scale data of the gray scale 1 from the sampling circuit 6 based on the data LOAD signal. Furthermore, the DAC circuit 8 receives the gray scale data from the hold circuit 7. Each DAC circuit 8 outputs the gray scale voltage of gray scale 1 to the positive input terminal of the corresponding input terminal (S23). It is assumed here that the IC 10 of the present invention is an IC for outputting gray scale voltages of n gray scales, and the gray scale voltage of gray scale 0 is the lowest voltage and the gray scale voltage of gray scale n is the highest voltage among the gray scale voltages outputted from the IC 10.

Next, the operational amplifier 1 compares the gray scale voltage received at its positive input terminal from the DAC circuit 8, and the gray scale voltage received at its negative input terminal from the DAC circuit 28 (S24). More specifically, the operational amplifier 1 inputs the gray scale voltage of gray scale 1 to its own positive input terminal, but inputs the gray scale voltage of gray scale 0 to its own negative input terminal. If the DAC circuit 8 is not defective, the gray scale voltage of gray scale 1 is higher than that of gray scale 0. Accordingly, the operational amplifier 1 outputs a signal of "H" level. On the other hand, if the operational amplifier outputs a signal of "L" level, this indicates that the DAC circuit 8 is defective.

Next, the judging circuit 3 (judging means) receives the output signal from the operational amplifier 1, and compares a level of the inputted signal with an expected value recorded in the judging circuit 3. The expected value recorded in the judging circuit 3 is given from the control circuit. In this operation checking test 1, the expected value recorded in the judging circuit 3 is of "H" level.

The judging circuit 3 judges that the DAC circuit 8 is not defective, if the signal inputted from the operational amplifier 1 is of "H" level like the expected value recorded in the judging circuit 3. On the other hand, the judging circuit 3 judges that the DAC circuit 8 is defective, if the signal inputted from the operational amplifier 1 is of "L" level unlike the expected value recorded in the judging circuit 3. Then, the judging circuit 3 outputs a "H" flag to the judging flag 4. When the judging flag 4 receives the "H" flag from the judging circuit 3, the judging flag 4 stores the inputted "H" flag in its own internal memory (S25).

The judging circuit 3 may be configured such that it receives the output signal from the operational amplifier 1, and outputs an "L" flag to the judging flag 4 if the inputted signals is of "H" level, and outputs a "H" flag to the judging flag 4 if the inputted signal is of "L" level. In this configuration, once the judging flag 4 receives a "H" flag from the judging section 3, the judging flag 4 keeps the "H" flag even after the judging flag 4 receives an "L" flag after the receipt of the "H" flag.

Moreover, the judging circuit 3 may be configured such that it will not perform the judging operation after the judgment as being defective is made and the judging flag 4 becomes "H".

Next, it is judged whether the value of the counter m is n−1 or not (S26). If the value of the counter m is less than n−1, the value of the counter m is increased by one and the steps S23 to S25 are repeated until the value of the counter m reaches n−1. Note that n is the number of gray scales that the IC 10 can output.

<Operation Checking Test 2 of Embodiment 1>

Figure 4:
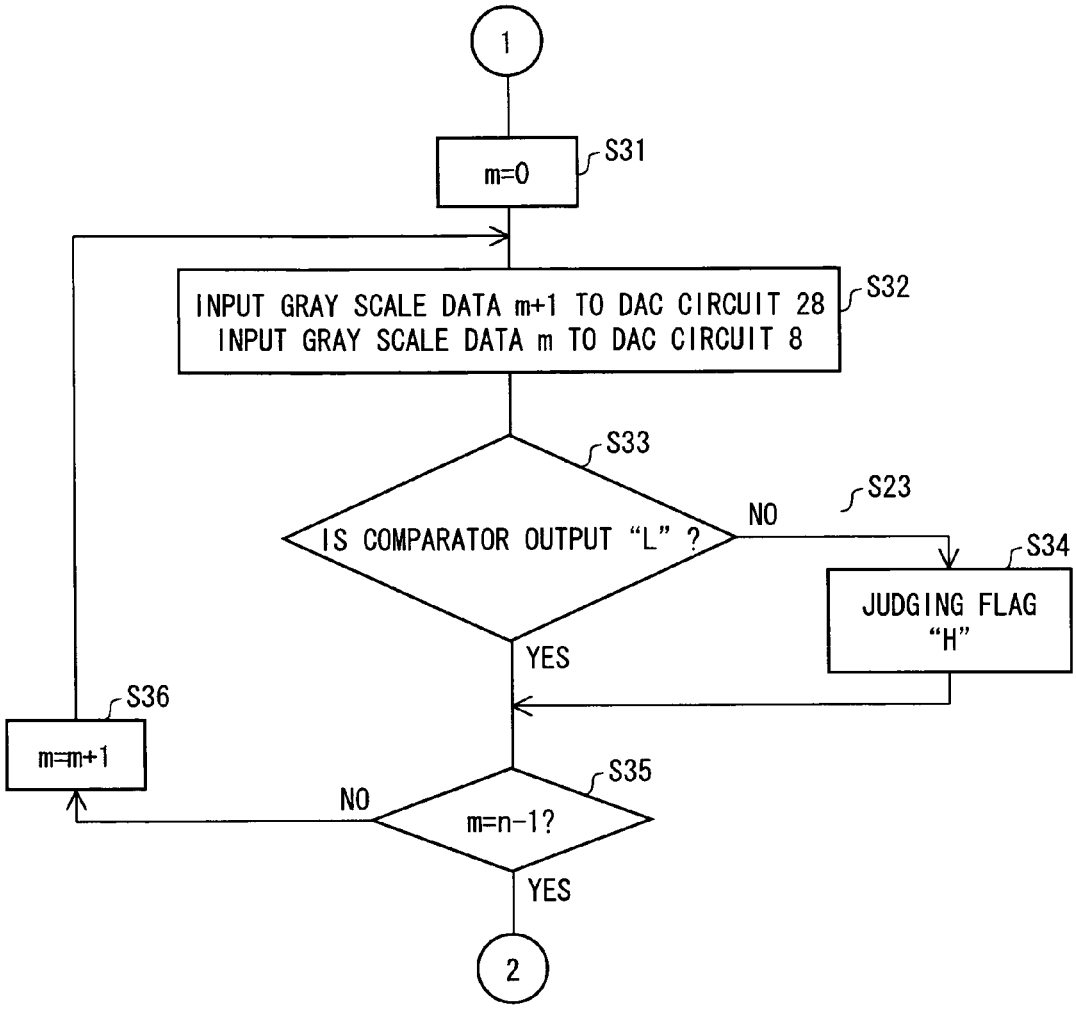
FIG. 4 is a flowchart illustrating a second procedure in an operation checking test according to the embodiment of the present invention.

Next, the second procedure of the operation checking test is described below referring to FIG. 4, which is a flowchart illustrating the second procedure of the operation checking test according to Embodiment 1.

In the operation checking test 1, the gray scale voltage inputted to the positive input terminal of the operational amplifier 1 is always higher than the gray scale voltage inputted to the negative input terminal. Thus, in case where the DAC circuit 28 is so defective that it outputs a low voltage only, or that it outputs a high voltage only, the judging circuit 3 outputs an "L" flag indicating "non-defective" will be outputted.

Therefore, in the operation checking test 2, operation checking is carried out by inputting a lower gray scale voltage to the positive input terminal of the operational amplifier 1 than to the negative input terminal thereof.

Firstly, the value of the counter m is initialized to 0 after the operation checking test 1 is completed (s31). Next, via the data bus, the control circuit stores in the spare sampling circuit 26 the gray scale data of gray scale m+1 (here, gray scale data of gray scale 1), whose value increased from the value of the counter m by one, by activating the TSTR1 signal. Next, via the data bus, the control circuit stores in the sampling circuit 6 the gray scale data of gray scale m (here, gray scale data of gray scale 0) that corresponds to the counter m, by activating the TSTR2 signal.

Like at S23 of the operation checking test 1, the DAC circuit 28 receives, via the hold circuit 27, the gray scale data stored in the sampling circuit 26. Further, the DAC circuit 28 outputs the gray scale voltage of gray scale m+1 (here, gray scale voltage of gray scale 1) to the negative input terminal of the operational amplifier 1, the gray scale voltage of gray scale m+1 corresponding to the inputted gray scale data. Meanwhile, the DAC circuit 8 receives, via the hold circuit 7, the gray scale data stored in the sampling circuit 6. Furthermore, each DAC circuit 8 outputs the gray scale voltage of gray scale m (here, gray scale voltage of gray scale 0) to the positive input terminal of the corresponding operational amplifier 1 to which the DAC circuit 8 is connected, the gray scale voltage of gray scale m corresponding to the inputted gray scale data (S32).

Next, the operational amplifier 1 compares the gray scale voltage of gray scale 0 inputted from the DAC circuit 8 to its positive input terminal, with the gray scale voltage of gray scale 1 inputted from the DAC circuit to its negative input terminal (S33). If the DAC circuit 8 is not defective, the gray scale voltage of gray scale 1 is higher than the gray scale voltage of gray scale 0. Accordingly, the operational amplifier outputs an "L" flag signal. That is, the operational amplifier 1 outputs an "H" level signal, it means that the DAC circuit 8 is defective.

Next, the judging circuit 3 receives the output signal from the operational amplifier 1 and compares the level of the inputted signal with the expected value recorded in the judging circuit 3. In the operational checking test 2, the expected value recorded in the judging circuit 3 is of "L" level. The judging circuit 3 judges that the DAC circuit is not defective, if the signal inputted from the operational amplifier 1 is of "L" level same as the expected value recorded in the judging circuit 3. On the other hand, the judging circuit 3 judges that the DAC circuit 8 is defective if the signal inputted from the operational amplifier 1 is of "H" level. Then, the judging circuit 3 outputs a "H" flag to the judging flag 4. The judging flag 4 stores the inputted "H" flag in its internal memory, if the judging flag 4 receives the "H" flag from the judging circuit 3 (S 34). The steps S33 to S34 as described above are repeated until m=n−1 (S35, S36).

<Operation Checking Test 3>

Figure 5:
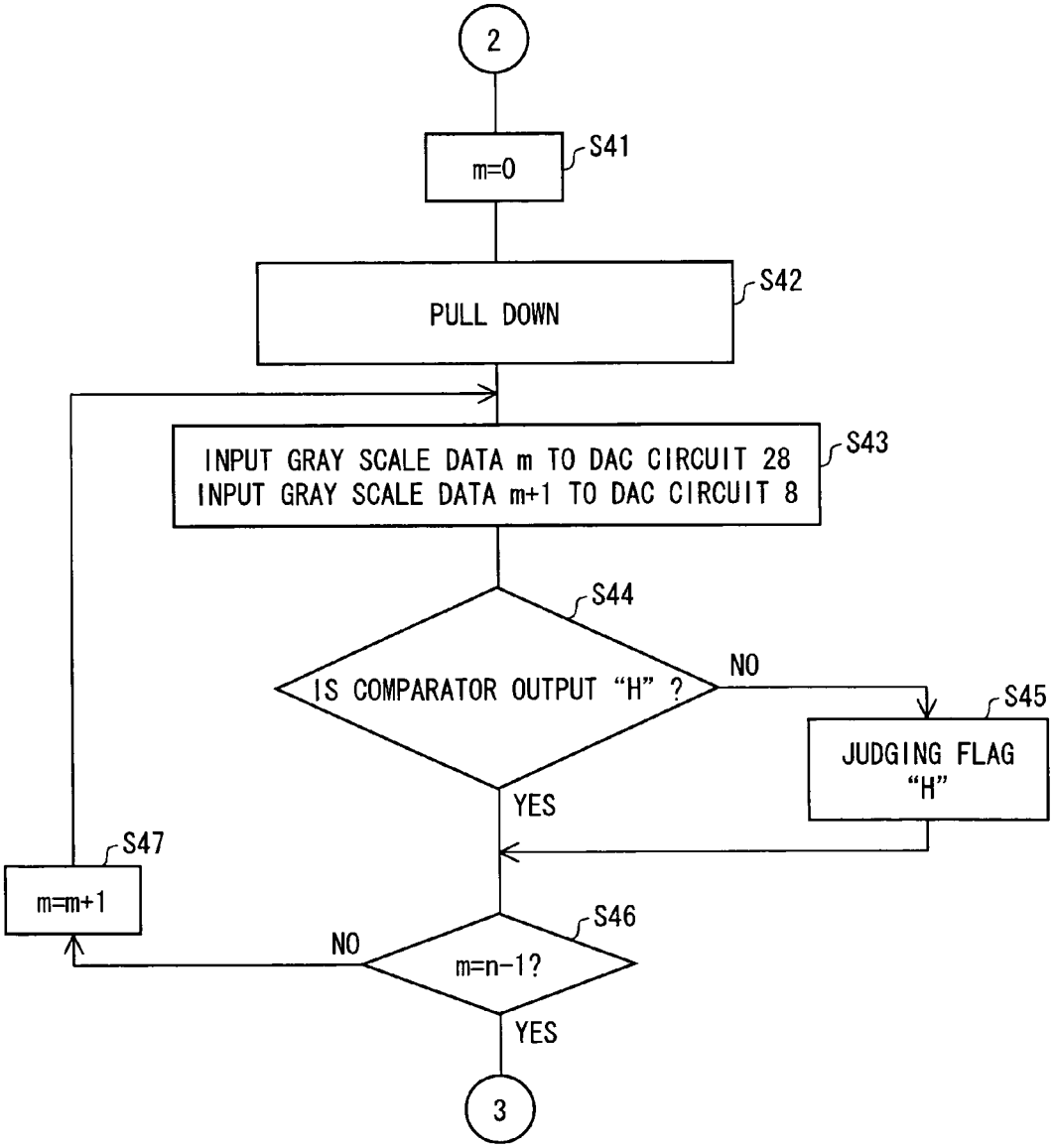
FIG. 5 is a flowchart illustrating a third procedure in an operation checking test according to the embodiment of the present invention.

Next, the third procedure of the operation checking test is described below referring to FIG. 5. FIG. 5 is a flowchart illustrating the third procedure of the operation checking test according to Embodiment 1.

If the DAC circuit 8 is so defective that its output is open, the operational amplifier 1 maintains the gray scale voltage inputted to the operational amplifier 1 during the checking test previously carried out. This would cause such a problem that the operation checking tests 1 and 2 cannot detect a defect. In the operation checking test 3, the positive input terminal of the operational amplifier 1 is connected with the pull-down circuit. By this, a low voltage is inputted in the positive input terminal of the operational amplifier 1 when the output of the DAC circuit 8 is open. As a result, it is possible to prevent the operational amplifier 1 from maintaining the gray scale voltage inputted thereto during the previous checking test, the gray scale voltage being maintained otherwise when the output of the DAC circuit 8 is open, in other words, when no output is outputted from the DAC circuit 8.

The operation checking test 3 is carried out as follows. Firstly, the counter m is initialized to 0 (S41). Next, the pull-up/pull-down circuit 5 performs pull-down to the positive input terminal of the operational amplifier 1 (S42). After that, the steps S43 to S47 are carried out, which are identical with the steps S23 to S27 in the operation checking test 1, and whose explanation is therefore omitted here.

As described above, by performing the pull-down to the positive input terminal of the operational amplifier 1 and then the procedure of the operation checking test 1, the operational amplifier 1 outputs a signal of "L" level when the output of the DAC circuit 8 is open. As a result, the judging circuit 3 judges, according to the signal of "L" level, that the DAC circuit 8 is defective. Consequently, the judging flag 4 records a "H" flag therein.

<Operation Checking test 4 of Embodiment 1>

Figure 6:
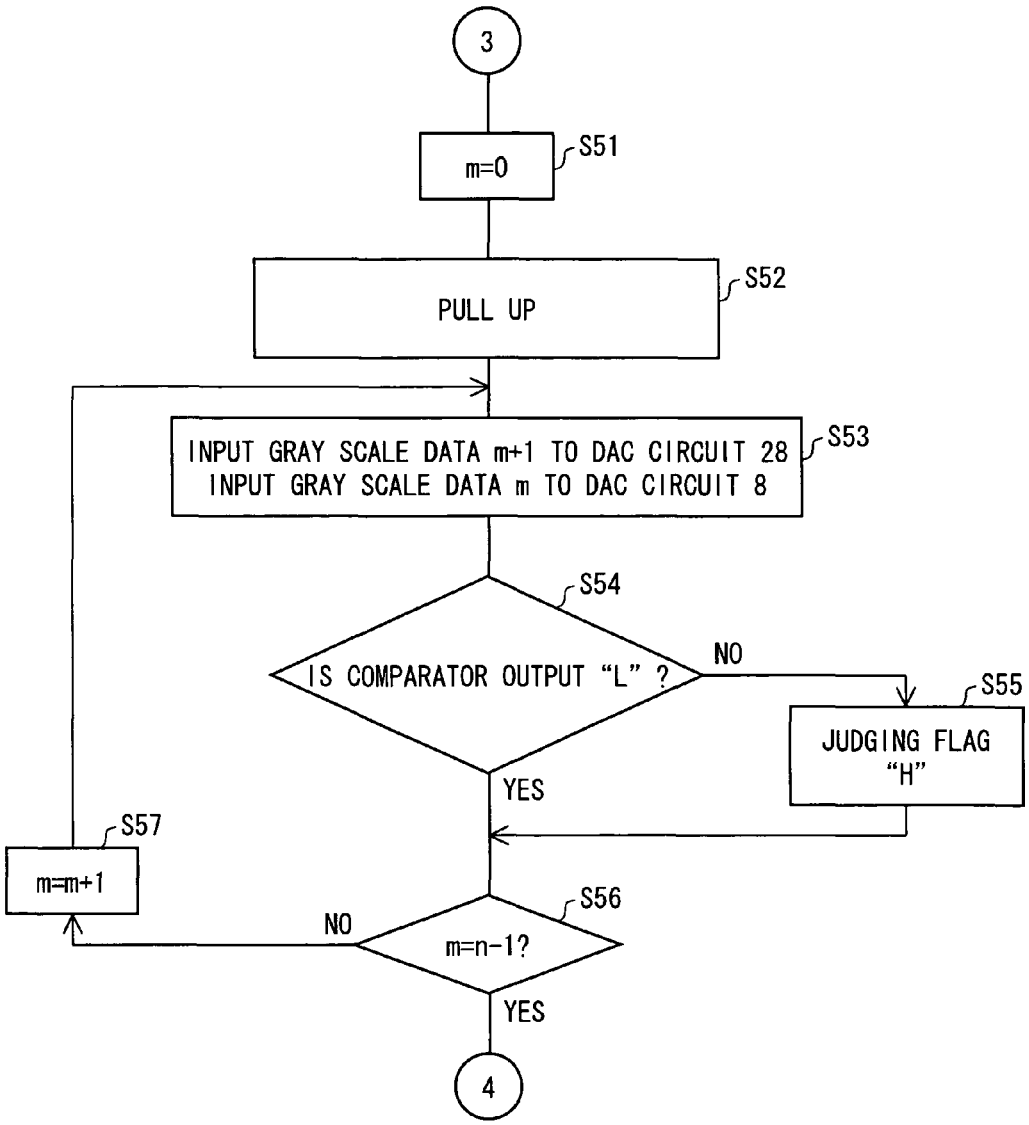
FIG. 6 is a flowchart illustrating a fourth procedure in an operation checking test according to the embodiment of the present invention.

Next, the fourth procedure of the operation checking test is described below, referring to FIG. 6, which is a flowchart illustrating the fourth procedure of the operation checking test according to Embodiment 1.

The operation checking test 4 is an operation checking test for detecting a defect while the output of the DAC circuit 8 is open, like the operation checking test 3. As illustrated in FIG. 6, firstly the counter m is initialized to 0 (S 51). Then, the pull-up/pull-down circuit 5 performs pull-up to the positive input terminal of the operational amplifier 1 (S 52). Then, the steps S53 to S57 are carried out, which are identical with the steps S32 to S36 in the operation checking test 2 as described above, and whose explanation is therefore omitted here.

As described above, by performing the pull-up to the positive input terminal of the operational amplifier 1 and then the procedure of the operation checking test 2, the operational amplifier 1 outputs a signal of "H" level when the output of the DAC circuit 8 is open. As a result, the judging circuit judges, according to the inputted signal of "H" level", that the DAC circuit 8 is defective. Consequently, the judging flag 4 records "H" therein.

<Operation Checking Test 5 of Embodiment 1>

Next, the fifth procedure of the operation checking test is described below referring to FIG. 7, which is a flowchart illustrating the fifth procedure of the operation checking test according to Embodiment 1.

The DAC circuit 8 would have such a defect that a short circuit occurs with respect to two adjacent gray scales that the DAC circuit 8 deals with. In the event of the short circuit with respect to such two adjacent gray scales, the DAC circuit 8 outputs an intermediate voltage between the two adjacent gray scales for which the short circuit occurs. In the case of this defect, the gray scale voltage outputted from the DAC circuit 8 will not be different from the gray scale voltage of the normal case by one gray scale or more. Therefore, the operation checking tests 1 to 4 cannot detect this defect. The operation checking test 5 aims at detecting the defect in the DAC circuit 8 in which short-circuit occurs regarding the two adjacent gray scales.

Figure 7:
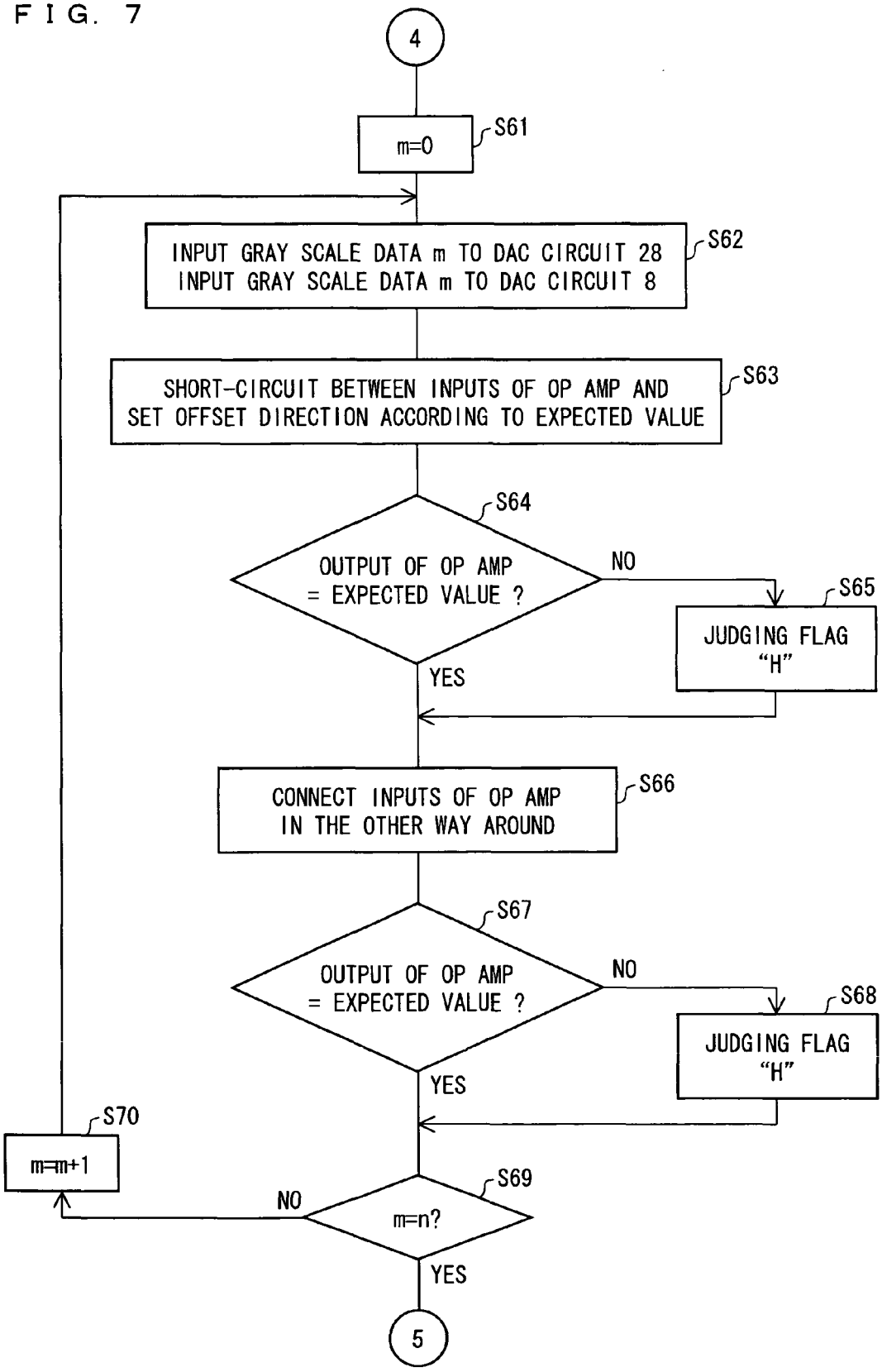
FIG. 7 is a flowchart illustrating a fifth procedure in an operation checking test according to the embodiment of the present invention.

As illustrated in FIG. 7, firstly the counter m is initialized to 0 (S 61). Next, TSTR 1 and TSTR 2 are activated, and further gray scale data of gray scale m (here, gray scale data of gray scale 0) is inputted via the data bus to the sampling circuit 26 and the sampling circuit 6. Next, the DAC circuits 28 and 8 obtain gray scale data of gray scale 0 from the sampling circuits 26 and 6 via the hold circuits 27 and 7, respectively. Further, the DAC circuits 28 and 8 output the gray scale voltage of gray scale 0 to the positive input terminal and the negative input terminal of the operational amplifier 1 (S 62), respectively.

Next, by using a switch (not illustrated), short-circuit is caused between the positive input terminal and the negative input terminal of the operational amplifier 1. In case where the DAC circuit 8 is judged as being not defective in the operation checking tests 1 and 2, the difference between the gray scale voltages inputted in the positive input terminal and the negative input terminal is not more than 1 gray scale. Therefore, the short circuit between the positive input terminal and the negative input terminal will not cause a large current flow.

The short circuit between the positive input terminal and the negative input terminal of the operational amplifier 1 leads to inputting the same gray scale voltage to the two input terminal of the operational amplifier. Because the operational amplifier 1 has an offset voltage between its input and output, the operational amplifier 1 outputs "H" or "L". The output level of the operational amplifier 1 in the event of the short circuit of the positive input terminal and the negative input terminal of the operational amplifier 1 is recorded as the expected value in the judging circuit 3 (S63).

Next, the switch (not illustrated) is turned OFF, thereby terminating the short circuit between the positive input terminal and the negative input terminal of the operational amplifier 1. Then, the gray scale voltage of gray scale 0 is inputted from the DAC circuit 8 to the positive input terminal of the operational amplifier 1, meanwhile the gray scale voltage of gray scale 0 is inputted from the DAC circuit 28 to the negative input terminal of the operational amplifier 1. If the DAC circuits 8 and 28 are not defective, the output of the operational amplifier 1 is same as the expected value recorded in the judging circuit 3. Therefore, the judging circuit 3 compares the output from the operational amplifier 1 with the expected value recorded in the judging circuit 3 (S64). The judging circuit 3 outputs a "H" flag to the judging flag 4 if the output value from the operational amplifier 1 is different from the expected value (S65).

Next, the switch (not illustrated) switches over the inputs of the operational amplifier 1 such that the gray scale voltage from the DAC circuit 28 is inputted in the positive input terminal of the operational amplifier 1, and the gray scale voltage from the DAC circuit 8 is inputted in the negative input terminal of the operational amplifier 1 (S66). Then, the same procedure as at S64 is carried out (S67). The judging circuit 3 outputs a "H" flag to the judging flag 4 if the output value from the operational amplifier 1 is different from the expected value at S67 (S68). By switching over the positive input terminal and the negative input terminal in this way, it becomes possible to detect a defect in the DAC circuit 8 regardless of whether the expected value recorded in the judging circuit 3 is "H" level or "L" level.

The steps S62 to S68 are repeated as described above is repeated until the value of the counter m reaches n, while increasing the counter m by one every time the steps S62 to S68 are repeated (S69, S70).

<Self-Healing>

Figure 8:
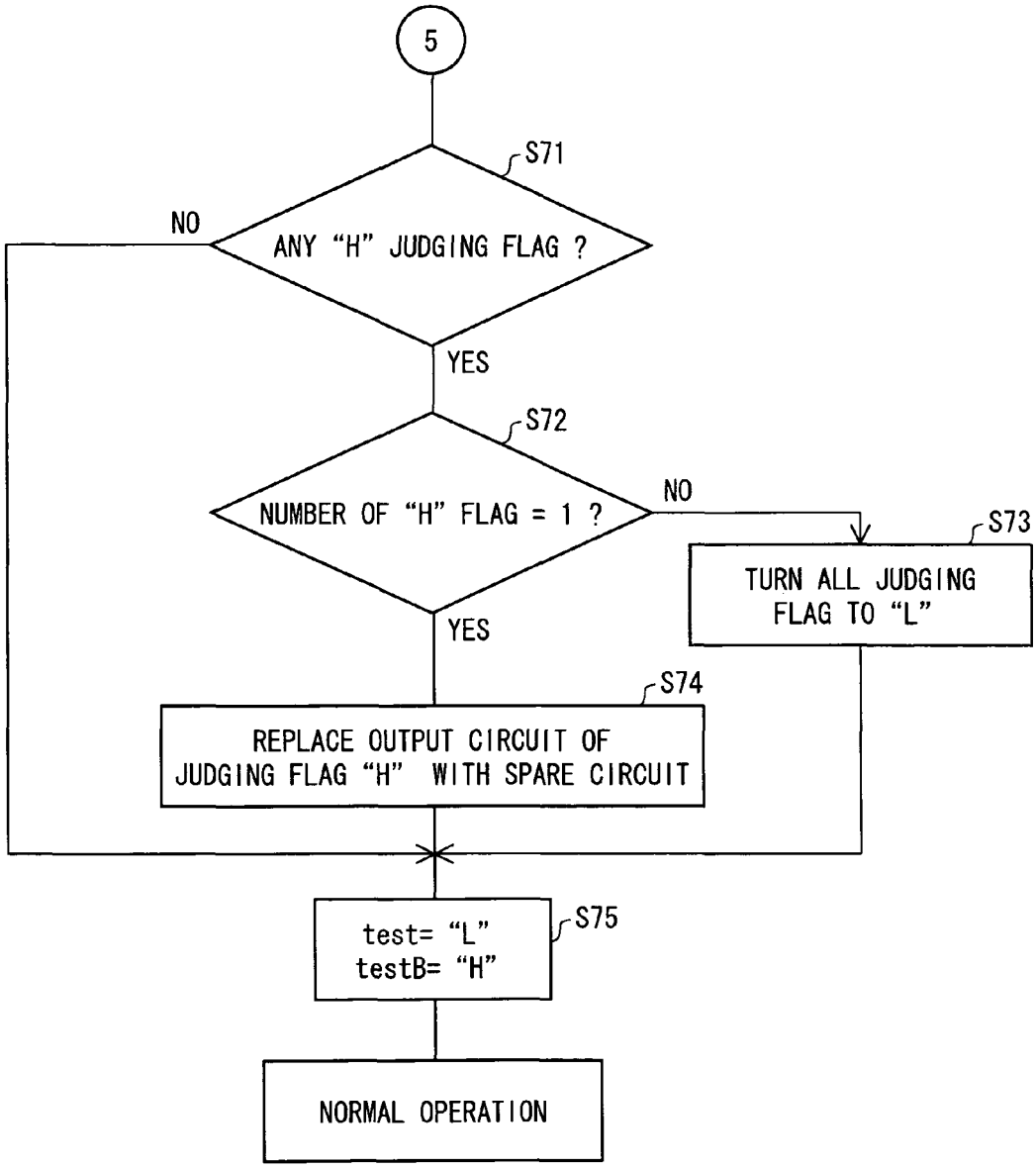
FIG. 8 is a flowchart illustrating procedure of switching over from a defecting output circuit to a spare output circuit, according to the embodiment of the present invention.

Referring to FIG. 8, healing operation is described below which is carried out in case where the judging flag 4 records a "H" flag, in other words, in case where the judging circuit 3 judges through the operation checking tests 1 to 5 that any one of the DAC circuits 8-1 to **8-*n* is defective. FIG. 8 is a flowchart illustrating the heating operation in which a DAC circuit 8 judged as being defective is replaced with the spare DAC circuit 28**.

The judging circuit 3 outputs the "H" flag to the judging flag 4 if the judging circuit 3 judges that the DAC circuit 8 is defective. Furthermore, the judging flag 4 receives the "H" flag from the judging circuit 3, and records the "H" flag therein. Then, the control circuit detects whether the judging flags 4 record "H" or not (S71). The control circuit goes to S75 if it detects that the judging flags 4 do not record "H". On the other hand, if the control circuit detects that a judging flag 4 records "H", the control circuit finds how many "H" flags are recorded among the judging flags 4-1 to **4-*n*. If more than one "H" flag is recorded among the judging flags 4, the control circuit proceeds to S73. If one "H" flag is recorded among the judging flags 4, the control circuit proceeds to S74 (S72**).

At S74, the DAC circuit 8 corresponding to the judging flag 4 recording the "H" flag is replaced with the spare DAC circuit 28 (S74). In the following explanation on how the defective DAC circuit 8 is replaced with the spare DAC circuit 28, it is assumed that the judging flag 4-1 corresponding to the liquid crystal driving signal output terminal OUT 1 records a "H" flag.

The judging flag 4-1 outputs an output signal Flag 1 of "H" level to the switches 2*c* and 2*d*. The output signal Flag 1 turns the switch 2*c* OFF and turns the switch 2*d* ON because they receive a signal of "H" level. By this, the switch 2*c* disconnects the liquid crystal driving signal output terminal OUT 1 from the output of the operational amplifier 1-1. On the other hand, the switch 2*d* outputs to the sampling circuit 26 the STR1 signal that is also sent to the sampling circuit 6-1. By this, the gray scale data for the liquid driving signal output terminal OUT 1 is also stored in the sampling circuit 26. Furthermore, the switch 2*d* connects the liquid crystal driving signal output terminal OUT 1 from the output of the operational amplifier 21. In this way, the switches 2*c* and 2*d* are switched over in response to the output signal of Flag 1 supplied from the judging flag 4-1, thereby replacing the defective DAC circuit 8-1 with the spare DAC circuit 28.

Next, the operation at S73 is explained. In case where plural "H" flags are recorded among the judging flags 4, the spare DAC circuit 28 may be defective statistically. Therefore, at S73, the control circuit changes all the flags stored in the judging flags 4 to "L" flags, and proceeds to S75. Next, if it is judged as "NO" at S71, the control circuit switches the test signal to "L", and the test B signal to "H" after S73 or S74. Then, the control circuit performs the normal operation (S75).

As described above, the operation checking tests 1 to 5, and the self-healing operation, the IC 10 can replace the defective DAC circuit with the spare DAC circuit 28. Further, in Embodiment 1, the IC 10 includes the spare sampling circuit 26 and the spare hold circuits 27 for the spare DAC circuit 28. Therefore, besides the DAC circuits 8, if a sampling circuit 6 or a hold circuit 7 is defective, such a defective sampling circuit 6 or a hold circuit 7 can be replaced with the spare sampling circuit 26 or the spare hold circuits 27.

Figure 9:
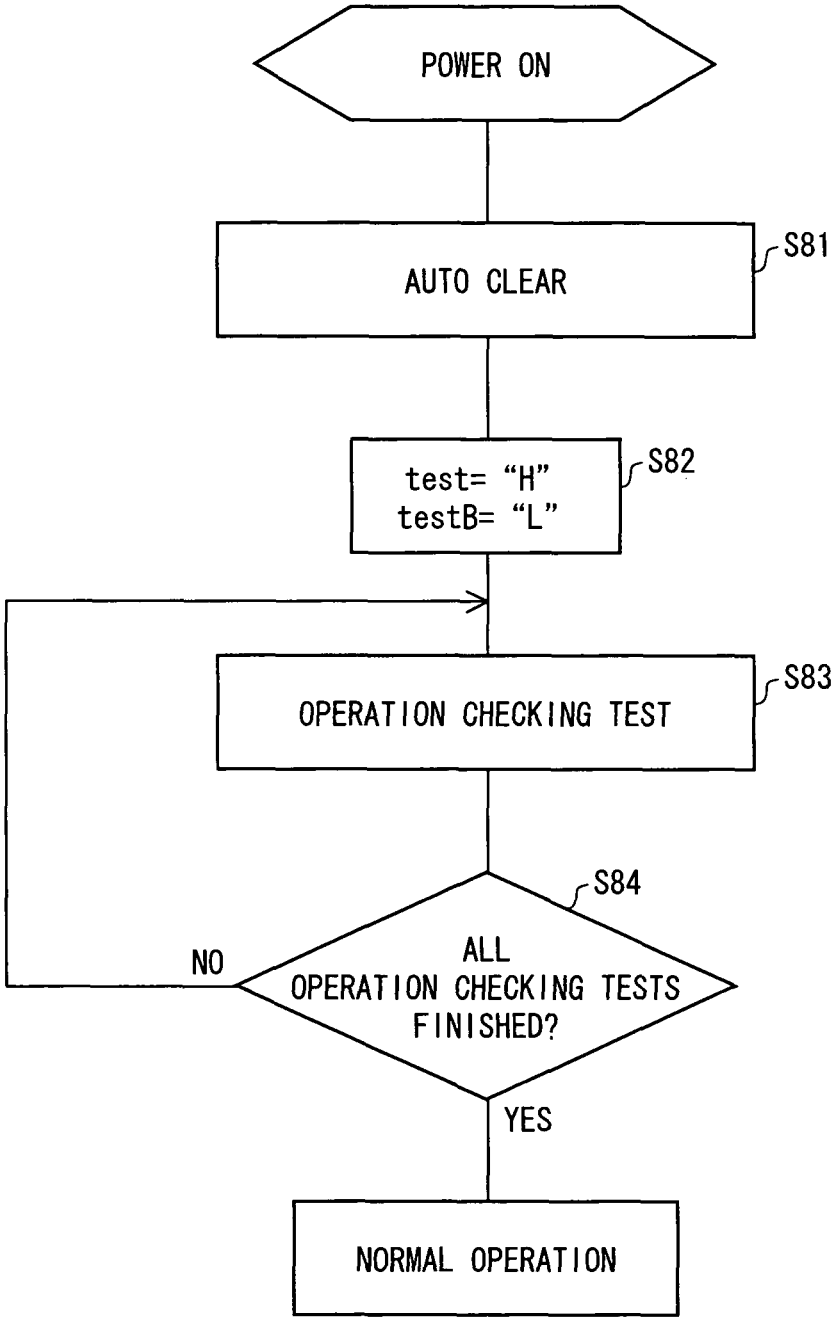
FIG. 9 is a flowchart illustrating procedure from turning on the display device, and performing operation checking test, and then moving to normal operation, according to the embodiment of the present invention.

The following explains a procedure in which after turning ON a display device on which the IC 10 is mounted, the operation checking test is carried out and then the normal operation is started, and referring to FIG. 9, which is a flowchart illustrating the procedure in which after turning ON the display device, the operation checking test is carried out and then the normal operation is started.

As illustrated in FIG. 9, firstly, the display device is turned ON and the IC 10 is initialized, whereby the judging flags 4 hold "L" flags (S81). Then, the control circuit outputs the test signal of "H" and test B signal of "L", thereby switching over the IC 10 to an operation checking test state (S82). After that, the control circuit and the IC 10 perform the operation checking test as described above (S83). Further, the control circuit confirms whether or not all the operation checking tests 1 to 5 are completed. The control circuit replaces a defective circuit with a spare circuit. After that, the control circuit starts the normal operation (S84).

<Operation Checking of Operational Amplifier>

The operation checking test described above presumes that the operational amplifier 1 is not defective. However, the operational amplifier 1 would be defective, too. Therefore, it is preferable to check the operation of the operational amplifier 1 before performing the operation checking test. Thus, the operation checking for the operational amplifier 1 is described below, referring to FIG. 10, which is an explanatory view illustrating a configuration of the operational amplifier 1, and a peripheral circuit for the operation checking for the operational amplifier 1.

Figure 10:
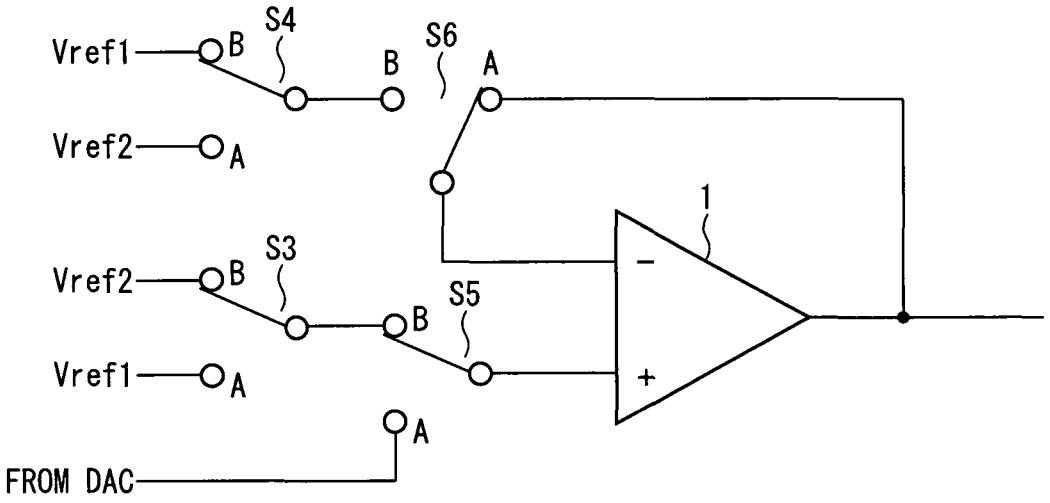
FIG. 10 is an explanatory view illustrating a circuit configuration for operation checking for an operational amplifier 1, according to the embodiment of the present invention.

As illustrated in FIG. 10, the positive input terminal of the operational amplifier is connected with a switch S5 for switching over between the output of the DAC circuit 8 and an input of a predetermined voltage. Further, B side of the switch S5 (input side of the predetermined voltage) is connected with a switch S3 for switching over two predetermined voltages Vref1 and Vref2. On the other hand, the negative input terminal of the operational amplifier 1 is connected with a switch S6 for switching over between the output of the operational amplifier 1 so as to perform negative feedback from the operational amplifier 1, and an input of a predetermined voltage. Furthermore, B side of the switch S6 (input side of the predetermined voltage) is connected with a switch S4 for switching over two predetermined voltages Vref1 and Vref2.

Next, the normal operation of the operational amplifier 1 is described. When the operational amplifier 1 is under the normal operation, the switch S5 is switched to A side (output side of the DAC circuit 8), and switch S6 is switched to A side. Thereby, the operational amplifier 1 operates as a voltage follower circuit.

Next, how the operation checking is performed to check the operation of operational amplifier 1 is described. Firstly the switches S1 and S2 are switched to B side. Thereby, the negative feedback of the operational amplifier 1 is stopped, and thereby the operational amplifier 1 operates as a comparator. Then, the switches S3 and S4 are switched to A side. Thereby, the operational amplifier 1 receives Vref1 at the positive input terminal and Vref2 at the negative input terminal. Assume that Vref1 and Vref2 are voltages prepared in advance and Vref1 is greater than Vref2 in voltage, and that a voltage difference between Vref1 and Vref2 is greater than an input/output offset value of the operational amplifier 1. Because Vref1 inputted at the positive input terminal is greater than Vref2 inputted at the negative input terminal, the operational amplifier 1 outputs a signal of "H" level. This output from the operational amplifier 1 is detected by the judging circuit 3. Then, the judging circuit 3 compares the output from the operational amplifier 1 with the expected value "H" recorded in the judging circuit 3. If the output from the operational amplifier 1 is of "L" level, the judging circuit 3 judges that the operational amplifier 1 is defective. The expected value stored in the judging circuit 3 is supplied from the control circuit.

There is a possibility that comparator operation of the operational amplifier 1 is defective such that it can output only "H" level. Therefore, the switches S3 and S4 are switched to B side, so that the operational amplifier 1 receives Vref2 at the positive input terminal of and Vref1 at the negative input terminal. In this case, the operational amplifier 1 outputs "L" level, because Vref1 inputted at the negative input terminal is greater in voltage than Vref2 inputted at the positive input terminal. This output from the operational amplifier 1 is detected by the judging circuit 3. Then, the judging circuit 3 compares the output from the operational amplifier 1 with the expected value "L" recorded in the judging circuit 3. If the output from the operational amplifier 1 is of "H" level, the judging circuit 3 judges that the operational amplifier 1 is defective. Here, it is assumed that the switches S3 to S6 are switched over by the control circuit.

Embodiment 2

Next, Embodiment 2 according to the present invention is described below, referring to FIGS. 11 to 17. For Embodiment 2, only what is different from Embodiment 1 is described, and what is identical with Embodiment 1 is not explained here repeatedly.

Firstly, the difference between Embodiment 1 and Embodiment 2 is briefly described. In Embodiment 1, the output of the DAC circuit 8 and the output of the spare DAC circuit is compared by the operational amplifier 1. In Embodiment 2, however, two adjacent DAC circuits 8 are paired and outputs from the two adjacent DAC circuits 8 are compared with each other by an operational amplifier 1.

<Configuration of Display Driving Semiconductor Integrated Circuit 20>

Figure 11:
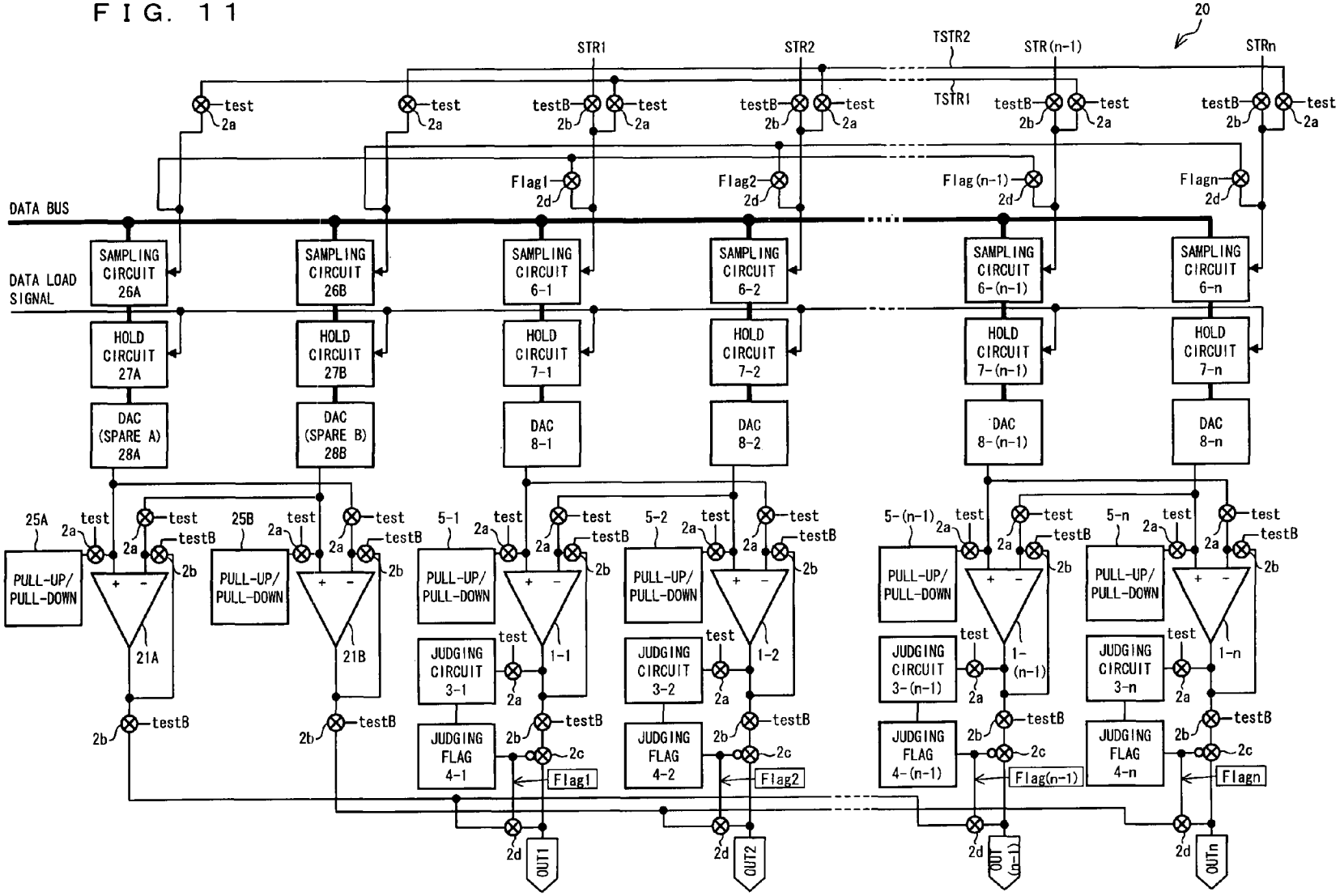
FIG. 11 is an explanatory view illustrating a structure of display driving semiconductor integrated circuit according to another embodiment of the present invention.

Referring to FIG. 11, configuration of a display driving semiconductor integrated circuit (hereinafter, IC) 20 is described below. FIG. 11 is an explanatory view illustrating the configuration of the IC 20 (IC for driving a display device).

An operational amplifier 1 receives at its positive input terminal an output from a DAC circuit 8 connected to the operational amplifier 1 in series. Further, the operational amplifier 1 receives at its negative input terminal an output from a DAC circuit 8 connected to the operational amplifier 1 in series and located adjacent to the DAC circuit 8. More specifically, an operational amplifier 1-1 receives at its positive input terminal an output from a DAC circuit 8-1, and receives at its negative input terminal an output from a DAC circuit 8-2 via a switch 2*a*, as illustrated in FIG. 11. Similarly, an operational amplifier 1-2 receives at its positive input terminal the output from a DAC circuit 8-2, and receives at its negative input terminal the output from a DAC circuit 8-1 via a switch 2*a*. Moreover, the IC 20 includes spare sampling circuits 26A and 26B, spare hold circuits 27A and 27B, spare DAC circuits 28A and 28B, operational amplifier 21A and 21B, and pull-up/pull-down circuits 25A and 25B. The operational amplifier 21A receives at its positive input terminal an output from the DAC circuit 28A and receives at its negative input terminal an output from the DAC circuit 28B via a switch 2*a*. Furthermore, the operational amplifier 21B receives at its positive input terminal the output from the DAC circuit 28B and receives at its negative input terminal the output from the DAC circuit 28A via a switch 2*a*.

<Normal Operation of IC 20>

In the normal operation of the IC 20, a control circuit outputs a test signal of "L" level, and test B signal of "H" level, as in Embodiment 1. By this, the DAC circuits 8 convert into gray scale voltage signals the gray scale data inputted thereto from the respective hold circuits 7, and output the gray scale voltage signals to the positive input terminals of the operational amplifiers 1 as gray scale voltages. In this case, the switch 2*b* is ON, so that the outputs of the operational amplifiers 1 are supplied to their negative input terminals thereby to perform negative feedback. Thereby, the operational amplifiers 1 operate as voltage followers. Thus, the operational amplifiers 1 buffer the gray scale voltage supplied thereto from the DAC circuit 8, and then outputs the buffered gray scale voltage to the corresponding output terminals OUT 1 to OUT n.

<Switching to Operation Checking Test>

Switching to operation checking test for IC circuit 20 is carried out by the control circuit outputting a test signal of "H" level and a test B signal of "L" level. The switch 2*a* is turned ON thereby inputting TSTR1 signal to the sampling circuit 26A and odd-numbered sampling circuits 6 (sampling circuits 6-1, 6-3, . . . 6(*n*−1)). Furthermore, TSTR2 signal is inputted to the sampling circuits 26B and even-numbered sampling circuits 6 (sampling circuits 6-2, 6-3, . . . , 6-*n*). Furthermore, as a result of the turning-ON of the switch 2*a*, the output of an even-numbered DAC circuit 8 is inputted to the negative input terminal of an odd-numbered DAC circuit 8 located adjacently in pair with the even-numbered DAC circuit 8. Meanwhile, the output of the odd-numbered DAC circuit 8 is inputted to the negative input terminal of the even-numbered DAC circuit 8 located adjacently in pair with the odd-numbered DAC circuit 8. Moreover, when the test B signal is of "L" level, the switch 2*b* is turned OFF. By this, the operational amplifier 1 stops supplying its output to its own negative input terminal thereby stopping the negative feedback. Consequently, the operational amplifier 1 becomes a comparator for comparing the output from the DAC circuit connected to the operational amplifier 1 in series, with the output from the DAC circuit 8 that is adjacent to the DAC circuit 8.

<Operation Checking Test 1 of Embodiment 2>

Figure 12:
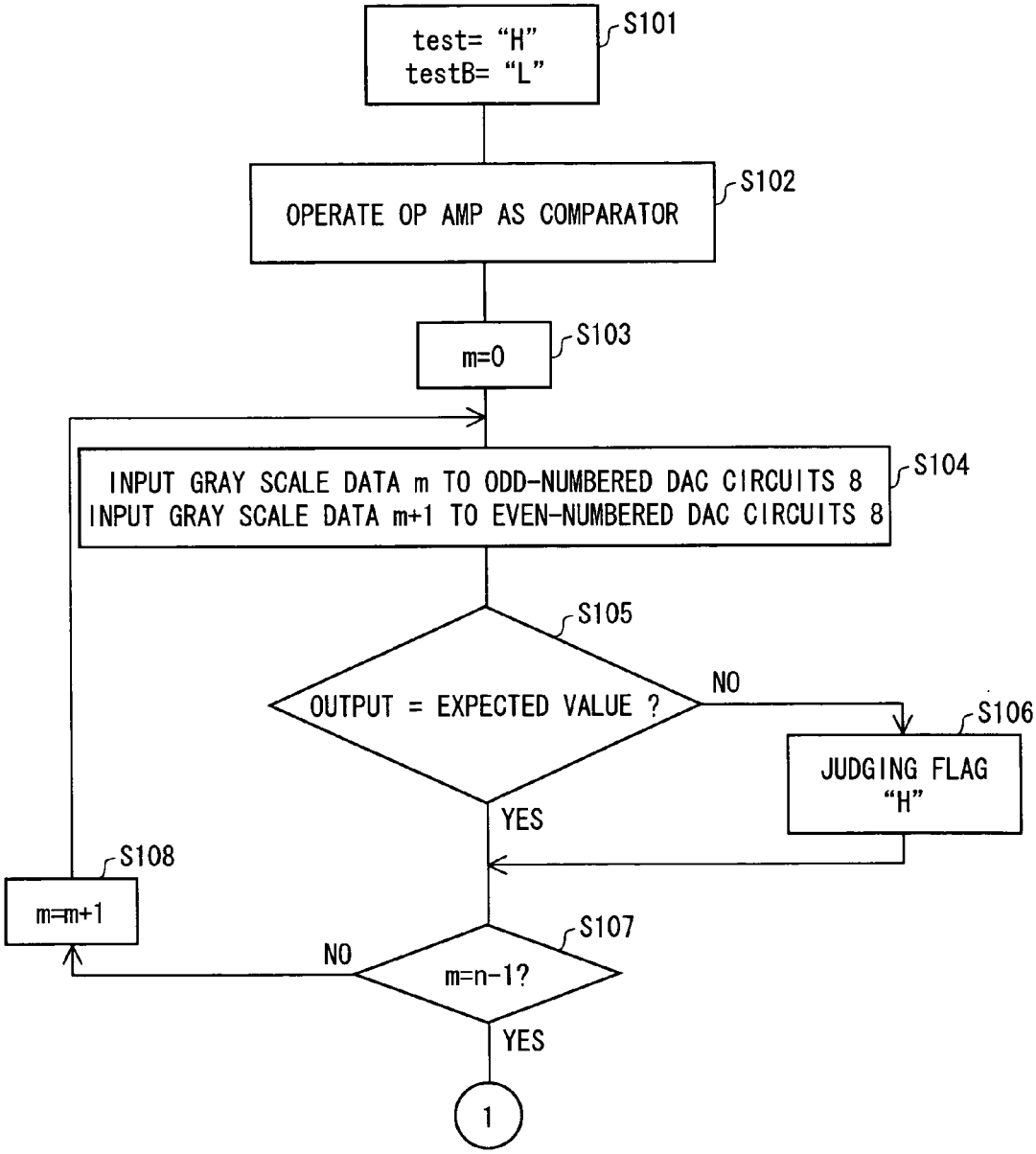
FIG. 12 is a flowchart illustrating that a first procedure in the operation checking test according to the another embodiment of the present invention.

In the following, a first procedure of the operation checking test according to Embodiment 2 is described, referring to FIG. 12, which is a flowchart illustrating the first procedure of the operation checking test.

Firstly, the control circuit outputs the test signal of "H" level and test B signal of "L" (S101). By this, the operational amplifier 1 operates as the comparator (S101). Then, the control circuit sets expected values of the odd-numbered judging circuits 3 (judging circuits 3-1, 3-3, . . . , 3-(*n*−1)) to the "L" level. On the other hand, the control circuit sets expected values of the even-numbered judging circuits 3 (judging circuits 3-2, 3-4, . . . , 3-*n*) to the "H" level.

Next, the control circuit initializes the counter m of the control circuit to 0 (S103). Further, the control circuit activates TSTR1, and the sampling circuit 26A and the odd-numbered sampling circuits 6 receive the gray scale data of gray scale m via the data bus. Moreover, the control circuit activates TSTR2, and the sampling circuit 26B and the even-numbered sampling circuits 6 receive the gray scale data of gray scale m+1 via the data bus (S104).

Assume the case where the value of the counter m is 0. The odd-numbered operational amplifiers 1 receives the gray scale voltage of gray scale 0 at their positive input terminal from the odd-numbered DAC circuit 8 correspondingly connected with the odd-numbered operational amplifiers 1 in series. Moreover, the odd-numbered operational amplifiers 1 receive gray scale voltage of gray scale 1 at their negative input terminals from the even-numbered DAC circuits 8 adjacent to the odd-numbered operational amplifiers 1 correspondingly. If the DAC circuit 8 connected to the two input terminals of the operational amplifier 1 is not defective, the even-numbered operational amplifier 1 outputs "H".

Next, the judging circuit 3 judges whether the level of the output signal from the operational amplifier 1 is identical with the expected value recorded in the judging circuit 3 (S105). If the output from the operational amplifier 1 is different from the expected value, the judging circuit 3 outputs a "H" flag to the judging flag 4 (S106). The steps S104 to S106 are repeated until the value of the counter m reaches n−1, while increasing the value of the counter m by one every time the steps S104 to S106 are repeated (S107, S108)<

<Operation Checking Test 2 of Embodiment 2>

Figure 13:
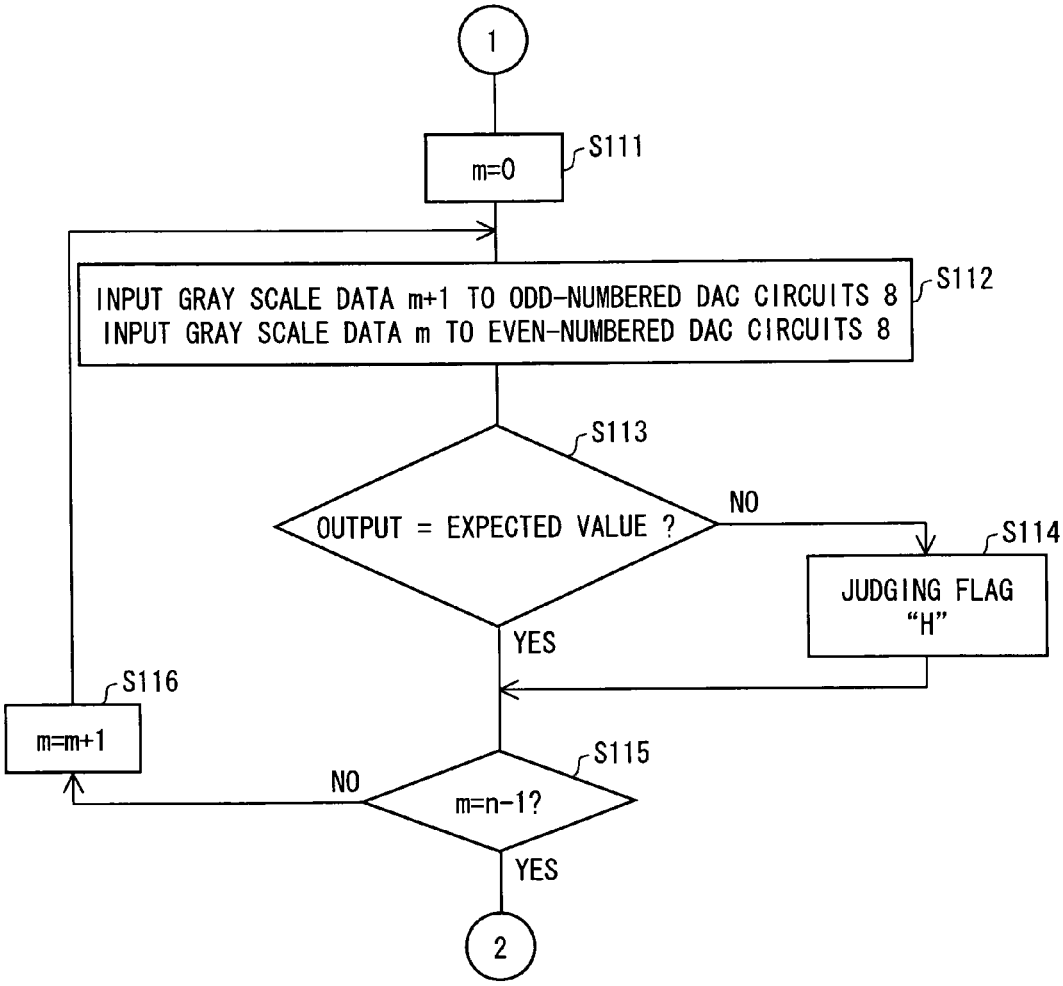
FIG. 13 is a flowchart illustrating that a second procedure in the operation checking test according to the another embodiment of the present invention.

Next, a second procedure of the operation checking is described below referring to FIG. 13, which is a flowchart illustrating the second procedure of the operation checking test according to Embodiment 2.

The operation checking test 2 according to Embodiment 2 is opposite to the operation checking test 1 in Embodiment 2, in terms of the voltage relationship between the odd-numbered or even numbered operational amplifiers 1 and the voltages of gray scale. Apart from that, the same operation is carried out in the operation checking test 2 according to Embodiment 2.

Firstly, the control circuit sets the expected values of the odd-numbered judging circuits 3 to "H", and the expected values of the even-numbered judging circuits 3 to "L". Furthermore, the control circuit initializes the counter m thereof to 0 (S111).

Then, the counter circuit activates TSTR1, and the sampling circuit 26A and the odd-numbered sampling circuits 6 receive the gray scale data of gray scale m+1 via the data bus. Meanwhile, the control circuit activates TSTR2, and the sampling circuit 26B and the even-numbered sampling circuits 6 receive gray scale data of gray scale m via the data bus (S112).

Assume that the value of the counter m is 0. In this case, the odd-numbered operational amplifier 1 receive the gray scale voltage of gray scale 1 at its positive input terminal from the odd-numbered DAC circuit 8 connected thereto in series. Moreover, the odd-numbered operational amplifier 1 receives the gray scale voltage of gray scale 0 at its negative input terminal from the even-numbered DAC circuit 8 adjacent thereto. If the DAC circuit 8 connected to the two input terminals of the operational amplifier 1 is not defective, the odd-numbered operational amplifier 1 outputs the "H" level. On the other hand, the even-numbered operational amplifier 1 receives the gray scale of gray scale 0 at its positive input terminal from the even-numbered DAC circuit 8 connected thereto in series. Moreover, the even-numbered operational amplifier 1 receives the gray scale voltage of gray scale 1 at its negative input terminal from the odd-numbered DAC circuit 8 adjacent thereto. If DAC circuit 8 connected to the two input terminals of the operational amplifier 1 is not defective, the even-numbered operational amplifier 1 outputs the "L" level.

Next, the judging circuit 3 compares the level of the output from the operational amplifier 1 with the expected value recorded in the judging circuit 3 (S113). If the output from the operational amplifier 1 is different from the expected value, the judging circuit 3 outputs a "H" flag to the judging flag 4. The steps S112 to S114 are repeated until the value of the counter m reaches n−1, while increasing the value of the counter m by one every time the steps S112 to S114 are repeated (S115, S116)<

<Operational Checking Test 3 According to Embodiment 2>

Figure 14:
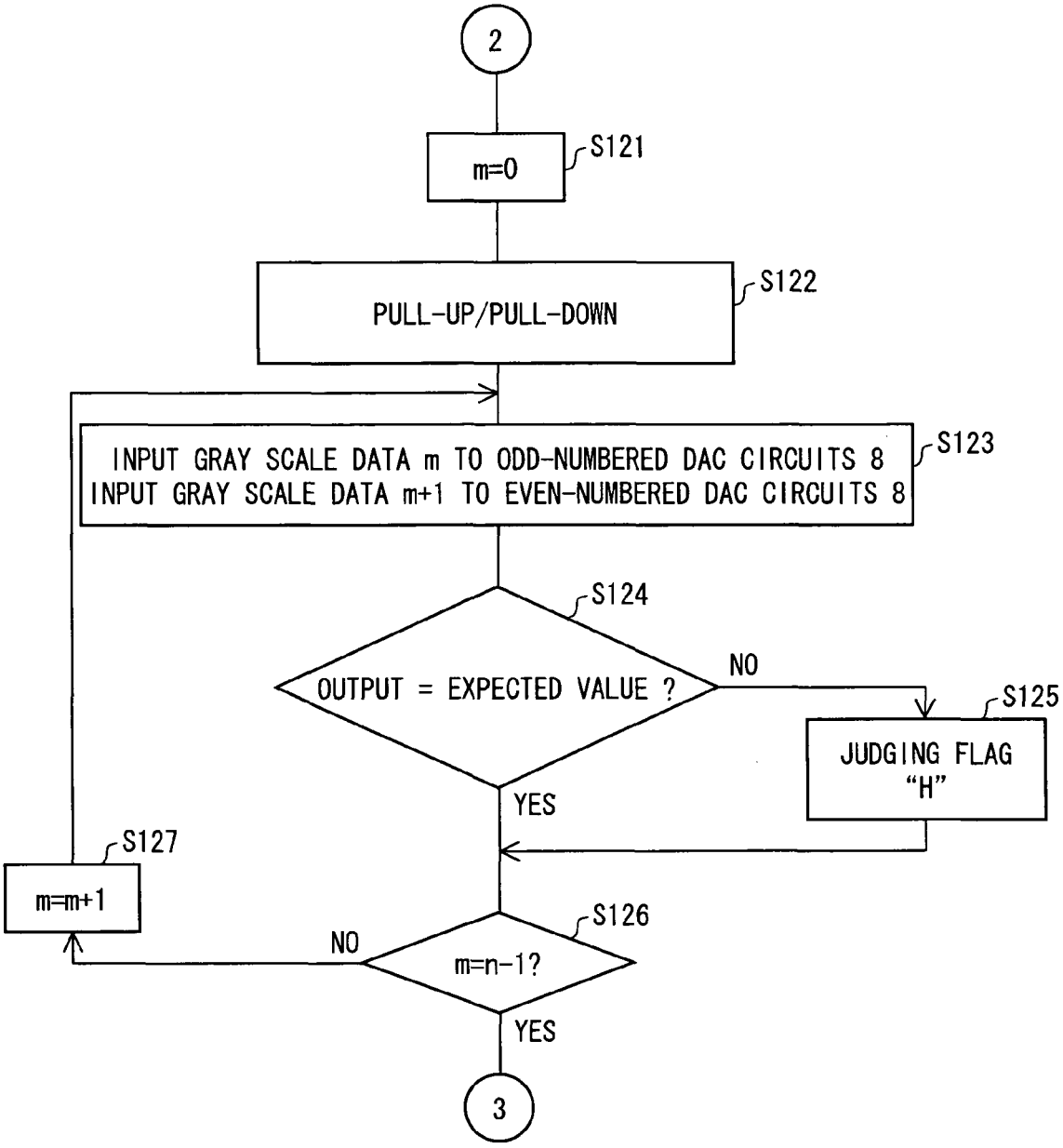
FIG. 14 is a flowchart illustrating that a third procedure in the operation checking test according to the another embodiment of the present invention.

Next, a third procedure of the operation checking test according to Embodiment 2 is described below, referring to FIG. 14, which is a flowchart illustrating the third procedure of the operation checking test according to Embodiment 2.

As described in the third operation checking test in Embodiment 1, if the DAC circuit 8 has such a defect that its output is open, there is a case that the operational amplifier 1 would maintain the gray scale voltage inputted thereto during the previous operation checking test, so that no defect can be detected in the checking tests 1 and 2 of Embodiment 2.

Firstly, as in the operation checking tests 1 and 2, the control circuit initializes the value of the counter m thereof to 0 (S121). Moreover, the IC 20 is configured such that the positive input terminal of the DAC circuit 8 is connected to the pull-up/pull-down circuit 5. The control circuit controls the pull-up/pull-down circuit 5 to pull up the positive input terminal of the odd-numbered operational amplifier 1 (S122). As a result, if the output of the odd-numbered DAC circuit 8 is open, a high voltage is inputted to the positive input terminal of the odd-numbered operational amplifier 1. Meanwhile, the control circuit controls the pull-up/pull-down circuit 5 to pull down the positive input terminal of the even-numbered operational amplifier 1 (S122). As a result, if the output of the even-numbered DAC circuit 8 is open, a low voltage is inputted to the positive input terminal of the even-numbered operational amplifier 1.

Then, the steps S123 to S127 are performed, which are same as the operation checking test 1 according to Embodiment 2, and whose explanation is omitted here.

<Operation Checking Test 4 of Embodiment 2>

Figure 15:
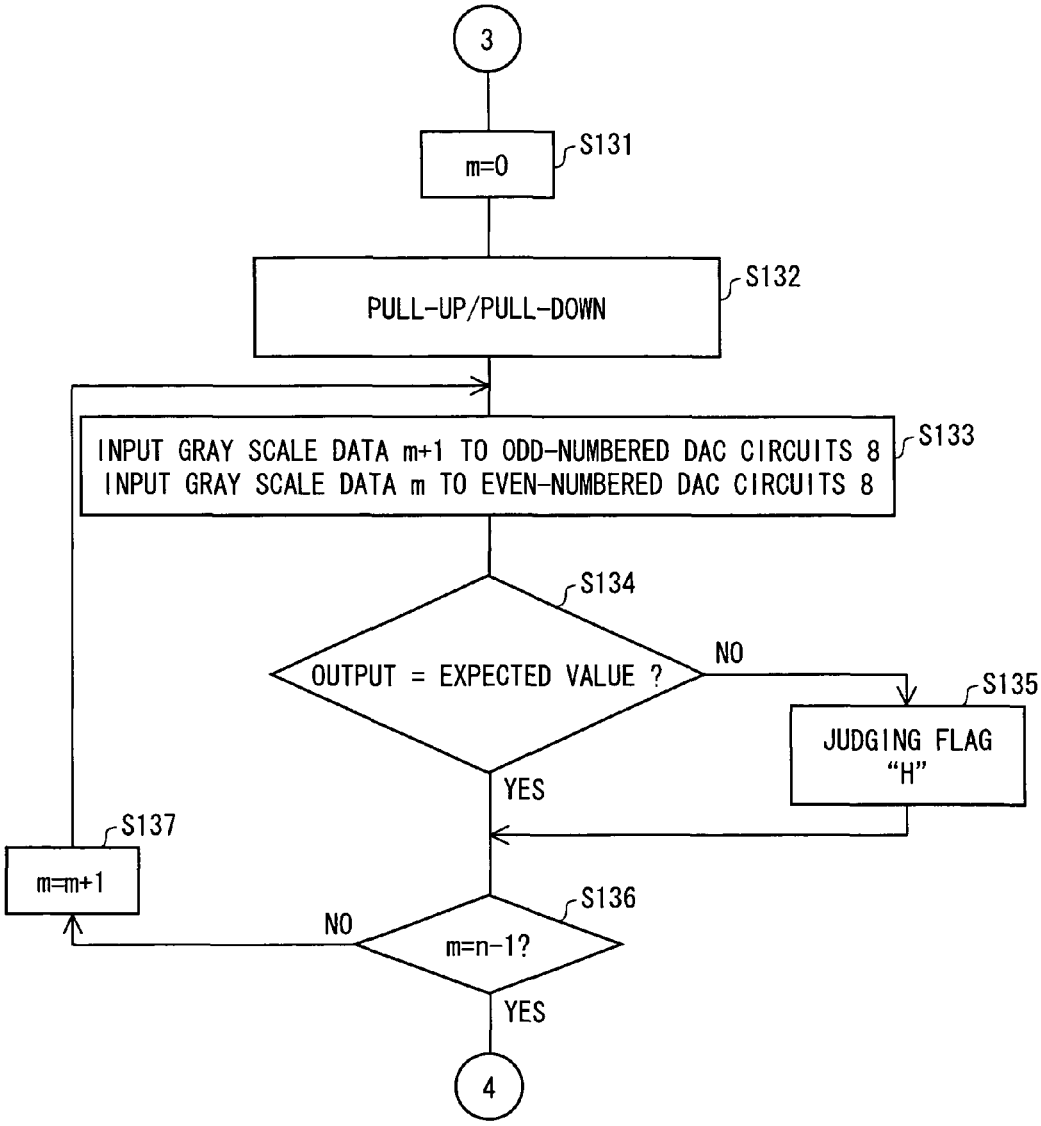
FIG. 15 is a flowchart illustrating that a fourth procedure in the operation checking test according to the another embodiment of the present invention.

Next, a fourth procedure of the operation checking test according to Embodiment 2 is described below referring to FIG. 15, which is a flowchart illustrating the fourth procedure of the operation checking test according to Embodiment 2.

The operation checking test 4 aims at detecting the same defect as the operation checking test 3. Firstly, the control circuit initializes the value of the counter m thereof to 0, as in the operation checking test as described above (S131). Next, the control circuit controls the pull-up/pull-down circuit 5 to pull down the positive input terminal of the odd-numbered operational amplifier 1 (S122). As a result, if the output of the odd-numbered DAC circuit 8 is open, a low voltage is inputted to the positive input terminal of the odd-numbered operational amplifier 1. Meanwhile, the control circuit controls the pull-up/pull-down circuit 5 to pull up the positive input terminal of the even-numbered operational amplifier 1 (S122). As a result, if the output of the even-numbered DAC circuit 8 is open, a high voltage is inputted to the positive input terminal of the even-numbered operational amplifier 1.

Then, the steps S133 to S137 are performed, which are same as the operation checking test 2 according to Embodiment 2, and whose explanation is omitted here.

<Operation Checking Test 5 according to Embodiment 2>

Next, a fifth operation checking test according to Embodiment 2 is described below, referring to FIG. 16, which is a flowchart illustrating the fifth procedure of the operation checking test according to Embodiment 2.

As described for the operation checking test 5 in Embodiment 1, the DAC circuit 8 would have such a defect that a short circuit would occur with respect to two adjacent gray scales that the DAC circuit 8 deals with. The operation checking test 5 according to Embodiment 2 aims at detecting such a defect.

Figure 16:
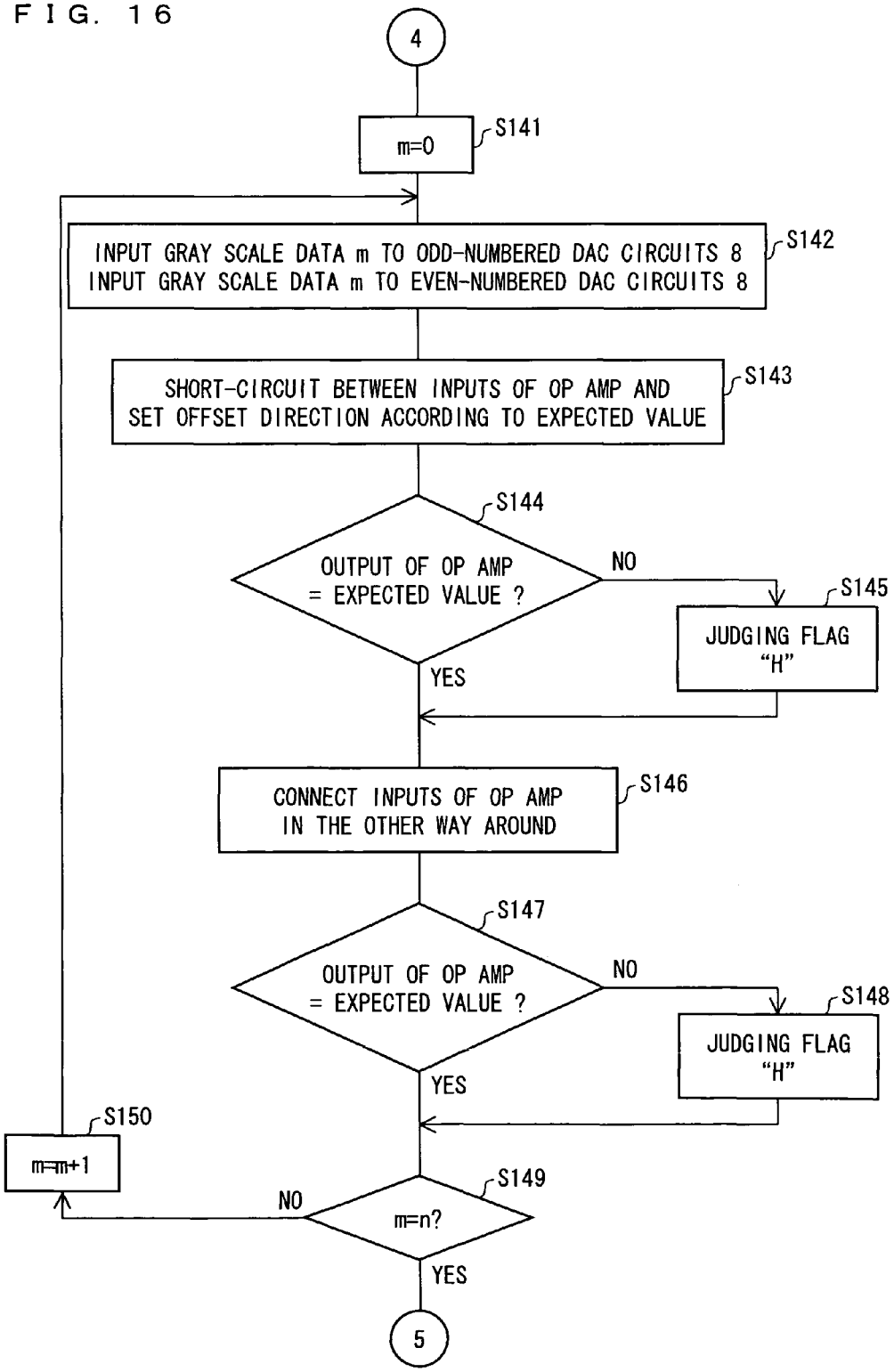
FIG. 16 is a flowchart illustrating that a fifth procedure in the operation checking test according to the another embodiment of the present invention.

As illustrated in FIG. 16, the control circuit initializes the value of the counter m to 0 (S141). Next, TSTR1 and TSTR2 are activated, and the gray scale data of gray scale m is inputted to the sampling circuit 26A, the sampling circuit 26B, and sampling circuits 6 via the data bus. Further, the data LOAD signal is activated, whereby the odd-numbered DAC circuits 8 and the even-numbered DAC circuits 8 output the gray scale voltages of the same gray scale m (S142).

Next, via a switch (not illustrated), the control circuit short-circuits the positive input terminal and the negative input terminal of the operational amplifier 1. Due to the short circuit between the positive input terminal and the negative input terminal of the operational amplifier 1, the same gray scale voltage is inputted to the positive input terminal and the negative input terminal of the operational amplifier 1. Next, the level of the output of the operational amplifier when the positive input terminal and the negative input terminal of the operational amplifier 1 are short-circuited is recorded as an expected value in the judging circuit 3 (S143).

Next, by turning OFF the switch (not illustrated), the short circuit between the positive input terminal and the negative input terminal of the operational amplifier 1 is dissolved. As a result, the odd-numbered operational amplifier receives at its positive input terminal the gray scale voltage of gray scale m from the odd-numbered DAC circuit 8 connected thereto in series, and receive gray scale voltage of gray scale m from the even-numbered DAC circuit 8 adjacent thereto. On the other hand, the even-numbered operational amplifier 1 receives at the positive input terminal the gray scale voltage of gray scale m from the even-numbered DAC circuit 8 connected thereto in series, and receives at the negative input terminal the gray scale voltage of gray scale m from the odd-numbered DAC circuit adjacent thereto. The judging circuit 3 compares the output of the operational amplifier 1 with the expected value recorded in the judging circuit 3 (S144). Further, if the output of the operational amplifier 1 is different from the expected value recorded in the judging circuit 3, the judging circuit 3 outputs an "H" flag to the judging flag 4. Then, the judging flag 4 records therein the "H" flag inputted thereto from the judging circuit 3.

Next, by using the switch (not illustrated), the control circuit exchanges the signals to be inputted to the positive input terminal and the negative input terminal of the operational amplifier 1 (S146). After that, the same process as in S147 is carried out (S147). As in S145, if the output from the operational amplifier 1 is different from the expected value recorded in the judging circuit 3, the judging circuit 3 outputs "H" to the judging flag 4 (S148).

The steps S142 to S148 as described above are repeated until the value of the counter m reaches n, while increasing the value of the counter m by one every time the steps S142 to S148 are repeated (S149, S150)

<Self-Healing of Embodiment 2>

Figure 17:
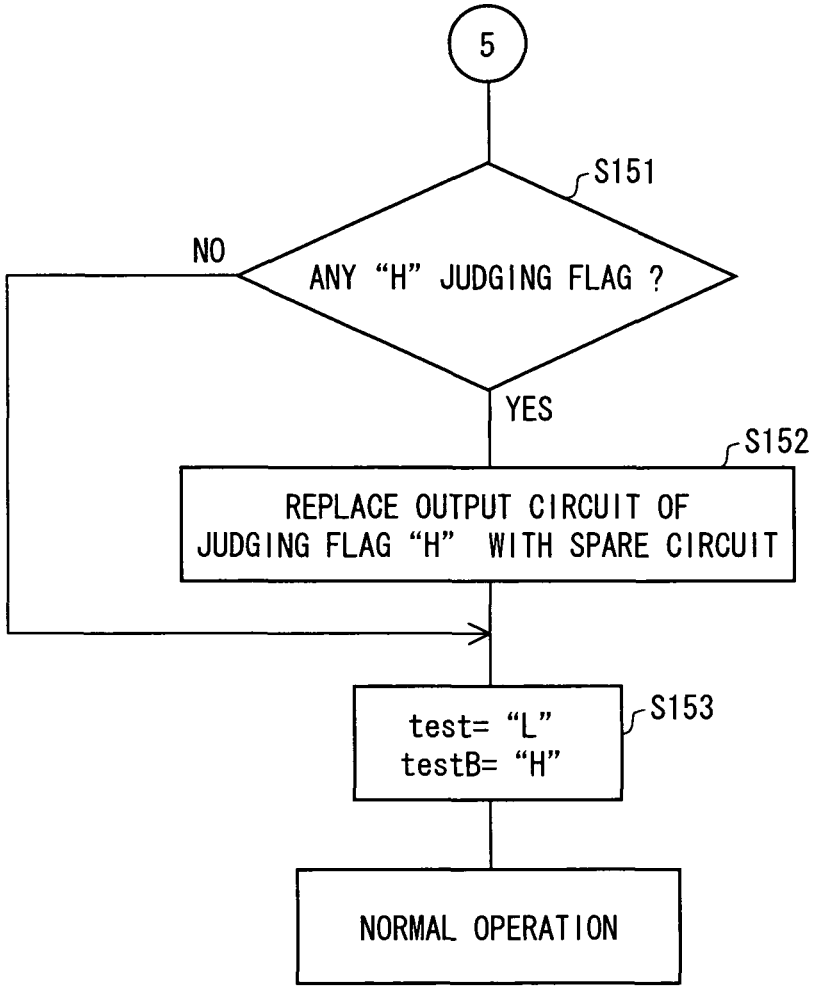
FIG. 17 is a flowchart illustrating how to replace a defective output circuit with a spare output circuit according to the another embodiment of the present invention.

Next, referring to FIG. 17, healing operation is described below which is carried out if the judging flag 4 records "H" therein, in other words, if the judging circuit 3 judges that any of the DAC circuits 8 is defective in the operation checking tests 1 to 5. FIG. 17 is a flowchart illustrating self-healing operation in which the DAC circuit 8 judged as being defective is replaced with the spare DAC circuit 28A and spare DAC circuit 28B.

Firstly, the control circuit detects whether the judging flag 4 records "H" therein (S151). If the control circuit detects that the judging flag 4 does not record "H" therein, the control circuit proceeds to S153. On the other hand, if the control circuit detects that the judging flag 4 records "H" therein, the control circuits replace the DAC circuit 8, which corresponds to the judging flag 4 storing "H" therein, with the spare DAC circuit 28A or spare DAC circuit 8B.

In Embodiment 2, the operation checking test tests the DAC circuits 8, two in pair. Thus, even if the judging flag 4 stores "H" therein, it is not possible to judge which one of the DAC circuits in pair is defective. Therefore, in Embodiment 2, the pair of the DAC circuits 8 corresponding to the judging flag 4 recording "H" therein, in other words, an odd-numbered DAC circuit 8 and an even-numbered DAC circuit in pair are replaced with the spare DAC circuits 28A and 28B (S152). The self-healing operation is described below with a concrete example in which it is put that the DAC circuit 8-1 is defective.

If the DAC circuit 8-1 is defective, the judging circuits 3-1 to 3-2 output "H" to the judging flag 4-1 and 4-2 respectively, as a result of the operation checking tests 1 to 5. Furthermore, the judging flags 4-1 and 4-2 output to the switches 2*c* and 2*d* the "H" flags inputted from the judging circuits 3-1 to 3-2 to the judging flags 4-1 and 4-2. Thereby, the switch 2*c* is turned OFF, while the switch 2*d* is turned ON. As a result, the sampling circuit 26A receives STR1 signal and the sampling circuit 26B receives STR2 signal. Thereby, the sampling circuit 26A receives via the data bus the gray scale data that corresponds to the liquid crystal driving signal output terminal OUT 1. Meanwhile, the sampling circuit 26B receives via the data bus the gray scale data that corresponds to the liquid crystal driving signal output terminal OUT 2. Furthermore, by turning OFF the switch 2*c*, the output of the operational amplifier 1-1 is disconnected from the liquid crystal driving signal output terminal OUT 1, while the output of the operational amplifier 1-2 is disconnected from the liquid crystal driving signal output terminal OUT 2, likewise. Further, by turning ON the switch 2*d*, the output of the operational amplifier 21A is connected from the liquid crystal driving signal output terminal OUT 1, while the output of the operational amplifier 21B is connected from the liquid crystal driving signal output terminal OUT 2, likewise.

As described above, a defective DAC circuit 8 and a DAC circuit 8 paired with the defective DAC circuit 8 are replaced in pair with the spare DAC circuits 28A and 28B. In this way, the defective DAC circuit 8 can be replaced with the spare DAC circuit 28A or 28B.

Then, the control circuit turns the test signal to "L" and the test B signal to "H", and then proceeds to the normal operation (S153).

Embodiment 3

In Embodiments 1 and 2 described above, the ICs 10 and 20 includes the switching circuit 60 (see FIG. 2) for switching over the gray scale voltage from the output circuit block 30 (see FIG. 2) and the spare output circuit block 40 (see FIG. 2). It should be noted that the present invention is not limited to such a configuration and may be configured such that the switching circuit 60 is provided to the display panel.

The following describes a configuration and operation of a display device 90' in which a display panel is provided with a switching circuit 60. In the present embodiment, what is different from Embodiment 1 is described while what is identical with Embodiment 1 is not explained repeatedly.

<Brief Explanation of Structure of Display Device 90'>

Figure 18:
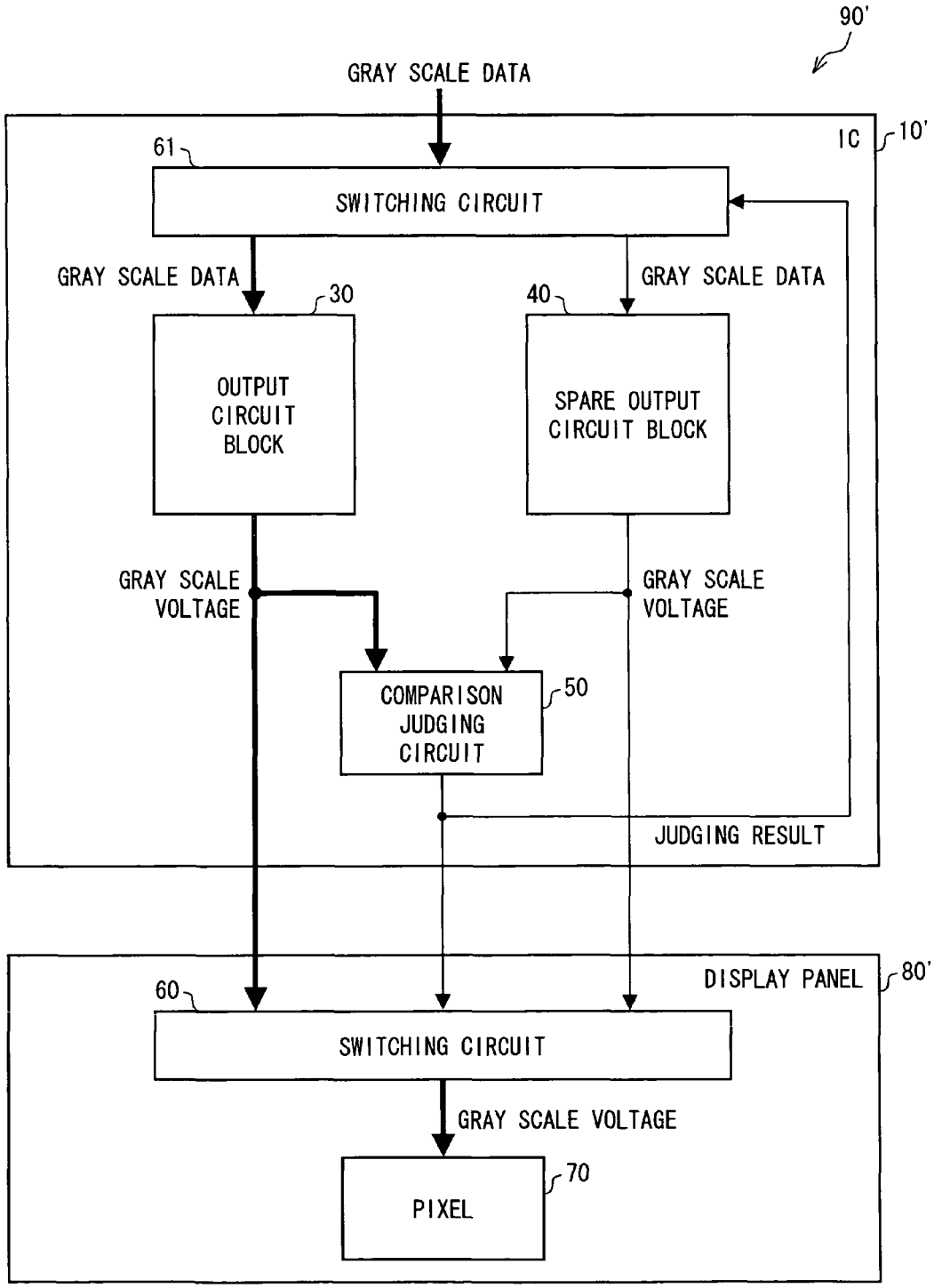
FIG. 18 is a block diagram schematically illustrating a structure of a display device according to still another embodiment of the present invention.

To begin with, a structure of the display device 90' according to the present embodiment is schematically described, referring to FIG. 18, which is a block diagram illustrating the structure of the display device 90' schematically.

As illustrated in FIG. 18, the display device 90' includes a display panel 80', an IC 10' for driving the display panel 80' according to gray scale data inputted to the IC 10' from outside. Here, the integrated circuit 10' is different from the integrated circuit 10 of Embodiment 1 in that the integrated circuit 10' does not include a switching circuit 60. Apart from that, the integrated circuit 10' is identical with the integrated circuit 10. Moreover, the display panel 80' is different from the display panel 80 of Embodiment 1 in that the display panel 80' includes a switching circuit 60. Apart from that, the display panel 80' is identical with the display panel 80.

<Structure of Display Device 90'>

Figure 19:
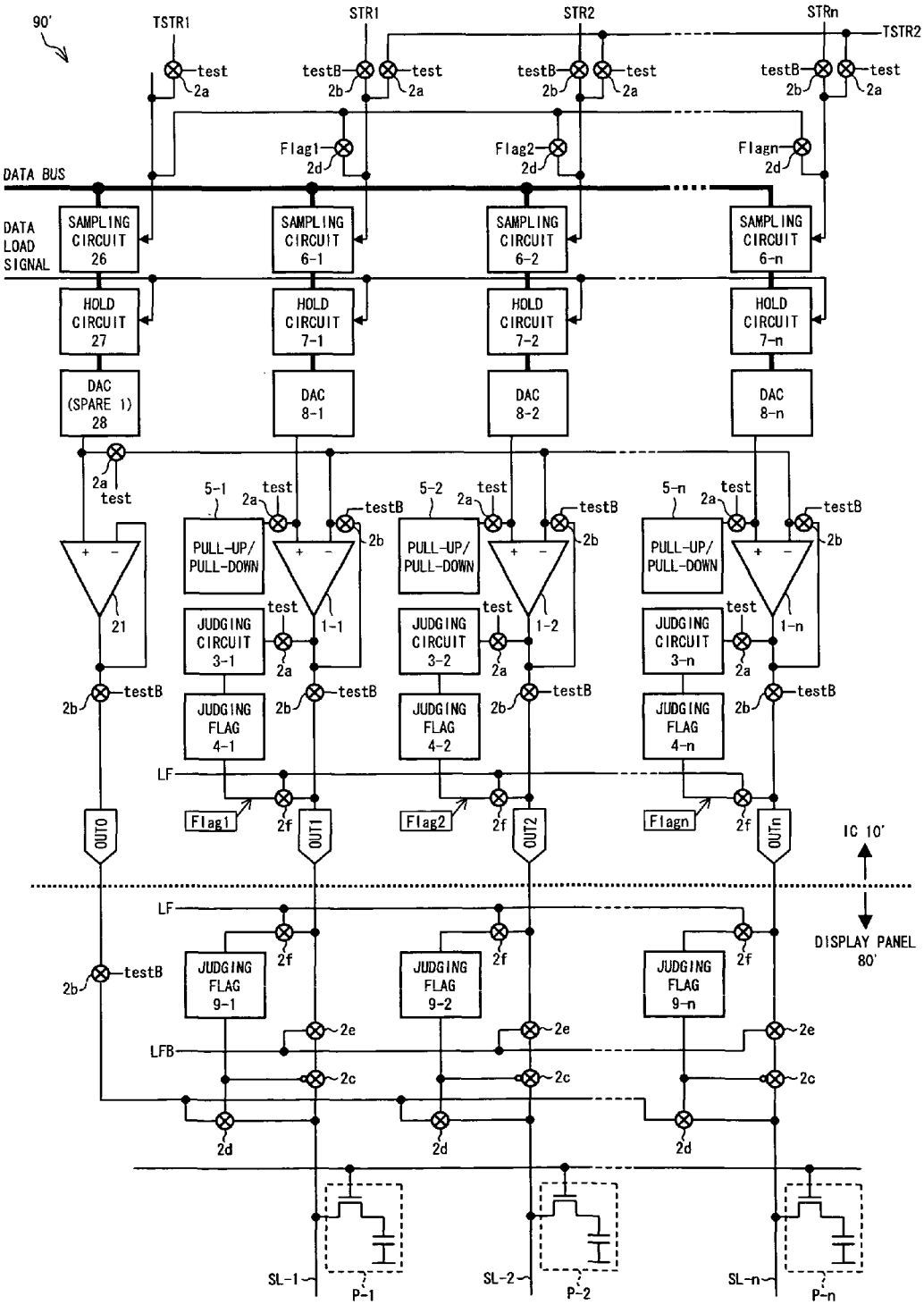
FIG. 19 is a block diagram illustrating a structure of a display device according to yet another embodiment of the present invention.

Next, referring to FIG. 19, the structure of the display device 90' according to the present embodiment is described in more details. FIG. 19 is a block diagram illustrating the structure of the IC 10'.

As illustrated in FIG. 19, the IC 10' includes an n number of sampling circuits 6 for receiving gray scale data via a data bus from a gray scale data input terminal (not illustrated), the gray scale data respectively corresponding to an n number of output terminals OUT 1 to OUT n, an n number of hold circuits 7, DAC circuits 8 for converting the gray scale data into gray scale voltage signals, operational amplifiers 1 for functioning as buffer circuits for the gray scale voltage signals from the DAC circuits 8, an n number of judging circuits 3, and an n number of pull-up/pull-down circuits 5.

Further, as illustrated in FIG. 19, the IC circuit 10' includes a plurality of switches 2*a* for turning ON and OFF according to test signal, a plurality of switches 2*b* for turning ON and OFF according to test B signal, a plurality of switches 2*f* for turning ON and OFF according to LF signal. The switches 2*a*, 2*b* and 2*f* are turned when a signal of "H" is inputted therein, and turned OFF when a signal of "L" is inputted therein. Furthermore, the IC circuit 10' includes a spare sampling circuit 26, a spare hold circuit 27, a spare DAC circuit 28, a spare operational amplifier 21, and a spare output terminal OUT0, one each.

Meanwhile, as described in FIG. 19, the display panel 80' includes connection terminals (not illustrated) for being connected respectively with the output terminals OUT 1 to OUT n of the IC terminals 10', judging flags 9-1 to **9-*n* (hereinafter, referred to as judging flags 9 collectively, where appropriate), switches 2*f* for turning ON and OFF according to the LF signal from a control circuit (not illustrate), switches 2*e* for turning ON and OFF according to LFB signal, which is an inversion signal of the LF signal, and switches 2*c* and 2*d* for turning ON and OFF according to Flag 1 to Flag n, which are output signals from the judging flags 9 respectively. The switches 2*d*, 2*e*, and 2*f* are turned ON when a signal of "H" is inputted thereto, and turned OFF when a signal of "L" is inputted thereto. Meanwhile, the switches 2*c*** are turned ON when a signal of "L" is inputted thereto, and turned OFF when a signal of "H" is inputted thereto.

Moreover, the display panel 80' according to the present embodiment is a liquid crystal display panel and, as illustrated in FIG. 19, has data signals lines SL-1 to SL-n (hereinafter, referred to as data signal lines SL collectively, where appropriate) connected to the corresponding output terminals OUT of the IC 10' via the switches **2*e* and 2*c*. Moreover, the data signal lines SL are connected respectively with pixels P which are as many as scanning signal lines GL. In FIG. 19, the pixel connected to the data signal line SL-1 is referred to as pixel P-1**, and the pixel connected to the data signal line SL-n is referred to as P-n.

<Self-Healing of Embodiment 3>

The following describes self-healing operation of the display device 90' according to the present embodiment in case where a judging flag 4 records a "H" flag therein as a result of operation checking tests. Note that the operation checking tests are carried out in the same manner as the operation checking tests 1 to 5 in Embodiment 1. Thus, their explanation is omitted here.

At the end of the operation checking tests 1 to 5, the test signal is of "H", and the test B signal is of "L". Thus, the operation amplifier 1 is disconnected from the output terminal OUT by the switch **2*b*. In this situation, the control circuit outputs an LF signal of "H" and an LFB signal of "L" after the completion of the operation checking tests 1 to 5. The output of the LF signal of "H" turns ON the switches 2*f* thereby to connect the judging flags 4 with the judging flags 9 via the output terminals OUT, respectively. Further, the judging flags 4 each output the flag of "H" or "L" recorded therein to the corresponding judging flags 9 via the output terminals OUT as Flag 1 to Flag n. The judging flags 9 respectively receive and then record Flag 1 to Flag n in their internal memories and outputs the Flag 1 to Flag n to the switches 2*c* and 2*d* connected thereto respectively. Because the LFB signal is of "L" in the period in which the LF signal is of "H", each switch 2*e* is turned OFF in this period. By this, it is prevented to output Flag 1 to Flag n to the data signal lines SL-1 to SL-n from the judging flags 4. As a result of this, the Flag 1 to Flag n outputted from the judging flags 4** will not affect the pixels P.

In the following the self-healing operation of the display device 90' is described in detail by referring to an example in which the judging flag 4-1 corresponding to the output terminal OUT 1 records a "H" flag therein.

In case where the judging flag 4-1 corresponding to the output terminal OUT 1 records a "H" flag therein, in other words, in case where the DAC circuit 8-1 is defective, the judging flag 9-1 receives the "H" flag from the judging flag 4 and stores the "H" flag in its internal memory. In this example, it is put that the judging flags 4-2 to **4-*n*** record "L" flags therein.

Next, the judging flag 9-1 outputs the Flag 1 of "H" to the switches **2*c* and 2*d* connected to the judging flag 9-1. By this, the switch 2*c* connected to the judging flag 9-1 disconnects the output terminal OUT 1 from the data signal line SL-1. Meanwhile, the switch 2*d* connected to the judging flag 9-1 connects the output terminal OUT 0 with the data signal line SL-1. On the other hand, the judging flags 9-2 to 9-*n* respectively output Flag 2 to Flag n of "L" to the switches 2*c* and 2*d* connected thereto. Thus, the switches 2*c* connected to the judging flags 9-2 to 9-*n* are turned ON, which the switches 2*d* connected to the judging flags 9-2 to 9-*n* are turned OFF. As a result, the data signal lines SL-2 to SL-n are respectively connected with the output terminals OUT 2 to OUT n via the switches 2*e***.

After the switches **2*c* and 2*d* connected to the judging flags 9 are switched over according to Flag 1 to Flag n supplied to the judging flags 9 from the judging flags 4, the control circuit outputs the LF signal of "L" and the LFB signal of "H". By this, the output terminals OUT 2 to OUT n are respectively connected with the data signal lines SL-2** to SL-n.

Next, the control circuit outputs the test signal of "L" and test B signal of "H" after the output of the LF signal of "L". As a result, the data signal line SL-1 is connected to the output of the operational amplifier 21 via the output terminal OUT 0. Meanwhile, the data signal lines SL-2 to SL-n are respectively connected with the operational amplifiers 1-2 to **1-*n* via the output terminals OUT 2 to OUT n. The switch 2*d* connected to the sampling circuit 6-1 is turned ON according to Flag 1 from the judging flag 4-1. Thus, the gray scale data inputted to the sampling circuit 6-1 (i.e. gray scale data to be supplied to the data signal line SL-1) is also inputted to the sampling circuit 26. As a result, the gray scale data to be inputted to the data signal line SL-1 is supplied to the data signal line SL-1 via the output terminal OUT 0, instead of the output terminal OUT 1. Switching in the input of the gray scale data to the sampling circuits 6 and the spare sampling circuit 26** is carried out in the same manner as in Embodiment 1, and is not explained in detail here.

As described above, the display device 90' performs the self-healing operation in which the spare DAC circuit 28 is used in replacement of a DAC circuit 8 judged as being defective. Like Embodiment 1, the present embodiment is provided with the spare sampling circuit 26 and the spare hold circuit 27 for the spare DAC circuit 28. Thus, the present embodiment allows replacement of a defective sampling circuit 6 or hold circuit 7 with the spare sampling circuit 26 or hole circuit 28, beside the DAC circuits 8.

Figure 20:
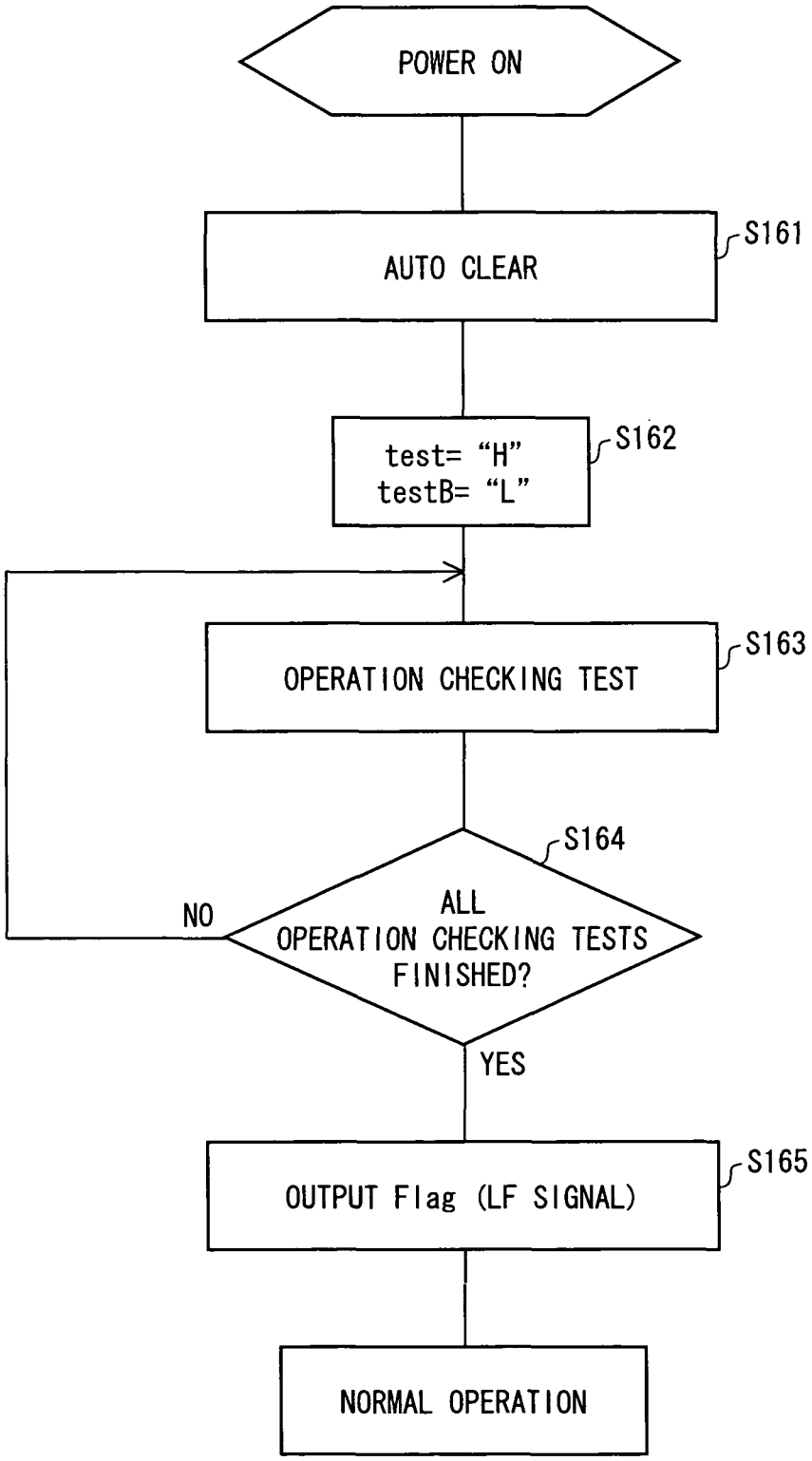
FIG. 20 is a flowchart illustrating steps from turning on the display device, and performing operation checking test, and then moving to normal operation, according to yet another embodiment of the present invention.

Referring to FIG. 20, the following describes how the display device 90' carries out the operation checking test after turned ON, and then proceeds to normal operation. FIG. 20 is a flowchart illustrating how the display device 90' carries out the operation checking test after turned ON, and then proceeds to the normal operation.

As illustrated in FIG. 20, firstly the display device 90' detects that it is turned ON by a user. Then, the display device 90' initializes the IC circuit 10, whereby all the flags recorded in the judging flags 4 are turned to "L" 1S161). Then, the control circuit outputs the test signal of "H" and test B signal of "L", thereby switching the IC 10' to the operation checking test state (S162). After that, the control circuit and the IC 10 perform the operation checking test as described above (S163). Further, the control circuit checks whether all the operation checking tests 1 to 5 have been completed (S164).

If the control circuit detects at S164 that all the operation checking tests 1 to 5 have not been completed yet, the display device 90' proceeds to S163 according to instructions from the control circuit, and performs an operation checking test that has not been completed. On the other hand, if the control circuit confirmed at S164 that all the operation checking tests 1 to 5 have been completed, the control circuit outputs the LF signal of "H" and LFB signal of "L", and if a defective circuit (sampling circuit 6, a hold circuit 7, DAC circuit 9, or operational amplifier 1) is detected, replace the defective circuit with the spare circuit (sampling circuit 26, hold circuit 27, DAC circuit 29, or operational amplifier 21). Then, the display device 90' proceeds to the normal operation (S165).

The display device 90' of the present embodiment is configured such that the judging flag 4 and the judging flag 9 are provided as a circuit for recording therein the flag indicating the result of the judging performed by the judging circuit 3-1. However, the display device 90' may be modified such that the judging flag 9, switch 2*f*, and switch 2*e* are not provided and the judging flag 4 controls the switch 2*c* and 2*d*. In this modification, the LF signal and LFB signal for controlling the switches 2*f* and 2*e* are not necessary, but a wiring and connection terminals for connecting the judging flag 4 with the switches 2*c* and 2*d* are necessary.

Embodiment 4

In Embodiments 1 to 3 described above, the IC circuit and the display panel are connected via the output terminals OUT. It should be noted that present invention encompass a display device in which an IC circuit and the display panel are integrated with each other.

In the following, a display device 90" in which an IC and a display panel are integrated with each other is described as Embodiment 4, referring to FIG. 21. It should be noted that the display device 90" according to the present embodiment is a modification from the display device 90 according to Embodiment 1. Thus, the present embodiment is described as to what is different from Embodiment 1, but not as to what is identical therewith.

<Structure of Display Device 90">

Figure 21:
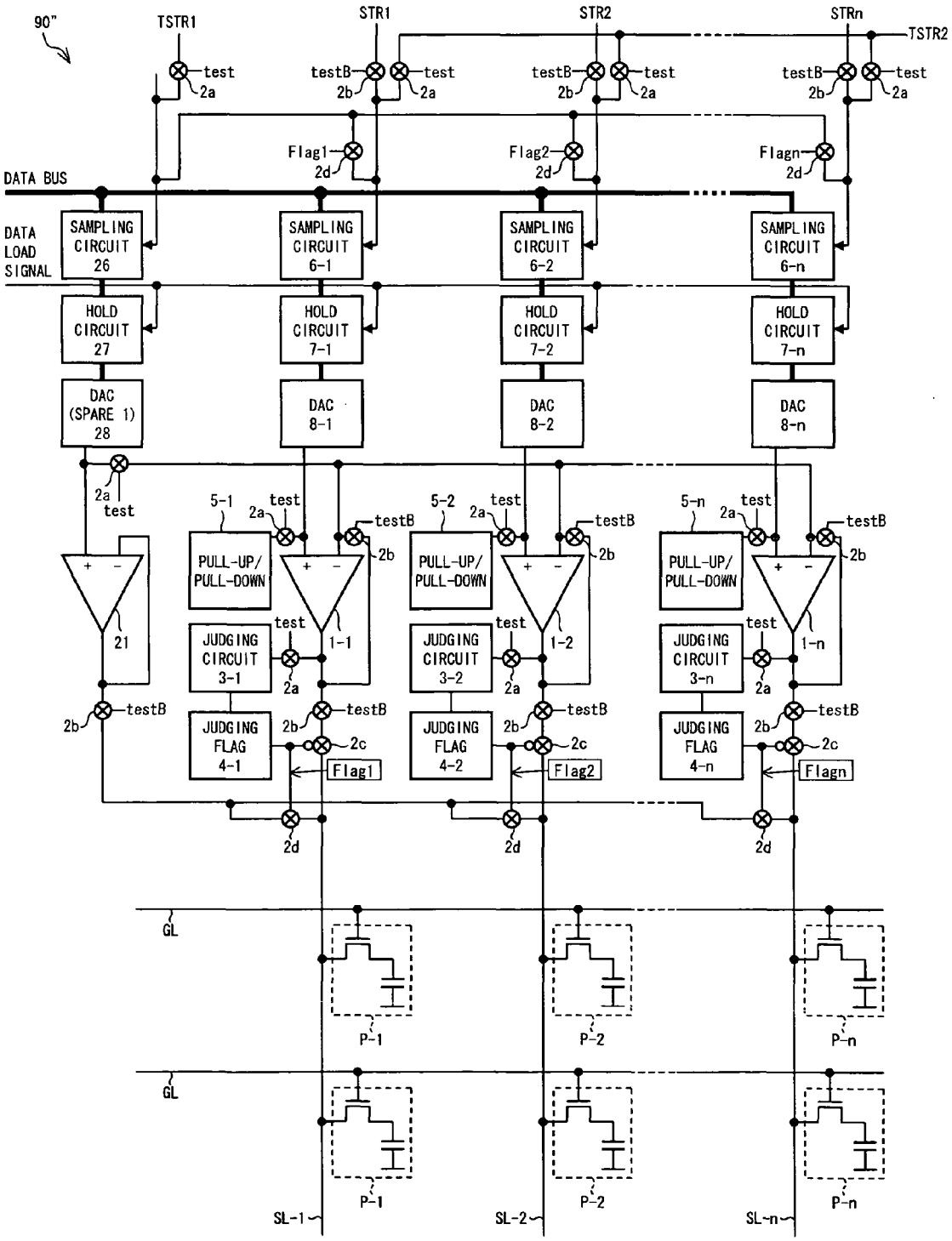
FIG. 21 is a block diagram illustrating a structure of a display device according to the still yet another embodiment of the present invention.

To begin with, a structure of the display device 90" according to the present embodiment is described, referring to FIG. 21, which is a block diagram illustrating the structure of the display device 90".

As illustrated in FIG. 21, the display device 90" is configured such that outputs of operational amplifiers 1 and 21 are respectively connected directly with data signal lines SL via switches 2*b*, 2*c* and 2*d*, unlike in Embodiment 1 in which the IC 10 and the display panel 80 are not integrated. That is, the display device 90" of the present embodiment is different from the display device 90 of Embodiment 1 as to whether the output terminals are provided or not. Apart from that, the display device 90" of the present embodiment is identical with the display device 90 of Embodiment 1.

While the present embodiment is explained as a modification from Embodiment 1, the present invention, needless to say, encompasses a display device modified from Embodiments 2 and 3 in which the IC and the display panel are integrated and the output terminals are not needed.

<Television System>

Figure 22:
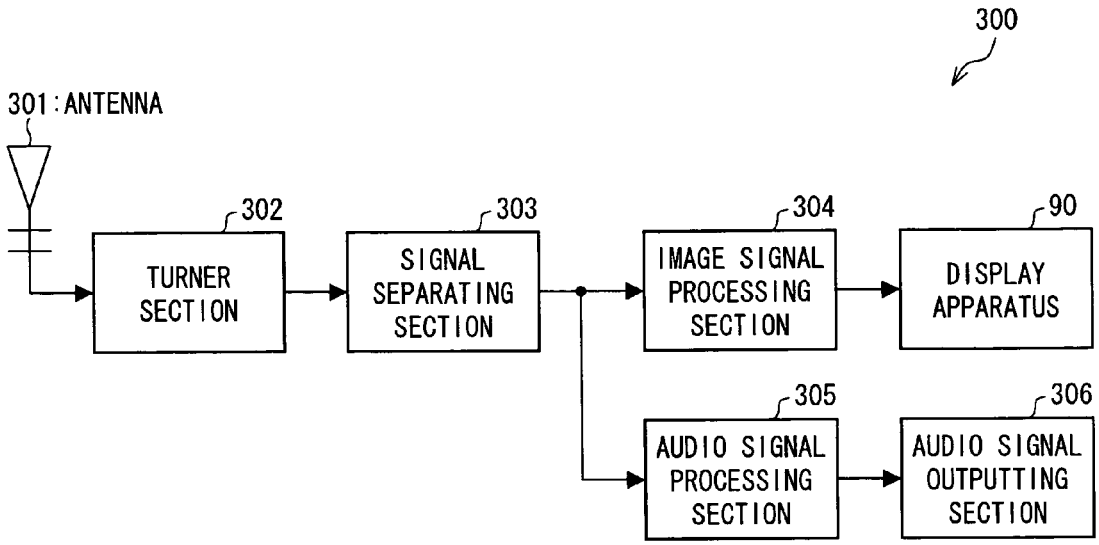
FIG. 22 is a block diagram illustrating a configuration of a television system according to one embodiment of the present invention.

Next, a television system 300 provided with the display device 90 of Embodiment 1 is described referring to FIG. 22, which is a block diagram illustrating the configuration of the television system 300. In the following, it is assumed that the television system 300 is provided with the display device 90 of Embodiment 1. It should be noted that present invention is not limited to this configuration, and may be provided with the display device of any one of Embodiments 2 to 4.

<Configuration of Television System 300>

As illustrated in FIG. 22, the television system 300 includes an antenna 301 for receiving a broadcast wave, a tuner section 302 for demodulating the received broadcast wave into an image/audio signal, a signal separating section 303 for separating into an image signal and an audio signal the image/audio signal thus obtained by the demodulation, an image signal processing section 304 for demodulating into a digital image signal the image signal thus obtained from the separation, a display device 90 for receiving the digital image signal as gray scale data and the demodulation displaying an image on a display panel 80 (see FIG. 2) according to the gray scale data, an audio signal processing section 305 for demodulating into a digital audio signal the audio signal thus obtained from the separation, and an audio signal outputting section 306 for converting the digital audio signal into an analog audio signal and outputting the analog audios signal from a speaker.

<Operation of Television System 300>

Next, an operation of the television system 300 is described below. To begin with, the broadcast wave from a broadcast station is received at the antenna 301. The antenna 301 outputs the received broadcast wave to the turner section 302. The turner section 302 receives the broadcast wave and demodulates the received broadcast wave into an image/audio signal and outputs the image/audio signal to the signal separating section 303. The signal separating section 303 receives the image/audio signal and separates the image/audio signal into an image signal and an audio signal. Then, the signal separating section 303 outputs the image signal and the audio signal to the image signal processing section 304 and the audio signal processing section 305, respectively. The image signal processing section 304 receives the image signal and demodulates the image signal into a digital image signal. Then, the image signal processing section 304 outputs the digital image signal to the display device 90 as gray scale data. The display device 90 receives the gray scale data and displays the gray scale data on the display panel 80 provided to the display device 90. On the other hand, the audio signal processing section 305 demodulates into a digital audio signal the audio signal thus obtained from the separation performed by the signal separating section 303. Then, the audio signal processing section 305 outputs the digital audio signal to the audio outputting section 306. The audio outputting section 306 receives the digital audio signal and converts the digital audio signal into an analog audio signal. Then, the audio outputting section 306 outputs the analog audio signal via the speaker provided to the audio outputting section 306.

The present invention is not limited to the television system 300 as described above in which the image/audio signal is obtained via the antenna 301 and turner 302 from the broadcast station. The present invention may be configured as a content reading device such as a DVD player, so that the image/audio signal is obtained from content data from a recording medium in which the content data is stored. Further, the present invention may be configured such that the image/audio signal is obtained via PC (personal computer) through the Internet or the like.

The present invention is not limited to the configurations as described in Embodiments 1 to 4 in which the operation checking test and the self-healing operation are performed right after the liquid crystal driving semiconductor integrated circuit 10 is turned ON. The present invention may be configured such that the a control signal is inputted to the liquid crystal driving semiconductor integrated circuit 10 so that the operation checking test and the self-healing operation are performed at a timing arbitrarily selected. For example, a signal indicating a retrace period in display operation is supplied from a controller of the display device to the liquid crystal driving semiconductor integrated circuit 10 so that the self-healing operation are performed at this timing.

Moreover, the liquid crystal driving semiconductor integrated circuit 10 may include a circuit for detecting a defect in the liquid crystal driving semiconductor integrated circuit 10, so that the operation checking test and the self-healing operation are performed when a defect occurs in the liquid crystal driving semiconductor integrated circuit 10. For example, it may be arranged such that a current of a signal outputted from the liquid crystal driving semiconductor integrated circuit 10 is detected, so that the operation checking test and the self-healing operation are performed when the current thus detected has a current value greater than a current value set as a reference.

Moreover, the operation checking test and the self-healing operation may be performed at regular intervals. For example, the operation checking test and the self-healing operation are performed in every vertical retrace period in which no display operation is performed, or every time when display period is accumulated to a predetermined time period.

Moreover, the operation checking test and the self-healing operation may be performed in part of a period in which the display operation is performed. For example, a liquid crystal display device is configured such that pixels store the display voltages. Thus, after charging the display voltages, the output of the liquid crystal driving semiconductor integrated circuit may have a high impedance with no fear of affecting the displayed image. Therefore, in part of the display period, the liquid crystal driving semiconductor integrated circuit has a high impedance output, and the operation checking test and the self-healing operation are performed. If the display period is not enough for performing all the patterns of the operation checking test, the operation checking test may be performed in such a manner that, for example, one pattern is performed in the part of display period. Thus, the operation checking test may be performed over a display period for displaying one frame or several frames.

In order to perform self-inspection (operation checking test) to detect its own defect, the IC 10 (see FIG. 1) according to the present invention should stop outputting the output signal for driving the display panel 80 (see FIG. 2). That is, the IC 10 cannot drive the display panel 80 in the period in which the IC 10 is performing the self-inspection. Therefore, the IC 10 should perform the self-inspection in the period in which the self-inspection does not affect the display of the image on the display device.

Therefore, as to self-inspection of the IC 10, the embodiments of the present invention are described such that the self-inspection and self-healing of the IC 10 are performed during a start-up process in turning ON the display device. Because the display device does not perform display during the start-up process thereof, the IC 10 can perform the self-inspection and self-healing without affecting the display of the image on the display device.

The present invention is not limited to the embodiment described above in which, for finding its own defection, the IC circuit 10 performs the self-inspection during the start-up process in turning ON the display device. The self-inspection and self-healing may be performed in a period other than the start-up process of the display device.

In the following Examples, examples of such a period other than the start-up process of the display device are described.

Example 1

Self-Inspection and Self-Healing in Vertical Retrace Period

Example 1 describes that it is possible for the IC 10 to perform the self-inspection and self-healing in a vertical retrace period of the display device, with no fear of affecting the display of the image on the display device. The reason is as follows.

Figure 23:
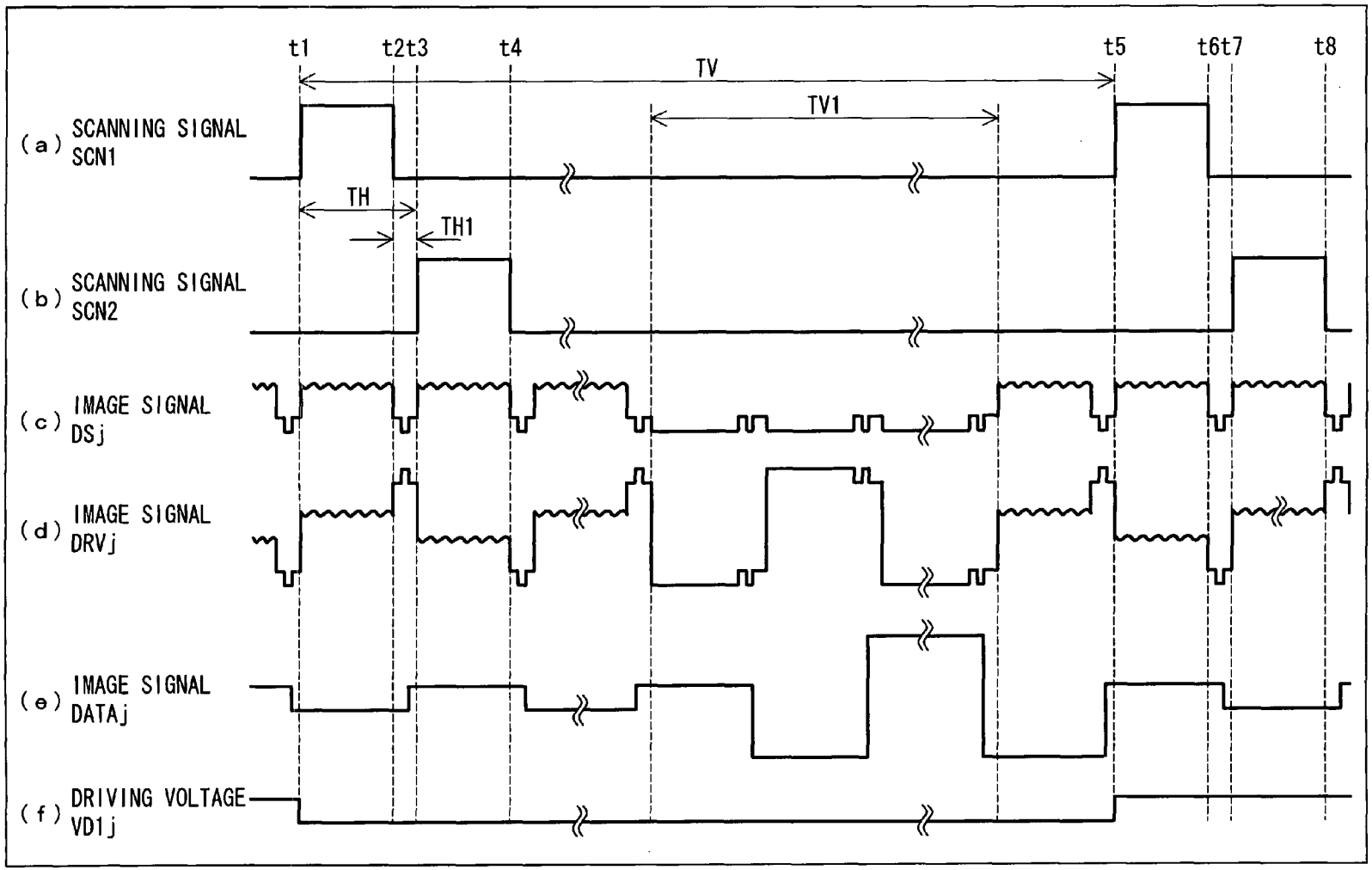
FIG. 23 is a timing chart in which (a) to (f) illustrate the timings of the signals inputted to the display device, which are scanning signals, image signal, and voltage value of a pixel electrode.

Firstly, timing of signals inputted to the display device is explained referring to FIG. 23, (a) to (f), which are timing chart illustrating the timings of the signals inputted to the display device.

In FIG. 23, (a) represents the scanning signal line SCN1 supplied to a first scanning signal line of the display device from a scanning-side driving circuit for driving scanning lines of the display device. (b) represents the scanning signal line SCN2 supplied to a second scanning signal line of the display device from the scanning-side driving circuit. (c) represents an image signal DSj for a j-th data signal line of the display device, the image signal DSj being supplied from the IC 10 (see FIG. 1) to an image signal inverting circuit. (d) represents an image signal DRVj for the j-th data signal line of the display device, the image signal DRVj being supplied from the image signal inverting circuit to a data-side driving circuit. (e) represents an image signal DATAj given to the j-th data signal line of the display device. (f) represents a driving voltage VD1*j* applied to a pixel connected to the first scanning signal line and j-th data signal line in the display device. In FIG. 23, the period TV between time t1 to t5 is a vertical scanning period of the display device. The period TV1 is a vertical retrace period. The period between times t2 to t3 is a horizontal retrace period. The image signal inverting circuit is a circuit for inverting the polarity of the image signal DSj from the IC 10, in order to invert the polarity of a display electrode in each pixel of the display device every horizontal scanning period TH and vertical scanning period TV.

As illustrated by (a) and (b) in FIG. 23, the scanning-side driving circuit outputs the scanning signals SCN1, SCN2, . . . , SCNm to the respective scanning signal lines of the display device at such timings that are delayed sequentially by the horizontal scanning TH. Moreover, the scanning-side driving circuit output the scanning signal SCN1 to SCNm to the respective scanning signal lines of the display device every vertical scanning period TV. Here, it is assumed that the display device has an m number of scanning signal lines.

The image signal DSj from the IC 10, which is indicated by (c) in FIG. 23, is inputted to the image signal inverting circuit. Next, the image signal inverting circuit inverts the polarity of the image signal DSj every horizontal scanning period TH, as well as, every vertical scanning period TV, thereby generating the image signal DVj indicated by (d) in FIG. 23. Further, the image signal inverting circuit inputs the image signal DRVj to the data-side driving circuit.

Next, every horizontal scanning period TH, the data-side driving circuit samples the image signal DRVj supplied from the image signal inverting circuit. As the image signal DATAj indicated by (e) in FIG. 23, signal values thus sampled are respectively outputted to the j-th data signal line of the display device at internals of the horizontal scanning period.

In the pixel connected with the first scanning signal line and the j-th data signal line (hereinafter, this pixel is referred to as "pixel 1*j*"), a TFT inside the pixel 1*j* becomes conductive in response to the scanning signal SCN1 the horizontal scanning period TH between times t1 to t2. Consequently, the image signal voltage of the image signal DATAj between times t1 to t2 is applied, as the driving voltage VD1*j*, to the display electrode inside the pixel 1*j* via the j-th data signal line. The driving voltage VD1*j* applied to the display electrode of the pixel 1*j* is kept at the voltage level of between t1 to t2, even if the TFT inside the pixel 1*j* is not conductive between times t2 to t5. Similarly, as to a pixel connected with a second scanning line and the J-th data signal line in the display device (hereinafter, this pixel is referred to as "pixel 2*j*"), a TFT inside pixel 2*j* becomes conductive in response to the scanning signal SCN2 in the horizontal scanning period between times t3 to t4. Consequently, the image signal voltage of the image signal DATAj between times t3 to t4 is applied, as the driving voltage VD1*j*, to the display electrode inside the pixel 2*j* via the j-th data signal line. The driving voltage applied to the display electrode of the pixel 2*j* is kept at the voltage level of between times t3 to t4, even if the TFT inside the pixel 2*j* is not conductive.

As described above, the driving voltage in each pixel of the display device is kept at the voltage level even if the TFT is not longer conductive inside the pixel, which voltage level the driving voltage had when the TFT was conductive. Therefore, the display device does not apply a voltage on the display electrode of the pixels in the vertical retrace period TV, in which the scanning-side driving circuit dose not output to the scanning signals line the scanning signals SCN1 to SCNm for causing the TFT of the pixels to be conductive, in other words, the TFT of the pixels are not conductive. That is, the IC 10 does not need to output the image signal DSj on which the driving voltage is based. Thus, even if the IC 10 and the display device are separated from each other electrically, the display of the image on the display device will not be affected.

Therefore, the IC 10 can perform the self-inspection and self-healing in the vertical retrace period of the display device, with no fear of affecting the display of image on the display device.

<Operational Defect Detection of the Whole IC 10>

In the present embodiment, the self-inspection process performed by the IC 10 in order to detect a defect in the output circuit blocks thereof is carried out per output circuit block, thereby performing the self-inspection process for all the output circuit blocks that respectively correspond the data signal lines. Thus, the self-inspection process takes a long time.

If there was no possibility that a operational defect occurs in each output circuit block of the IC 10, the IC 10 would have no need of performing the self-inspection process. In other words, the IC 10 is required to perform the self-inspection process only if there is no possibility of an operational defect.

In view of this, the IC 10 may be configured to include an operation judging circuit for judging, for the whole IC 10, whether there is a possibility that a defect occurs. With the operation judging circuit, it is possible to avoid to perform unnecessary self-inspection process, by performing the self-inspection process only when the operation judging circuit judges that a defect occurs somewhere in the IC 10.

In the following, an operation judging circuit 200 provided in the IC 10 is described referring to FIGS. 24 to 26, which judges whether there is a possibility that an operational defect occurs in the whole IC 10.

Firstly, in case where an operational defect occurs in the IC 10, a power source current supplied to the IC 10 is greater than that in the normal operation, in other words, than an initial stage at which the IC 10 judged as being good in quality is shipped out as a final product. Therefore, when the power source current supplied to the IC 10 becomes greater than that in the normal operation by a certain degree, it indicates that a defect occurs in the IC 10. Therefore, the operation detection circuit 200 detects the value of the power source current supplied to the IC 10, and thereby judges from the detected power source current whether an operational defect occurs in the IC 10.

<Configuration of Operation Judging Circuit 200>

A configuration of the operation judging circuit 200 is describes below, referring to FIG. 24, which is a block diagram illustrating the configuration of the operation judging circuit 200.

Figure 24:
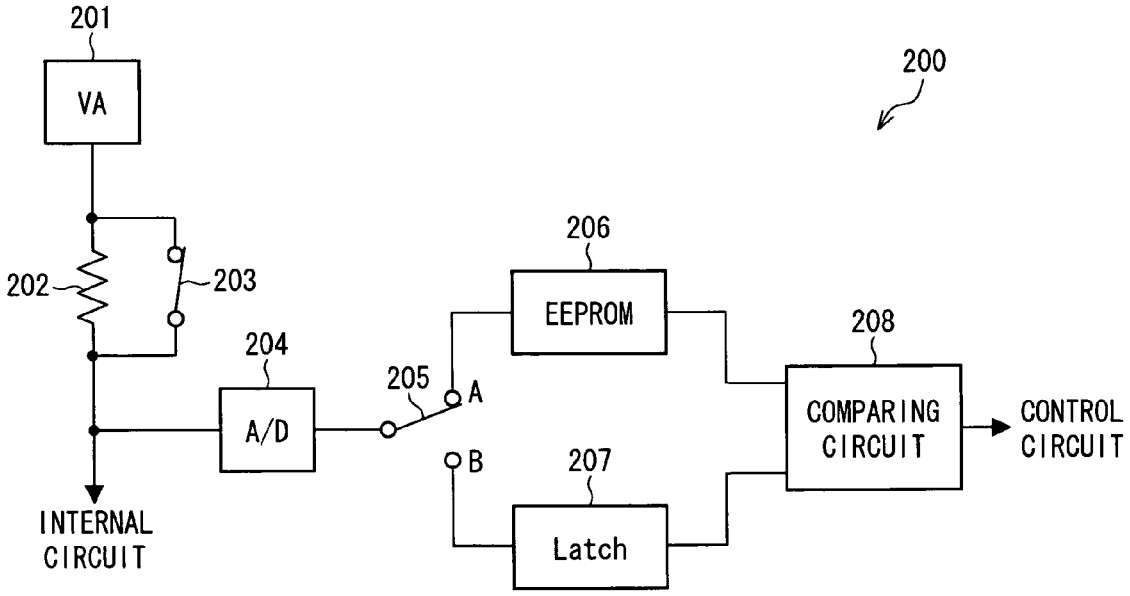
FIG. 24 is a block diagram illustrating a configuration of an operation judging circuit, according to one embodiment of the present invention.

As illustrated in FIG. 24, the operation judging circuit 200 includes a VA 201 for supplying a power source to the IC 10, a resistor 202 (detection means) and a switch 203. The resistor 202 and the switch 203 are provided between the VA 201 and the IC 10, and connected in parallel with each other. Further, the operation judging circuit 200 includes A/D converter 204 (detection means), a switch 205, an EEPROM 206 (normal current value recording means), a data latch circuit 207, and a comparator circuit 208 (current value detecting means, driving circuit judging means). The A/D convert 204 is connected with the IC 10-side of the resistor 202 and the switch 203. The switch 205 receives an output signal from the A/D converter 204. The EEPROM 206 is a non-volatile memory and connected to one output terminal of the switch 205. The data latch circuit 207 is connected to the other output terminal of the switch 205. The comparator circuit 208 compares an output value of the data latch circuit 207 with an output value of the EEPROM 206. The output terminal of the comparator circuit 208 supplies a result of the comparison to the control circuit of the IC 10. The switches 203 and 205 are switched over by the control circuit of the IC 10.

<Brief Explanation on Operation of Operation Judging Circuit 200>

The operation judging circuit 200 is arranged such that the EEPROM 206 records reference data therein, which is a value corresponds to the power source current value that the IC 10 has when it operates normally. When the operation judging circuit 200 judges whether an operational defect occurs in the IC 10, the operation judge circuit 200 detects the value of the power source current value supplied to the IC 10, and compares the detected value with the value of the reference data recorded in the EEPROM 206 in advance. If the detected value is equal to or greater than the certain value, the operation judging circuit judges that an operational defect occurs in the IC 10. Then, the operation judging circuit 200 outputs a signal to the control circuit 10, the signal indicating occurrence of a defect in the IC 10. In response to this, the control circuit 10 starts the self-inspection process and the self-healing process.

<Generation of Reference Data and Recording Process>

As described above, the operation judging circuit 200 should record the reference data in the EEPROM 206 thereof in advance. How the operation judging circuit 200 records the reference data in the EEPROM 206 is described below referring to FIG. 25, which is a flowchart illustrating how operation judging circuit 200 records the reference data in the EEPROM 206.

Figure 25:
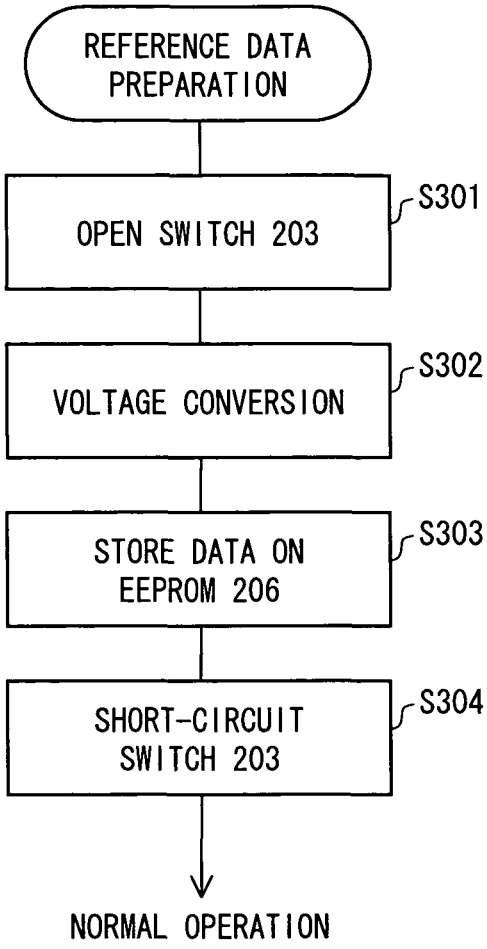
FIG. 25 is a flowchart illustrating how a power source current value of an integrated circuit under normal operation is detected and recorded, according to one embodiment of the present invention.

As illustrated in FIG. 25, the control circuit opens the switch 203 thereby to flow the power source current across the resistor 202 from the VA 201, to begin the generation of the reference data (S301). Here, the resistor 202 has a resistance that causes a voltage drop of approximately 0.1 V when the IC 10 operates normally. The resistance of the resistor 202 is preferably determined in consideration of an IC current consumption.

Then, the voltage value at the IC 10-side of the resistor 202 is converted into a digital value by the A/D converter 204 (S302). The A/D converter inputs the digital value to the EEPROM 206 via the switch 205. The EEPROM 206 receives the digital value from the A/D converter and records it as the reference data (S303). At S303, the control circuit switches over the switch 205 to connect the A/D converter 204 with the EEPROM 206.

After the EEPROM 206 records the reference data therein, then the control circuit short-circuits the switch 203 thereby to bring the IC 10 to its normal state (S304). the steps S301 to S304 in the reference data generation and recording process are carried out at shipment of the display device provided with the IC 10, that is, at a stage when the IC 10 is judged as being normal through various shipment inspection.

<Operational Defect Detection Process by Operation Judging Circuit 200>

Figure 26:
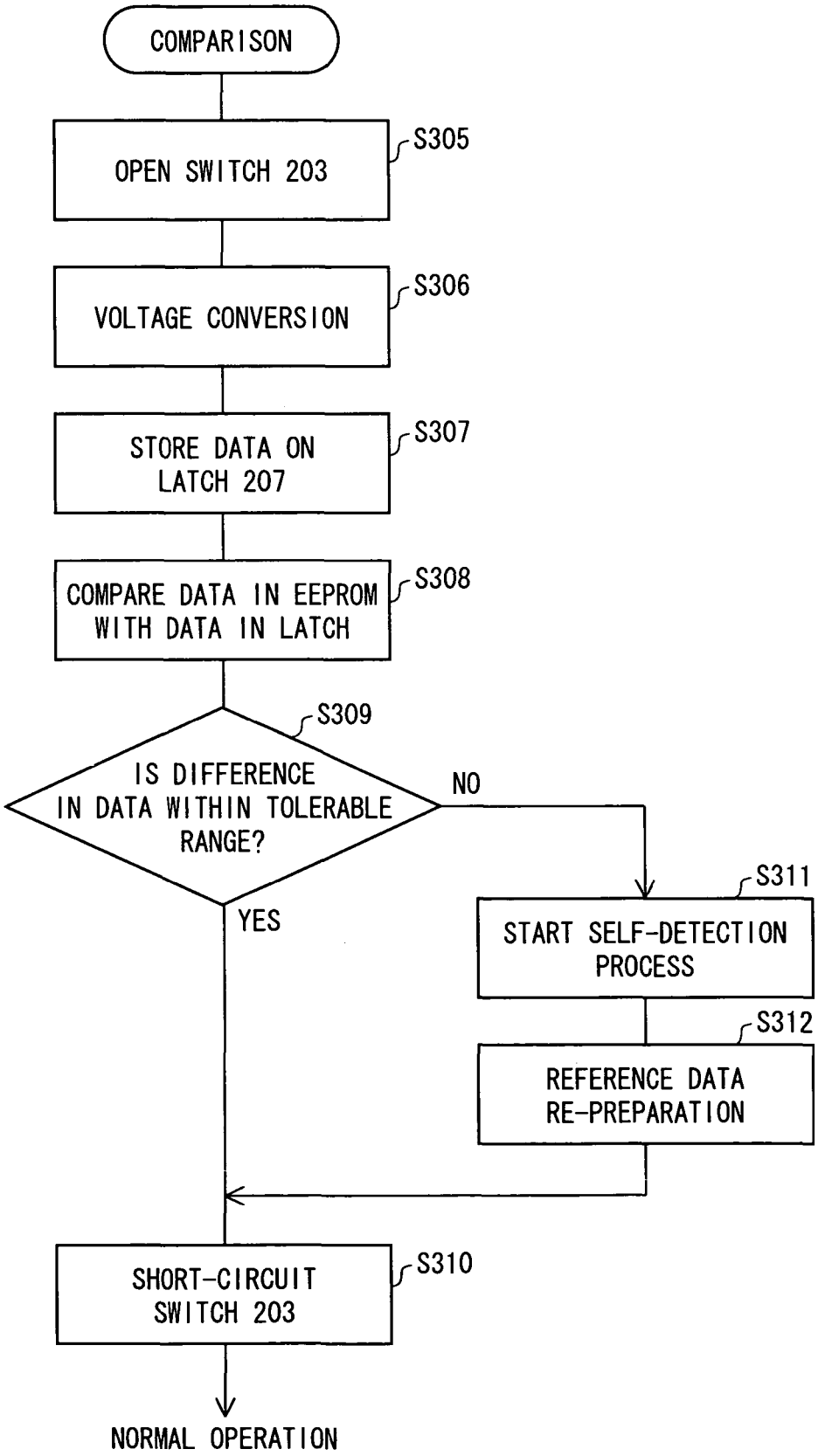
FIG. 26 is a flowchart illustrating how an operational defect in an integrated circuit is detected from the power source current value supplied to the integrated circuit, according to one embodiment of the present invention.
Figure 27:
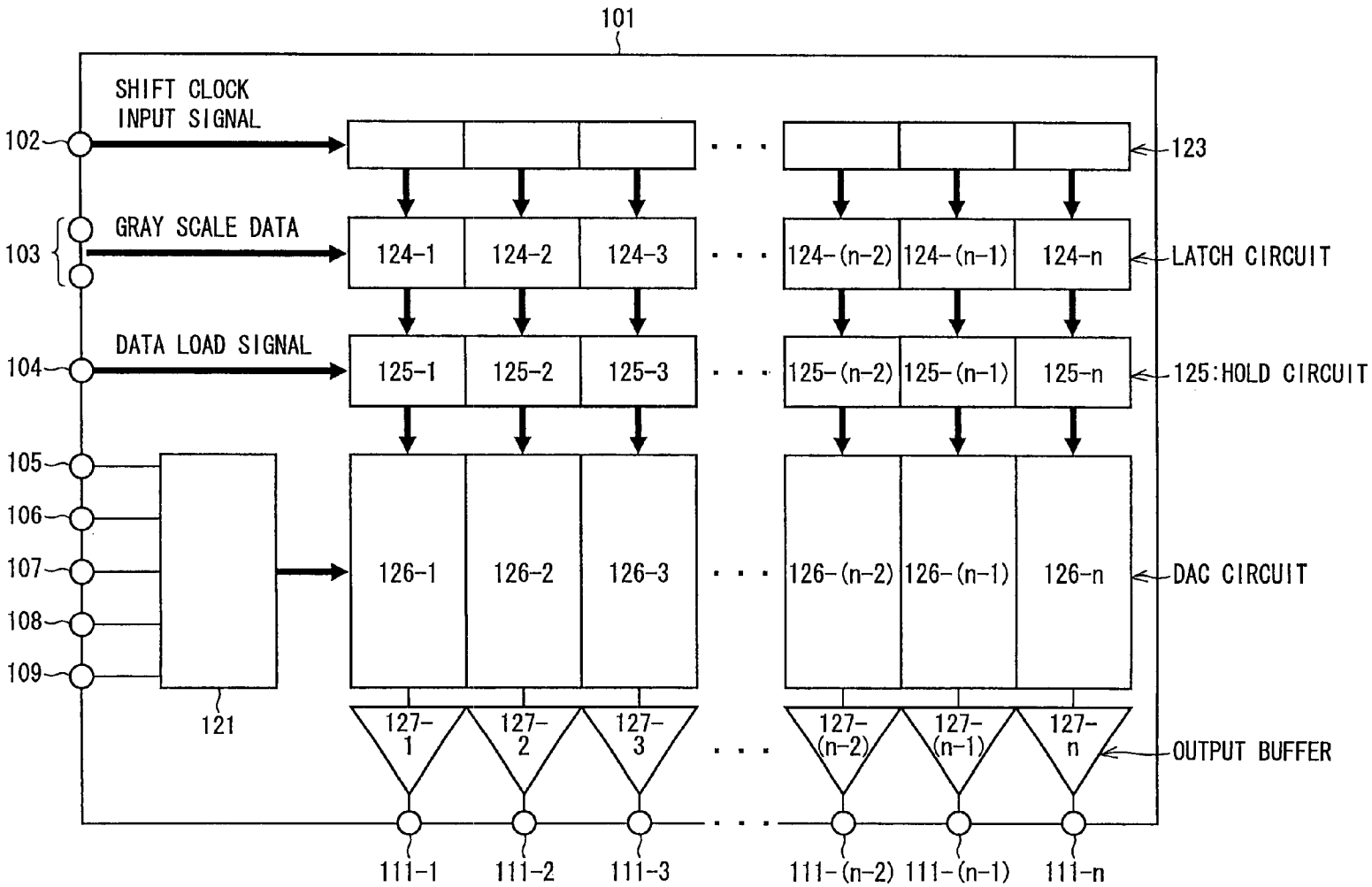
FIG. 27 is an explanatory view illustrating a configuration of a display driving semiconductor integrated circuit in a conventional example.

Next, how the operation judging circuit 200 detect an operational defect in the IC 10 is described referring to FIG. 26, which is a flowchart illustrating how the operation judging circuit 200 detect an operational defect in the IC 10.

As illustrated in FIG. 26, the control circuit opens the switch 203 thereby to flow the power source current across the resistor 202 from the VA 201 (S305).

Then, the voltage value at the IC 10-side of the resistor 202 is converted into a digital value by the A/D converter 204 (S306). The A/D converter inputs the digital value to the data latch circuit 207 via the switch 205. The data latch circuit 207 receives the digital value from the A/D converter and records it as the detected data (S307). At S306, the control circuit switches over the switch 205 to connect the A/D converter 204 with the data latch circuit 207.

Next, the comparator circuit 208 reads out the reference data recorded in the EEPROM 206, and the detected data recorded in the data latch circuit 207, and compares the reference data and the detected data thus read out (S308). Further, the comparator circuit 208 detects whether a difference between the value of the reference data and the value of the detected data is equal to or greater than a predetermined value (e.g., 3 or more as a digital value) (S309). If the difference between the value of the reference data and the value of the detected data is equal or greater than the predetermined value (e.g., 3 or more as a digital value), the comparator circuit 208 outputs the signal to the control circuit of the IC 10, the signal indicating that an operational defect occurs in the IC 10.

If the control circuit receives from the comparator circuit 208 the signal indicating that an operational defect occurs in the IC 10, the control circuit starts the self-inspection of the IC circuit (S311). Further, if the self-inspection of the IC 10 detects a defect in an output circuit block of the IC 10, the IC 10 performs the self-healing by replacing an output of the defective output block with an output of the spare output circuit block. If the self-inspection of the IC 10 at S 311 detects no defect in the output circuit blocks, the change in the power source current is considered to be caused by another factor. Thus, in this case, the operation judging circuit 200 performs the reference data generation and recording process at S301 to S304 because such a change occurs in the power source current value. Thereby, the changed power source current value is recorded as new reference data in the EEPROM 206 (S312). Furthermore, after S312, the control circuit short-circuits the switch 203 thereby to bring the operation judging circuit 200 and the IC 10 to the normal operation state (S310).

On the other hand, if at S309 the comparator circuit 208 detects that the difference between the value of the reference data and the value of the detected data is less than the predetermined value (for example, less than 3 as a digital value), the process goes to S310.

Example 2

Regular Self-Inspection of IC 10

The self-inspection (operation checking test) and self-healing of the IC 10 may be carried out regularly. More specifically, the self-inspection (operation checking test) and self-healing of the IC 10 may be carried out every vertical retrace period of the display device, which is described in Example 1. In this case, a vertical sync signal is counted and the self-inspection and self-healing of the IC 10 is carried out every display at which the count reaches a certain value. This configuration can be realized by constituting a counter with a non-volatile memory, and counting the number of the vertical sync signal by using the counter. Further, the IC 10 may includes a timer for measuring time, and uses the timer to count operation time period, so that the self-inspection and self-healing of the IC 10 can be performed every time the operation time period is accumulated to a predetermined value.

Example 3

Moreover, the self-inspection (operation checking test) and self-healing of the IC 10 may be carried out in part of a period in which the display device carries out the display of an image. For example, each pixel of the display device records the voltage of the display electrode. Thus, after the charging of the voltage to the display electrode, the display of the image on the display device will not be affected by turning the output terminals OUT 1 to OUT n of the IC 10 to high-impedance.

Therefore, in part of the period in which the image is displayed on the display device, the output terminals OUT to OUT n are turned to high impedance, and the self-inspection (operation checking test) and self-healing of the IC 10 are carried out. An example of how to turn the output terminals OUT 1 to OUT n to high impedance is providing switches to the respective signal paths connecting the output terminals OUT 1 to OUT n with the display device, and opening the switches thereby obtaining high impedance between the output terminals OUT 1 to OUT n and the display device, in other words, electrically disconnecting the output terminals OUT 1 to OUT n from the display device.

Moreover, the self-inspection (operation checking test) has various patterns as described in Embodiment 1. If there is no enough time to perform all the patterns of the self-inspection (operation checking test), only part (e.g., only one pattern) of the patterns of the self-inspection (operation checking test) may be carried out in part of the display period of one line. Thereby, all the patterns of the self-inspection (operation checking test) can be performed in a display period of one frame of the display device or over a display period of several frames of the display device. Furthermore, by adopting the arrangement in which the patterns of the self-inspection (operation checking) are performed over not in one period, but over plural periods, it is possible to perform the self-inspection (operation checking test) in the horizontal retrace period in FIG. 23.

Note that the present invention is not limited to Examples 1 to 3 which are discussed based on the IC 10 described in Embodiment 1. The configuration of Examples 1 to 3 are applicable to the ICs 10' and 20 in Embodiment 2 and 3, and the display device 90" in Embodiment 4.

Moreover, the present invention is not limited to Embodiments 1 to 4, which are discussed on a liquid crystal display device for displaying an image on a liquid display panel. The present invention is also applicable to display devices such as plasma television, other than the liquid crystal display device.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

An integrated circuit according to the present invention for driving a display device may be configured as follows.

<First Configuration>

An integrated circuit for driving a display device, the integrated circuit comprising:

an output circuit and an output buffer for each output terminal for driving the display device;

an output circuit and an output buffer in spare apart from the output circuit and the output buffer, wherein:

the output buffers are operational amplifiers, the integrated circuit has a function for automatically checking an operation of the output circuit, the operational amplifiers are operated as comparators in checking the operation of the output circuit, each operational amplifier, which is operated as the comparators, respectively compares a voltage value outputted from the output circuit in spare with a voltage value of the output circuit provided per output terminal, so as to check the operation of the output circuit provided per output terminal against that of the output circuit in spare.

<Second Configuration>

The integrated circuit as set forth in First Configuration, wherein:

an output circuit and output buffer connected to an output terminal that is judged as being defective in operation by the checking of the operation, are replaced with the output circuit and output buffer in spare so as to perform self-healing as to the output circuit and output buffer.

<Third Configuration>

An integrated circuit for driving a display device, the integrated circuit comprising:

an output circuit and an output buffer for each output terminal for driving the display device;

an output circuit and an output buffer in spare apart from the output circuit and the output buffer, wherein:

the integrated circuit has a function for automatically checking an operation of the output circuit, the integrated circuit has a register for storing a flag indicating a result of the checking of the operation, the output buffers are operational amplifiers, the operational amplifiers are operated as comparators in checking the operation of the output circuit, each operational amplifier, which is operated as the comparators, respectively compares a voltage value outputted from the output circuit in spare with a voltage value of the output circuit provided per output terminal, so as to check the operation of the output circuit provided per output terminal against that of the output circuit in spare, the flag indicating the result of the checking the operation is stored in the register, and an output circuit and output buffer connected to an output terminal for which a flag indicating the output terminal is defected is stored are replaced with the output circuit and output buffer in spare, so as to perform self-healing for the output circuit and output buffer.

<Fourth Configuration>

An integrated circuit, comprising:

an output circuit and an output buffer for each output terminal for driving the display device;

an output circuit and an output buffer in spare apart from the output circuit and the output buffer, wherein:

the output buffers are operational amplifiers, the operational amplifiers are operated as comparators, an output voltage of the comparators that is theoretically obtained from a predetermined input voltage inputted in the comparators is set as an expected value, the expected value is compared with an output voltage of an output buffer outputted from the input voltage, and if the output voltage is different from the expected value, the output buffer in spare replaces the output buffer to be used.

<Fifth Configuration>

The integrated circuit as set forth in any one of the first to fourth configurations, wherein:

the checking of the operation of the output circuit or the output buffer is carried out automatically when a power is supplied, and after self-healing by replacing a defective output circuit or output buffer with the spare circuit is carried out, an display operation is carried out.

As described above, an integrated circuit according to the present invention for driving a display panel includes: comparing means for comparing an output signal from an output circuit with an output signal from the spare output circuit; judging means for judging, based on a result of the comparison performed by the comparing means, whether or not the output circuit is defective; and connection switching means for, if the judging means judges that the output circuit is defective, connecting the spare output circuit to the output terminal, instead of the output circuit. With this configuration, the integrated circuit has concrete means for detecting a defect in the output circuit easily after the driving circuit is mounted on the display panel, and is able to perform self-healing if the output circuit is defective.

Embodiments and Examples described in the detailed explanation for the present invention are merely to facilitate understanding of the technical content of the present invention, and the present invention shall not be narrowly construed within such concrete examples. The present invention can be modified in various way within the spirit and the scope the claims as below.

INDUSTRIAL APPLICABILITY

The present invention provides an integrated circuit for driving a display device, the integrated circuit concretely having means for detecting an output circuit and means for self-healing and being able to deal with a defect in the output circuit more easily. Especially, the present invention is applicable to a large-size liquid crystal display device or a television with high definition.

The invention claimed is:

1. A driving circuit for driving a display panel, comprising:

an output terminal connected to the display panel;

an output circuit block including an output circuit capable of being connected with the output terminal;

a spare output circuit block including a spare output circuit capable of being connected with the output terminal;

an operational amplifier to be selectively used as one of a comparing circuit to compare an output signal from the output circuit with an output signal from the spare output circuit and a buffer circuit such that the buffer circuit is a voltage follower;

a judging circuit to judge, based on a result of the comparison performed by the operational amplifier, whether or not the output circuit is defective;

a connection switch to switch, if the judging circuit judges that the output circuit is defective, connecting the spare output circuit to the output terminal, instead of the output circuit;

a memory to store a flag indicating the result of the judging performed by the judging circuit, and if the flag is of indicating that the output circuit is defective, the connection switch connects the spare output circuit with the output terminal, instead of the output circuit.

2. The driving circuit as set forth in claim 1, comprising:

a controller to control an input signal that is to be inputted to the output circuit and the spare output circuit, wherein the controller inputs signals of different size to the output circuit and the spare output circuit, respectively, the controller outputs an expected value that indicates an expected result of the comparison performed with the input signals of different sizes by the comparing circuit, and if the result of the comparison is different from the expected value, the judging circuit determines that the output circuit is defective.

3. A display device, comprising a driving circuit as recited in claim 2.

4. The driving circuit as set forth in claim 1, wherein the following are performed in a period in which the following do not affect an image displayed by the display panel, the comparison performed by the operational amplifier;

the judging performed by the judging circuit;

the switching, performed by the connection switch, to the spare output circuit from the output circuit judged as being defective; and outputting the output signal to the output terminal from the spare output circuit after the connection switch connects the output terminal with an output of the spare output circuit.

5. A display device, comprising a driving circuit as recited in claim 4.

6. The driving circuit as set forth in claim 1, wherein right after turning ON the display panel, the following are performed, the comparison performed by the operational amplifier;

the judging performed by the judging circuit; and the switching, performed by the connection switch, to the spare output circuit from the output circuit judged as being defective.

7. The driving circuit as set forth in claim 1, wherein in a vertical retrace period of the display panel, the following are performed, the comparison performed by the operational amplifier;

the judging performed by the judging circuit; and the switching, performed by the connection switch, to the spare output circuit from the output circuit judged as being defective.

8. The driving circuit as set forth in claim 1, further comprising:

a blocking circuit to block a signal path from the output terminal to the display panel, the following being performed after the blocking circuit blocks the signal path from the output terminal to the display panel:

the comparison performed by the operational amplifier;

the judging performed by the judging circuit; and the switching, performed by the connection switch, to the spare output circuit from the output circuit judged as being defective.

9. A display device, comprising a driving circuit as recited in claim 1.

10. A television system, comprising a display device according to claim 9.

11. A driving circuit for driving a display panel, comprising:

an output terminal connected to the display panel;

an output circuit block including an output circuit capable of being connected with the output terminal;

a spare output circuit block including a spare output circuit capable of being connected with the output terminal;

an operational amplifier to be selectively used as one of a comparing circuit to compare an output signal from the output circuit with an output signal from the spare output circuit and a buffer circuit such that the buffer circuit is a voltage follower;

a judging circuit to judge, based on a result of the comparison performed by the operational amplifier, whether or not the output circuit is defective;

a connection switch to switch, if the judging circuit judges that the output circuit is defective, connecting the spare output circuit to the output terminal, instead of the output circuit;

a detector to detect a current value of a power source current supplied to the driving circuit;

a memory to store a current value that the power source current has when the driving circuit is operating without defect, is stored in advance;

a current value comparing circuit to compare the current value of the power source current detected by the detector, with the current value stored in the memory; and a driving circuit judging circuit, based on a result of the comparison performed by the current value comparing circuit, to determine if the driving circuit is defective, if the driving circuit is defective, the following being performed, the comparison performed by the operational amplifier;

the judging performed by the judging circuit; and the switching, performed by the connection switch, to the spare output circuit from the output circuit judged as being defective.

12. A display device, comprising a driving circuit as recited in claim 11.

* * * * *